US011460239B2

(12) United States Patent
Chu et al.

(10) Patent No.: US 11,460,239 B2
(45) Date of Patent: Oct. 4, 2022

(54) REFRIGERATOR

(71) Applicant: LG Electronics Inc., Seoul (KR)

(72) Inventors: Yunsu Chu, Seoul (KR); Joonghan Son, Seoul (KR); Younghun Son, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/089,423

(22) Filed: Nov. 4, 2020

(65) Prior Publication Data

US 2021/0131720 A1 May 6, 2021

(30) Foreign Application Priority Data

Nov. 5, 2019 (KR) ..... 10-2019-0140339
Feb. 19, 2020 (KR) ..... 10-2020-0020295

(51) Int. Cl.
*F25D 23/02* (2006.01)
*F25D 29/00* (2006.01)
*F25D 27/00* (2006.01)

(52) U.S. Cl.
CPC ..... *F25D 23/028* (2013.01); *F25D 29/005* (2013.01); *F25D 27/005* (2013.01); *F25D 2323/021* (2013.01); *F25D 2400/361* (2013.01)

(58) Field of Classification Search
CPC .... F25D 23/028; F25D 29/005; F25D 27/005; F25D 2323/021; F25D 2400/361;
(Continued)

(56) References Cited

U.S. PATENT DOCUMENTS 8,960,934 B2 * 2/2015 Sung ..... F25D 29/005 362/218
10,180,748 B2 * 1/2019 Kim ..... G06F 3/0416
(Continued)

FOREIGN PATENT DOCUMENTS

CN 104136974 11/2014
CN 205014747 2/2016
(Continued)

OTHER PUBLICATIONS

EP Extended European Search Report in European Appln. No. 20205581.0, dated Apr. 7, 2021, 8 pages.
(Continued)

*Primary Examiner* — Hiwot E Tefera
(74) *Attorney, Agent, or Firm* — Fish & Richardson P.C.

(57) ABSTRACT

A refrigerator includes a cabinet and a door. The door includes an outer plate that includes a display part having through holes and a touch manipulation part positioned at a lower side of the display part. The display part and the touch manipulation part are integrally formed. A display cover is mounted on a rear surface of the outer plate. An inner case is mounted on the rear surface of the outer plate to surround the display cover and communicates with an opening formed in a peripheral surface of the door. A display assembly can be inserted into the display cover through the opening. A touch sensor assembly is mounted onto the display cover at a position corresponding to the touch manipulation part. Light emitting members of the display assembly can be positioned above the touch sensor assembly when the display assembly has been inserted into the display cover.

20 Claims, 34 Drawing Sheets

(58) Field of Classification Search
CPC ..... F25D 23/02; F25D 2400/40; F25D 27/00; G06F 3/0412; G06F 3/0416; G06F 3/0488
See application file for complete search history.

(56) References Cited

U.S. PATENT DOCUMENTS

| | | | | |
|---|---|---|---|---|
| 10,378,815 | B2 * | 8/2019 | Lee | F25D 29/005 |
| 10,508,856 | B2 * | 12/2019 | Kim | F25D 23/028 |
| 10,564,769 | B2 * | 2/2020 | Kim | G06F 3/0414 |
| 2011/0243656 | A1 * | 10/2011 | Ikekame | B29C 65/607 403/345 |
| 2014/0300263 | A1 * | 10/2014 | Sung | F25D 23/028 312/404 |
| 2015/0042904 | A1 | 2/2015 | Shiraishi | |
| 2015/0192352 | A1 * | 7/2015 | Sung | F25D 23/028 29/890.035 |
| 2016/0003519 | A1 * | 1/2016 | Kim | F25D 29/005 49/70 |
| 2016/0117022 | A1 | 4/2016 | Kim et al. | |
| 2016/0178276 | A1 * | 6/2016 | Park | H03K 17/962 345/173 |
| 2016/0178277 | A1 * | 6/2016 | Park | G06F 3/0414 345/173 |
| 2016/0188093 | A1 * | 6/2016 | Kim | F25D 29/005 345/173 |
| 2016/0327332 | A1 * | 11/2016 | Kim | F25D 23/028 |
| 2016/0334158 | A1 * | 11/2016 | Joo | F25D 25/021 |
| 2017/0153055 | A1 * | 6/2017 | Hong | F25D 23/028 |

FOREIGN PATENT DOCUMENTS

| | | |
|---|---|---|
| CN | 106104182 | 11/2016 |
| CN | 106123454 | 11/2016 |
| CN | 106196857 | 12/2016 |
| EP | 2891854 | 7/2015 |
| JP | 2015055361 | 3/2015 |
| KR | 20170040710 | 4/2017 |

OTHER PUBLICATIONS

Office Action in Chinese Appln. No. 202011202618.8, dated Jan. 24, 2022, 18 pages (with English translation).

* cited by examiner

REFRIGERATOR

CROSS-REFERENCE TO RELATED APPLICATIONS

The present application claims priority under to Korean Patent Application No. 10-2020-0020295, filed on Feb. 19, 2020, and Korean Patent Application No. 10-2019-0140339, filed on Nov. 5, 2019, the disclosures of which are hereby incorporated by reference in their entireties.

TECHNICAL FIELD

The present disclosure relates to a refrigerator.

BACKGROUND

In general, a refrigerator is a home appliance that allows low-temperature storage of food in an internal storage space that can be closed by a door. The refrigerator can maintain the stored food in an optimal state by cooling the storage space using a cold air. Such a cold air can be generated through heat exchange with a refrigerant that circulates in a refrigeration cycle.

Refrigerators have been gradually becoming larger and multifunctional in accordance with changes in dietary life and the trend of high-end products. Accordingly, refrigerators have been developed which include various structures and convenience devices that may improve users' convenience and efficient use of the internal space of the refrigerators.

A refrigerator may include a display for displaying an operating state of the refrigerator. Such a display may be provided on the door of the refrigerator. In addition, the display may display various types of information according to the operation of the refrigerator, using numbers, letters, symbols, or pictures.

Accordingly, a user can see information output through the display, determine the operating state of the refrigerator, and accordingly control the operation of the refrigerator.

In certain refrigerators, a front of a refrigerator door may include an outer plate that is made of a metal material and that includes a display part having a plurality of through holes and a touch manipulation part configured to receive a user's touch input. A display assembly and a touch assembly may be disposed inside the door.

However, the mounting structure of the display assembly and the touch assembly in such conventional refrigerators is complicated. Further, it is difficult to align the through holes and LEDs of the display assembly.

SUMMARY

Implementations of the present disclosure provide a refrigerator that includes a simple configuration of a display assembly, thereby allowing easy assembly and improving productivity.

Implementations of the present disclosure provide a refrigerator that enables a display assembly to be positioned at an accurate position on a display part when the display assembly is inserted and mounted.

Implementations of the present disclosure provide a refrigerator that is capable of improving heat-insulation performance of a door by making a display assembly slim.

Implementations of the present disclosure provide a refrigerator in which a display assembly and through holes of a display part are easily aligned.

Implementations of the present disclosure provide a refrigerator that is capable of improving identification through a display part.

Particular implementations of the present disclosure provide a refrigerator that includes a cabinet that defines a storage space, and a door configured to open and close the storage space. The door may include an outer plate, a display cover, an inner case, a door liner, an insulating material, a display assembly, and a touch sensor. The outer plate includes a metal material and includes a front surface and a rear surface opposite to the front surface. The front surface of the outer plate defines a front appearance of the door. The outer plate includes (i) a display part that includes a plurality of first through holes configured to display information of the refrigerator and (ii) a touch manipulation part that is connected to the display part and configured to receive a user input. The display cover is mounted to the rear surface of the outer plate. The inner case is mounted to the rear surface of the outer plate and surrounds the display cover. The inner case and the outer plate define a space that communicates with an opening that is defined at a peripheral surface of the door. The door liner defines a rear surface of the door opposite to the front appearance of the door. An insulating material is disposed between the outer plate and the door liner. A display assembly is configured to be inserted into the display cover through the opening at the peripheral surface of the door, and includes a plurality of light emitters configured to emit light that passes through the plurality of first through holes. A touch sensor assembly is mounted to the display cover at a position corresponding to the touch manipulation part and is configured to detect a user's touch operation on the outer plate. The touch manipulation part is disposed vertically below the display part. The light emitters are positioned vertically above the touch sensor assembly based on the display assembly being inserted into the display cover.

In some implementations, the refrigerator can optionally include one or more of the following features. The display assembly may include a display printed circuit board (PCB) that includes the plurality of light emitters, and a display frame that is coupled to the display PCB and inserted into the display cover. The display frame may include a lower end and an upper end opposite vertically to the lower end, and defines a lower opening that extends at the lower end of the display frame. The touch sensor assembly may be positioned at the lower opening based on the display assembly being inserted into the display cover. The display frame may include a frame light guide that is positioned vertically above the lower opening, and that includes a plurality of third through holes configured to guide light emitted from the light emitters toward the first through holes. The display frame may include a first side extension and a second side extension that extend vertically from opposite ends of the frame light guide. The lower opening of the display frame may be defined between the first side extension and the second side extension. Based on the display assembly being inserted into the display cover, the touch sensor assembly is inserted into the lower opening of the display frame. The first side extension part and the second side extension part may include pressing protrusions that contact a rear surface of the display cover and press the display frame against the rear surface of the display cover. A sensor assembly mounting portion may be recessed from a front surface of the display cover that is opposite to the rear surface of the display cover. The touch sensor assembly may be mounted on the sensor assembly mounting portion. The touch sensor assembly includes a touch PCT, an elastic member, and a touch cover. The touch PCB is received in the sensor assembly mounting portion and mounts a touch sensor. The elastic member is mounted in the sensor assembly mounting portion and supports the touch PCB. The touch cover is configured to close an open surface of the sensor assembly mounting portion and contacts the rear surface of the outer plate and transmits the user's touch operation on the outer plate to the touch sensor.

Particular implementations of the present disclosure provide a refrigerator that includes a cabinet that defines a storage space, and a door configured to open and close the storage space. The door may include an outer plate, a display cover, an inner case, a door liner, an insulating material, and a display assembly. The outer plate includes a metal material and includes a front surface and a rear surface opposite to the front surface. The front surface of the outer plate defines a front appearance of the door. The outer plate includes a display part that includes a plurality of first through holes configured to display information of the refrigerator. The display cover is mounted to the rear surface of the outer plate. The inner case is mounted to the rear surface of the outer plate and surrounds the display cover. The inner case and the outer plate define a space that communicates with an opening that is defined at a peripheral surface of the door. The door liner defines a rear surface of the door opposite to the front appearance of the door. The insulating material that is disposed between the outer plate and the door liner. The display assembly is configured to be inserted into the display cover through the opening at the peripheral surface of the door. The display assembly may include a display frame, a display PCB, a light emitter, and a microcomputer. The display frame is inserted into the display cover and defines a frame opening through the display frame. The display PCB is coupled to the display frame. The light emitter is mounted to a surface of the display PCB and faces the plurality of first through holes. The microcomputer is mounted to the surface of the display PCB and disposed in the frame opening.

In some implementations, the refrigerator can optionally include one or more of the following features. The display frame includes a frame light guide that contacts the surface of the display PCB and defines third through holes configured to guide light emitted from the light emitter toward the first through holes. The frame opening extends horizontally through the display frame and is disposed vertically above the frame light guide. A part of the display PCB to which the light emitter is mounted is shielded by the light guide. A part of the PCB to which the microcomputer is mounted is exposed through the frame opening. Based on the display assembly being inserted into the display cover, the frame opening is positioned vertically above the display cover, and the microcomputer is exposed to outside of the display cover. The display frame may include a first side extension and a second side extension, a frame light guide, and a handle portion. The first side extension and the second side extension vertically extend from opposite sides and that are spaced apart from each other. The frame light guide connects the first side extension and the second side extension and defines a third through hole configured to guide light emitted from the light emitter toward the first through holes. The handle portion extends vertically and connects ends of the first side extension and the second side extension. The frame opening is defined by the first side extension, the second side extension, the frame light guide, and the handle portion.

Particular implementations of the present disclosure provide a refrigerator that includes a cabinet that defines a storage space, and a door configured to open and close the storage space. The door may include an outer plate, a display cover, an inner case, a door liner, an insulating material, and a display assembly. The outer plate includes a metal material and includes a front surface and a rear surface opposite to the front surface. The front surface of the outer plate defines a front appearance of the door. The outer plate includes a display part that includes a plurality of first through holes configured to display information of the refrigerator. The display cover is mounted to the rear surface of the outer plate. The inner case is mounted to the rear surface of the outer plate and surrounds the display cover. The inner case and the outer plate define a space that communicates with an opening that is defined at a peripheral surface of the door. The door liner is coupled to the outer plate and defines a rear surface of the door opposite to the front appearance of the door. The insulating material is disposed between the outer plate and the door liner. The display assembly is configured to be inserted into the display cover through the opening at the peripheral surface of the door. The display assembly includes a plurality of light emitters configured to emit light that passes through the plurality of first through holes. The display assembly may include a display PCB, a frame light guide, a display frame, and a handle portion. The display PCB includes a surface to which the plurality of light emitters are mounted. The frame light guide defines a third through hole and contacts the surface of the display PCB such that the light emitted from the plurality of light emitters are guided toward the plurality of first through holes. The display frame is coupled to the display PCB and connected to the frame light guide. The handle portion extends from an end of the display frame toward the opening at the peripheral surface of the door. The display frame includes a plurality of fastening protrusions. The display PCB defines a plurality of fastening holes that correspond to the fastening protrusions. The fastening protrusions of the display frame are engaged with the fastening holes of the display PCB such that the display frame and the display PCB are coupled to each other. The display frame includes a plastic material. Ends of the plurality of fastening protrusions that extends through the plurality of fastening holes are fused and bonded around the fastening holes. The plurality of fastening protrusions and the plurality of fastening holes are disposed along the plurality of light emitters. The display frame defines a PCB accommodating space that is configured to receive the display PCB. The plurality of fastening protrusions are disposed at the PCB accommodating space.

Particular implementations of the present disclosure provide a refrigerator that includes a cabinet that defines a storage space, and a door configured to open and close the storage space. The door may include an outer plate, a cover light guide, a display cover, an inner case, a door liner, an insulating material, and a display assembly. The outer plate includes a metal material and includes a front surface and a rear surface opposite to the front surface. The front surface of the outer plate defines a front appearance of the door. The outer plate includes a display part that includes a plurality of first through holes configured to display information of the refrigerator. The cover light guide defines a plurality of second through holes. The display cover includes an open upper surface and is connected to the cover light guide such that the plurality of second through holes communicate with the plurality of first through holes of the display part. The display cover is mounted to the rear surface of the outer plate. The inner case is mounted to the rear surface of the outer plate and surrounds the display cover. The inner case and the outer plate define a space that communicates with an opening that is defined at the door. The door liner defines a rear surface of the door opposite to the front appearance of the door. The insulating material is disposed between the outer plate and the door liner. The display assembly is configured to be inserted into the display cover through the opening at the door. The display assembly may include a display frame, a display PCB, and a plurality of light emitters. The display frame includes a handle portion and a guide accommodating portion that is defined at a front surface of the display frame vertically below the handle portion. The display PCB is coupled to a rear surface of the display frame opposite to the front surface of the display frame. The plurality of light emitters are disposed at the display PCB and correspond to the guide accommodating portion of the display frame. The plurality of light emitters are configured to emit light that passes through the second through holes and the first through holes. Based on the display assembly being inserted through the open upper surface of the display cover, the cover light guide of the door is received in the guide accommodating portion of the display frame. The display frame includes a frame light guide that contacts the display PCB and includes a plurality of third through holes configured to guide light emitted from the plurality of light emitters toward the first through holes. The guide accommodating portion is recessed at the frame light guide. The plurality of first through holes, the plurality of second through holes, and the plurality of third through holes communicate with one another based on the display assembly being inserted into the display cover. The display frame further include a first side extension and a second side extension that extend vertically from opposite side ends of the frame light guide, and that contact opposite side ends of the display cover. The display frame further includes a first side protrusion and a second side protrusion that extend vertically and are disposed at the first side extension and the second side extension. The display cover defines a first side opening and a second side opening that receive, and are engaged with, the first side protrusion and the second side protrusion based on the display assembly being inserted in to the display cover. The cover light guide is disposed between the first side opening and the second side opening. The frame light guide and the cover light guide include inclined surfaces that are configured to contact each other and guide the cover light guide to the guide accommodating portion based on the display assembly being inserted into the display cover.

According to an implementation, a refrigerator includes a cabinet configured to define a storage space, and a door configured to open and close the storage space. The door includes an outer plate formed of a metal material to define a front appearance of the door and including a display part which displays operation information by a combination of a plurality of first through holes that are fine in size and a touch manipulation part which is positioned on a lower side of the display part and is operated by a user. The display part and the touch manipulation part may be integrally formed. A display cover may be mounted on a rear surface of the outer plate. An inner case may be mounted on the rear surface of the outer plate to surround the display cover and communicating with an opening formed at one side of a peripheral surface of the door. A door liner may be configured to define a rear surface of the door. An insulating material may be filled between the outer plate and the door liner. A display assembly may be inserted into the display cover by passing through the opening from outside of the door. The display assembly may include a plurality of light emitting members which emit light to pass through the first through holes. A touch sensor assembly may be mounted onto the display cover at a position corresponding to the touch manipulation part to detect a user's touch operation on the outer plate. The light emitting members may be positioned above the touch sensor assembly when the display assembly has been inserted into the display cover.

The display assembly may include a display printed circuit board (PCB) on which the plurality of light emitting members are mounted, and a display frame coupled to the display PCB and inserted into the display cover. The display frame may be formed with a lower opening extending upward at a lower end thereof and the touch sensor assembly is positioned in the lower opening when the display assembly has been inserted into the display cover.

The display frame may include a frame light guide positioned on a upper side of the lower opening and having a plurality of third through holes that guide light emitted from the light emitting members toward the first through holes. The display frame may further include a first side extension and a second side extension extending downward from both ends of the frame light guide. The lower opening may be formed between the first side extension and the second side extension, and when the display assembly is inserted into the display cover, the touch sensor assembly is inserted into the lower opening.

The first side extension part and the second side extension part may be formed with pressing protrusions protruding to contact a rear surface of the display cover to press the display frame forward.

A sensor assembly mounting portion is formed to be recessed from a front surface of the display cover to mount the touch sensor assembly. The touch sensor assembly may include a touch PCB which is accommodated in the sensor assembly mounting portion and on which a touch sensor is mounted. An elastic member may be mounted in the sensor assembly mounting portion to support the touch PCB. A touch cover may be configured to shield an open front surface of the sensor assembly mounting portion and contacting a rear surface of the outer plate to transmit the user's touch operation on the outer plate to the touch sensor.

According to another implementation of the present disclosure, a refrigerator includes a cabinet configured to define a storage space, and a door configured to open and close the storage space. The door may include an outer plate formed of a metal material to define a front appearance of the door and including a display part which displays operation information by a combination of a plurality of first through holes that are fine in size. A display cover may be mounted on a rear surface of the outer plate. An inner case may be mounted on the rear surface of the outer plate to surround the display cover and communicating with an opening formed at one side of a peripheral surface of the door. A door liner may be configured to define a rear surface of the door. An insulating material may be filled between the outer plate and the door liner. A display assembly may be inserted into the display cover through the opening from outside of the door. The display assembly may include a display frame inserted into the display cover and having a frame opening therethrough. A display PCB may be coupled to a rear surface of the display frame. A light emitting member may be installed on a front surface of the display PCB to face the first through holes. A microcomputer may be installed on the front surface of the display PCB to be disposed in the frame opening.

The display frame may include a frame light guide configured to contact the front surface of the display PCB and having third through holes that guide light emitted from the light emitting member toward the first through holes.

The frame opening may be formed to pass through the display frame in a front-rear direction on an upper side of the frame light guide.

A part of the PCB on which the light emitting member is mounted may be shielded by the light guide. A part of the PCB on which the microcomputer is mounted may be exposed through the frame opening.

When the display assembly has been inserted into the display cover, the frame opening may be positioned above the display cover, and the microcomputer is exposed to outside of the display cover.

The display frame may include a first side extension and a second side extension formed to vertically extend from both sides spaced apart from each other. A frame light guide may be configured to connect the first side extension and the second side extension and formed with a third through hole that guide light emitted from the light emitting member toward the first through holes. A handle portion may be configured to connect upper ends of the first side extension and the second side extension and extending upward. The frame opening may be defined by the first side extension, the second side extension, the frame light guide, and the handle portion.

According to still another implementation of the present disclosure, a refrigerator includes a cabinet configured to define a storage space, and a door configured to open and close the storage space. The door may include an outer plate formed of a metal material to define a front appearance of the door and including a display part which displays operation information by a combination of a plurality of first through holes that are fine in size. A display cover may be mounted on a rear surface of the outer plate. An inner case may be mounted on the rear surface of the outer plate to surround the display cover and communicating with an opening formed at one side of a peripheral surface of the door. A door liner may be coupled to the outer plate to define a rear surface of the door. An insulating material may be filled between the outer plate and the door liner. A display assembly may be inserted into the display cover by passing through the opening from outside of the door. The display assembly may include a plurality of light emitting members which emit light to pass through the first through holes. The display assembly may include a display PCB on which the plurality of light emitting members are mounted on a front surface thereof. A display frame may be coupled to the display PCB and integrally formed with a frame light guide in which a third through hole is formed in contact with a front surface of the display PCB to guide light emitted from the light emitting member toward the first through holes. A handle portion may extend from an upper end of the display frame toward the opening.

A plurality of fastening protrusions may protrude from a rear surface of the display frame. A plurality of fastening holes may be formed in the display PCB at positions corresponding to the fastening protrusions. The fastening protrusions may be coupled to the fastening holes such that the display frame and the display PCB are coupled to each other.

The display frame may be formed of a plastic material, and an end of the fastening protrusion protruding through the fastening hole may be fused and bonded around the fastening hole.

The plurality of fastening protrusions and the plurality of fastening holes may be arranged along arrangement of the light emitting members.

A PCB accommodating space may be formed to be recessed from a rear surface of the display frame to accommodate the display PCB, and the fastening protrusions may be formed inside the PCB accommodating space.

According to still another implementation of the present disclosure, a refrigerator includes a cabinet configured to define a storage space, and a door configured to open and close the storage space. The door may include an outer plate formed of a metal material to define a front appearance of the door and including a display part which displays operation information by a combination of a plurality of first through holes that are fine in size. A display cover may have an open upper surface, may be integrally formed with a cover light guide having second through holes communicating with the first through holes in a front surface thereof, and may be mounted on a rear surface of the outer plate. An inner case may be mounted on the rear surface of the outer plate to surround the display cover and may communicate with an opening formed in an upper surface of the door. A door liner may be configured to define a rear surface of the door. An insulating material may be filled between the outer plate and the door liner. A display assembly may be inserted into the display cover through the opening from outside of the door. The display assembly may include a display frame including a handle portion and a guide accommodating portion formed in such a way that a part of a front surface thereof is recessed on a lower side of the handle portion. A display PCB may be coupled to a rear surface of the display frame. A plurality of light emitting members may be provided on a front surface of the display PCB corresponding to the guide accommodating portion to emit light to pass through the second through holes and the first through holes. When the display assembly has been inserted through the open upper surface of the display cover, the cover light guide maintains a state of being accommodated in the guide accommodating portion.

The display frame may include a frame light guide configured to contact the front surface of the display PCB and having third through holes that guide light emitted from the light emitting member toward the first through holes. The guide accommodating portion may be formed to be recessed in the frame light guide, and the first through holes, the second through holes, and the third through holes communicate with one another when the display assembly has been inserted into the display cover.

The display frame may further include a first side extension and a second side extension extending in a vertical direction from both side ends of the frame light guide to contact both side ends of the display cover. A first side protrusion and a second side protrusion extending in a vertical direction may be formed on front surfaces of the first side extension and the second side extension. A first side opening and a second side opening to which the first side protrusion and the second side protrusion may be inserted and coupled when the display assembly is inserted may be formed in a front surface of the display cover.

The cover light guide may be formed between the first side opening and the second side opening.

A lower end of the frame light guide and an upper end of the cover light guide may be formed with inclined surfaces having corresponding inclinations. The inclined surfaces may contact each other to guide the cover light guide to the guide accommodating portion when the display assembly is inserted.

According to still another implementation of the present disclosure, a refrigerator includes a cabinet configured to define a storage space, a door configured to open and close the storage space and formed with a display part having a plurality of through holes, and a display assembly provided in the door. The display assembly may include a PCB including a light emitting member, and a display frame to guide mounting of the PCB. The display frame may include a reflector which is integrally formed with the display frame and is open at a position corresponding to the light emitting member to guide light emitted from the light emitting member to pass through the through hole.

According to the refrigerator according to the implementations of the present disclosure, the following effects may be expected.

According to implementations of the present disclosure, there is provided a structure in which the PCB on which the light emitting members are mounted is integrally coupled to the display frame mounted on the display cover. In particular, the display frame may enable a structure for mounting of a display PCB, a structure for guiding light emitted from the light emitting member, and a structure inserted into the display cover in a single configuration to simplify the overall structure and improve assembly workability and productivity.

In particular, since the display PCB is fixed in a state of being accommodated in the display frame, it is possible to prevent light from leaking from the light emitting member, and make the arrangement space compact.

In addition, the display PCB is fixed to the display frame by having a structure that fuses the fastening protrusion integrally formed with the display frame while being inserted into the fastening groove, thus achieving a structure in which the display frame and the display PCB are rigidly fixed.

That is, the display PCB and the display frame may be in close contact with each other even at a position close to a plurality of light emitting members. A coupling structure can be provided even in a narrow space compared to a screw fastening method. In addition, adjacent portions where the plurality of light emitting members are disposed can be in close contact with the frame light guide of the display frame, thereby improving the identification of the display part.

In addition, inclined portions are formed in the first side extension and the second side extension on both sides of the display frame to facilitate insertion into the inside of the display cover and to allow the display frame to be inserted in an accurate position, thereby enabling workability.

In addition, the pressing protrusion is formed in the display frame so that the front surface of the display frame is in close contact with the rear surface of the display cover, and thus the second through holes and the third through holes communicate with each other while being in close contact with each other, to allow light emitted from the light emitting member to be guided to pass through the first through holes without leaking.

In addition, the first side protrusion and the second side protrusion are formed in the first and second side extensions, respectively, and the first side opening and the second side opening into which the first and second side protrusions are inserted are formed in the display cover to guide the display assembly to be coupled to an accurate position inside the display cover when the display assembly is inserted.

In addition, even when the display assembly is fixedly mounted on the display cover, the rigid coupling structure is maintained, so that the first through holes, the second through holes, and the third through holes are aligned even when the door is repeatedly opened and closed.

That is, when the display assembly is inserted and mounted, mis-assembly is prevented, the display assembly is positioned at an accurate position, and the assembled position can be continuously maintained, thereby ensuring the identification of the display.

In addition, the elastic member, the touch PCB, and the touch cover constituting the display are mounted on the display cover, thus simplifying the mounting structure of the touch sensor assembly.

In addition, the sensor assembly mounting portion on which the touch sensor assembly is mounted protrudes rearward, and has a coupling structure with the first side extension and the second side extension of the display frame to guide the mounting of the display assembly and maintain the mounted state.

In addition, in the implementations of the present disclosure, a reflector for guiding light emitted from an LED to the front panel is integrally formed with the frame assembly. Therefore, assembly is more convenient, and a problem occurring in light guidance due to an error in assembly is prevented compared to a case where a reflector is separately provided and assembled to the frame assembly.

In addition, in the present disclosure, the touch assembly may be integrally formed with the cover assembly. Therefore, compared to a case where the touch assembly is separately manufactured and mounted, there is an advantage in that a defect of a touch signal is prevented and work efficiency is improved.

Further, in the present disclosure, all unnecessary parts may be removed from the cover assembly and the frame assembly. For example, the cover assembly and the frame assembly are configured such that one of the overlapping portions is removed. Therefore, since the redundant portion is removed entirely, there is an effect of reducing the weight and reducing the material cost.

In addition, according to the present disclosure, the number of parts decreases entirely, so that the manufacturing processes are changed, thereby dramatically reducing the assembly processes. Therefore, there is an effect of improving workability and increasing price competitiveness.

Further, in the present disclosure, the display part is formed on the upper side, the manipulation part is formed on the lower part, the light emitting member corresponding to the display part is disposed on the upper side, and the touch sensor assembly corresponding to the manipulation part is disposed on the lower side. Accordingly, it is possible to minimize the horizontal widths of the display cover and the inner case for accommodating the display assembly disposed inside the door, and thus, the heat-insulation performance of the door is improved by allowing the insulating material to occupy a larger area of the door.

In addition, in the present disclosure, the display PCB is mounted on the display frame that enters and exits the display cover, and the frame light guide (reflector) that guides light from the light emitting member is integrally formed with the display frame to reduce the thickness of the display assembly. Accordingly, the thickness of the space of the inner case may be reduced, and the heat-insulation performance of the door may be improved by increasing the thickness of the insulating material filled in the door at a corresponding position.

In addition, the light emitting member is provided under the front surface of the display PCB, and the microcomputer is disposed over the front surface of the display, so that the light emitting member and the microcomputer can be disposed on the surface of the display PCB, thereby further decreasing the thickness of the display PCB and further improving the heat-insulation performance of the door.

BRIEF DESCRIPTION OF THE DRAWINGS

Hereinafter, the present disclosure will be described in more detail with reference to the drawings.

DETAILED DESCRIPTIONS

Hereinafter, implementations of the present disclosure will be described in detail with reference to the exemplary drawings. It should be noted that the identical or equivalent component is designated by the identical numeral even when they are displayed on other drawings. In addition, a detailed description of known configurations or functions will be omitted to the extent such configurations or functions are obvious to those skilled in the art.

Figure 1:
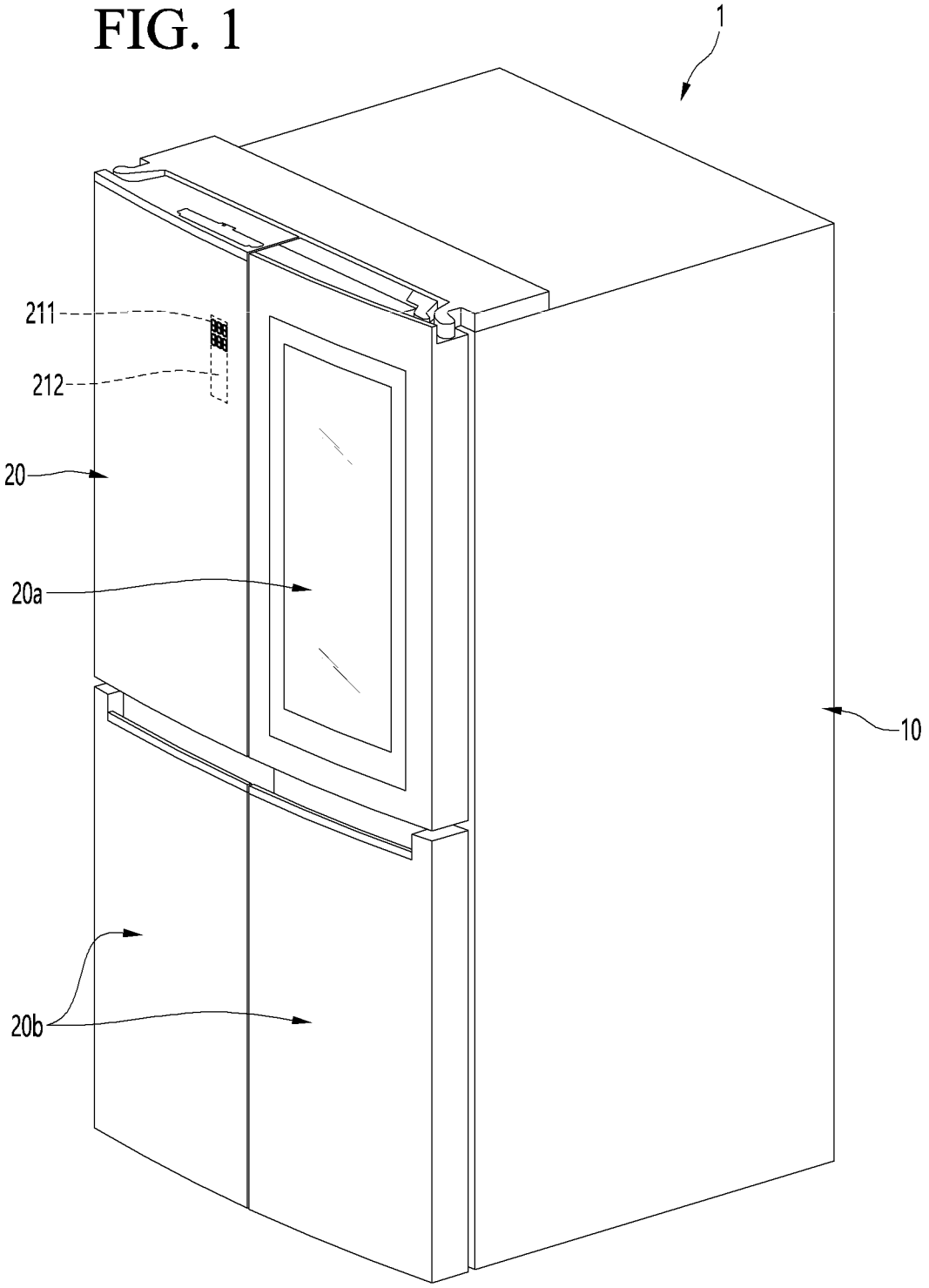
FIG. 1 is a perspective view of a refrigerator according to an implementation of the present disclosure.

Implementations of the present disclosure will be described primarily with respect to a refrigerator in which a display part is disposed on one of a pair of refrigerating chamber doors that are provided in a bottom freeze type refrigerator. However, it is understood that the present disclosure is applicable to other types of refrigerators that are equipped with a door. FIG. 1 is a perspective view of a refrigerator according to an implementation of the present disclosure.

For ease of description and understanding, particular directions are defined. Hereinafter, a direction toward the floor surface on which the refrigerator 1 is placed may be referred to as a downward direction, and a direction toward a top surface of a cabinet 10 opposite to the floor surface may be referred to as an upward direction. In addition, a direction toward a door 20 may be referred to as a front direction and a direction toward the inside of the cabinet 10 from the door 20 may be referred to as a rear direction. Other directions may be defined and described in relevant figures.

Referring to FIG. 1, a refrigerator 1 according to an implementation of the present disclosure may include a cabinet 10 defining a storage space and doors 20, 20*a* and 20*b* mounted on the front surface of the cabinet 10 to open and close the storage space. Here, an outer appearance of the refrigerator 1 may be defined by the cabinet and the doors 20, 20*a* and 20*b*.

The storage space of the cabinet 10 may be divided vertically. For example, a refrigerating chamber may be provided at the upper side, and a freezing chamber may be provided at the lower side. A plurality of doors 20, 20*a*, 20*b* for opening and closing the spaces may be provided at a front open side of the storage space. The doors 20, 20*a*, 20*b* may be configured to open and close the storage space in a sliding or rotating manner, and may be configured to define a front outer appearance of the refrigerator 1 when the doors are closed.

The doors may include a pair of refrigerating chamber doors 20 and 20*a* for shielding the refrigerating chamber and a pair of freezing chamber doors 20*b* for shielding the freezing chamber. The pair of refrigerating chamber doors 20 and 20*a* and the pair of the freezing compartment door

20*b* may be configured such that both left and right doors are rotatably coupled and may be configured to open and close the refrigerating chamber and the freezing chamber by rotation.

In some implementations, a dispenser for dispensing water or ice may be provided at the front surface of the refrigerating chamber door 20. Although not shown in detail, the right refrigerator chamber door 20*a* of the refrigerator chamber doors 20 and 20*a* that are arranged on the left and right sides respectively may include a separate door storage space, a main door with an opening, and a sub door for opening and closing the main door. A portion of the sub door may be configured to be selectively transparent such that the door storage space is visible from the outside.

In addition, a display part 211 and a touch manipulation part 212 may be provided at the refrigerating chamber door 20 on the left side at a height that facilitates manipulation and identification by a user. Hereinafter, the refrigerating chamber door 20 on the left side, which includes the display part 211 and the touch manipulation part 212, will be simply referred to as a door 20. It should be noted that the implementation of the present disclosure is not limited to the left refrigerating chamber door 20 that includes the display part 211 and the touch manipulation part 212, but may be applied to refrigerators with any other doors that include the display part 211 and the touch manipulation part 212.

Figure 2:
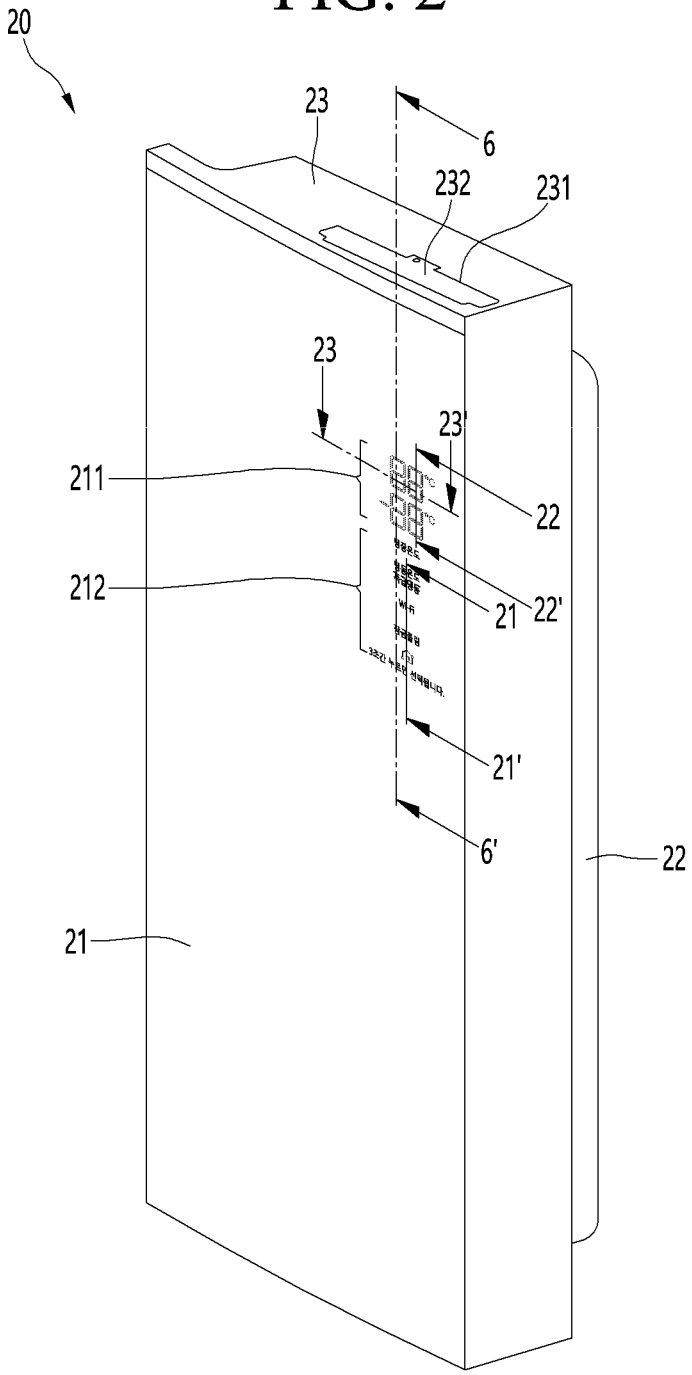
FIG. 2 is a perspective view of a door of the refrigerator.
Figure 3:
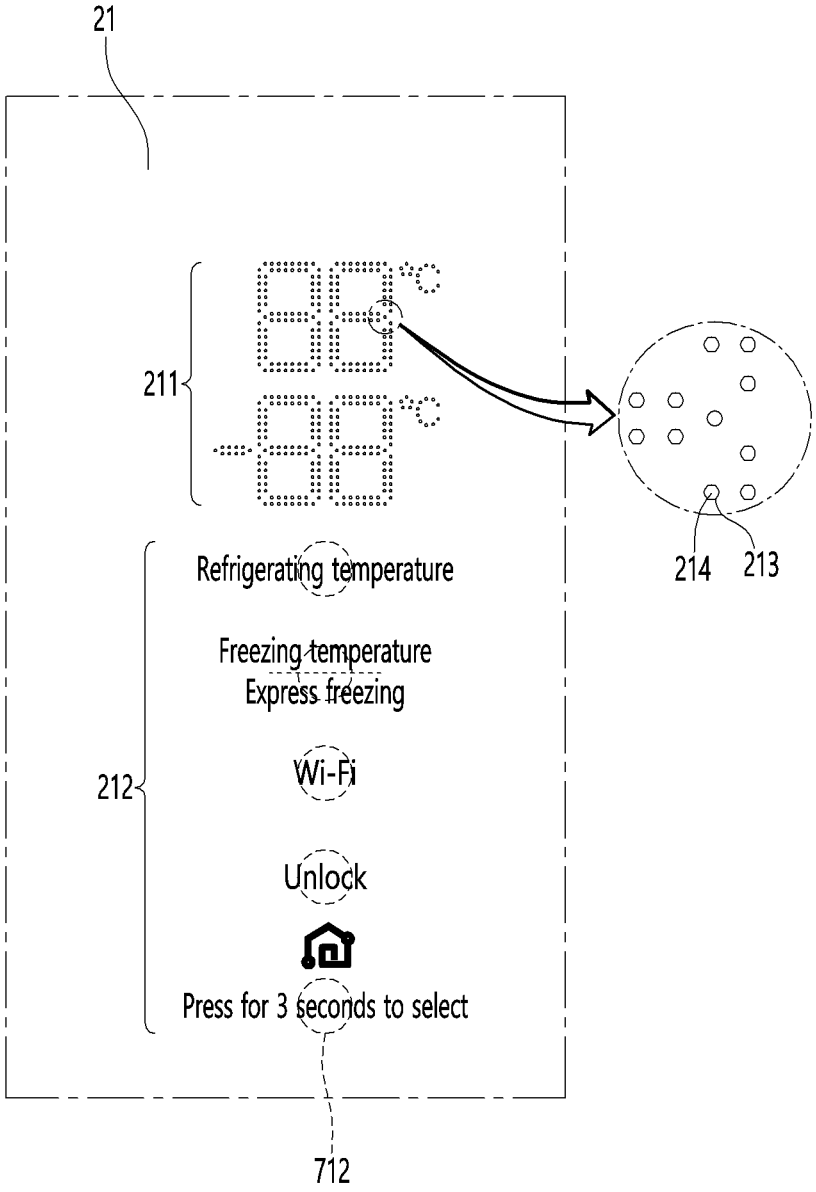
FIG. 3 is an enlarged view of a display part and a touch manipulation part of the door.

FIG. 2 is a perspective view of an example door of the refrigerator. FIG. 3 is an enlarged view of an example display part and an example touch manipulation part of the door.

As shown in the drawings, the door 20 may include an outer plate 21 defining a front appearance, a door liner 22 defining a rear appearance, and cap decors 23 provided at the top and bottom of the door 20. The overall appearance thereof may be formed by the combination of the outer plate 21, the door liner 22, and the cap decors 23.

In some implementations, the outer plate 21 defines the front appearance of the door 20 and may be formed of a plate-shaped metal material. The outer plate 21 may be formed of a stainless steel plate or a color steel plate (VCM, PCM) formed to have a stainless texture. For example, the outer plate 21 may be formed to have a thickness of approximately 0.5 mm. The front surface of the outer plate 21 exposed to the outside may be subjected to an anti-fingerprint treatment, and a specific color, a pattern, or a design may be printed. Further, a hairline may be formed to have a metal texture.

In some implementations, the display part 211 and the touch manipulation part 212 may be provided in the outer plate 21.

The display part 211 is configured for displaying operation states of the refrigerator 1. The display part 211 may be configured to output symbols, numbers or the like by permitting light emitted from the inside of the door 20 to transmit through the display part. The display part 211 allows a user to identify operation information of the refrigerator 1 from the outside of the refrigerator 1.

In some implementations, the display part 211 includes a plurality of through holes 213 that are formed in a portion of the outer plate 21. For example, the display part 211 may be configured as a set of a plurality of through holes 213 in a predetermined arrangement so as to represent different numbers or symbols. For example, the set of the plurality of through holes 213 may be arranged in the form of seven-segment, and may be arranged to represent a specific symbol, a shape of a design, or letters indicating the state of the refrigerator 1.

The through holes 213 may be formed to correspond to the arrangement of a plurality of through holes 312 and 614 in FIG. 22 to be described below, so that the light emitted from a light emitting member 511 of a display assembly 40 can be transmitted therethrough. In addition, the through hole 213 formed in the outer plate 21 is referred to as a first through hole 213 to be distinguished from the through holes 312 and 614 provided in the display assembly 40 and the display cover 30.

The first through hole 213 may be formed as a fine hole having a small diameter. For example, the first through hole 213 may be formed to have a diameter of 0.4 mm to 0.7 mm. The first through hole may be formed in various manners such as laser processing, etching, or NCT processing. The first through hole 213 has a fine size, and the hole filling member 214 is filled in the first through hole 213, so that the light emitting member 511 may not be easily exposed to the outside when the light emitting member 511 is not turned on. In addition, when the light emitting member 511 is turned on, the first through hole 213 may transmit light so that information can be displayed.

For example, light is emitted through some of the first through holes 213 formed at a position corresponding to the position of the light emitting member (511 in FIG. 11) to which light is emitted. In addition, the first through holes 213 to which light is emitted may represent a specific number, letter, or the like, thus transmitting information to the user.

That is, when at least some of the light emitting members 511 are turned on, at least some of the first through holes 213 that correspond to the light emitting members 511 that are turned on can transmit light, enabling the first through holes 213 to be visible to the outside. In this case, a specific number may be expressed by a combination of the exposed first through holes 213 to display a letter or picture, so that information can be transmitted to the user.

In addition, when the light emitting member 511 is turned off and light is not emitted from the inside of the door 20, the display part 211 is configured to be invisible (or hardly visible) when viewed from the outside. In addition, when the light emitting member 511 is turned off, the door 20 has the same appearance as the door so that a configuration for displaying information such as the display part 211 is not visible.

The touch manipulation part 212 is a part where a user inputs an operation for the operation of the refrigerator 1 and may be provided at a portion of the front surface of the door 20, and may be provided at the lower side of the display part 211 or at a position adjacent to the display part 211.

In some implementations, the touch manipulation part 212 may be formed such that a portion in which a pressing operation is detected is printed or a manipulation portion is visible to the user through surface processing such as etching.

In addition, a touch sensor assembly 70 (FIG. 6) and a touch sensor 712 to be described below may be provided inside the door 20 corresponding to the touch manipulation part 212, and may be configured to detect a pressing operation of the touch manipulation part 212.

Hereinafter, the display assembly 40 and the touch sensor assembly 70 will be described in more detail with reference to the drawings.

Figure 4:
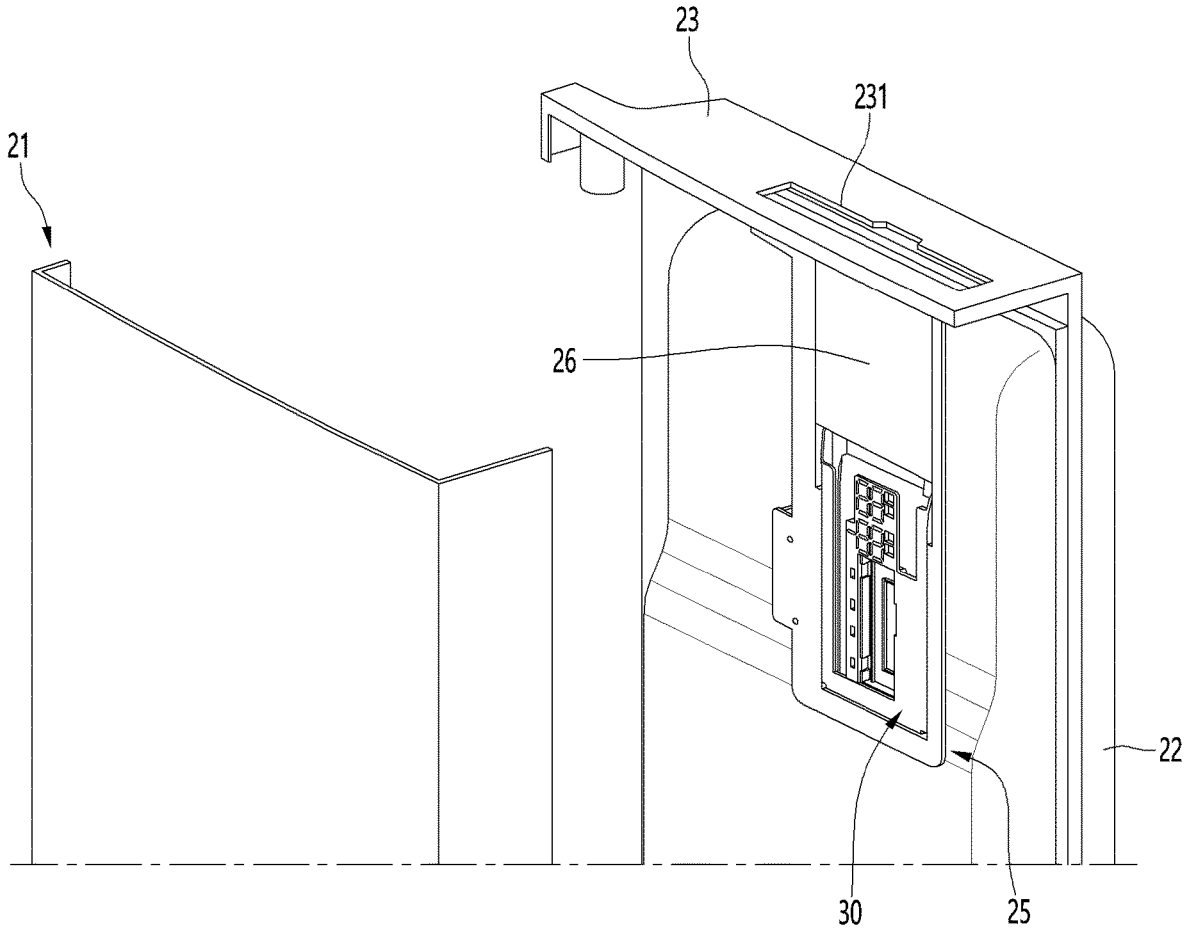
FIG. 4 is an exploded perspective view of the door from which an outer plate is separated.
Figure 5:
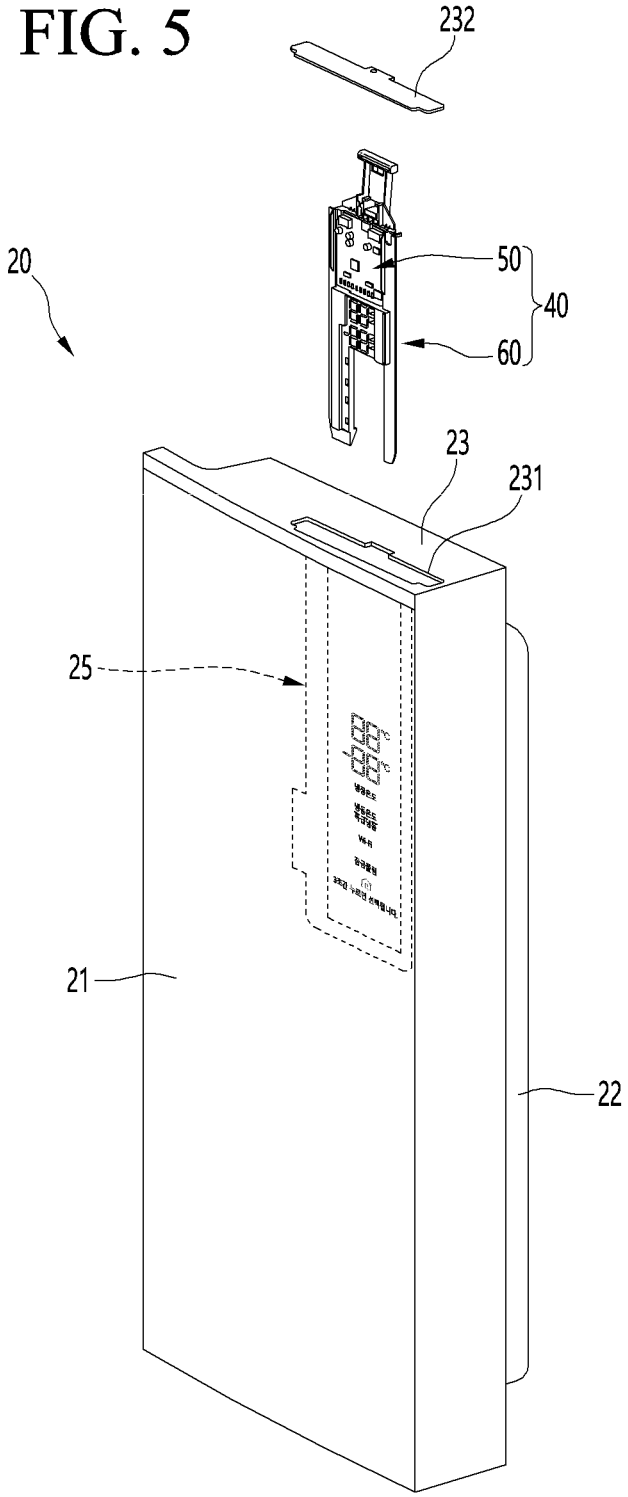
FIG. 5 is an exploded perspective view of a display assembly separated from the door.
Figure 6:
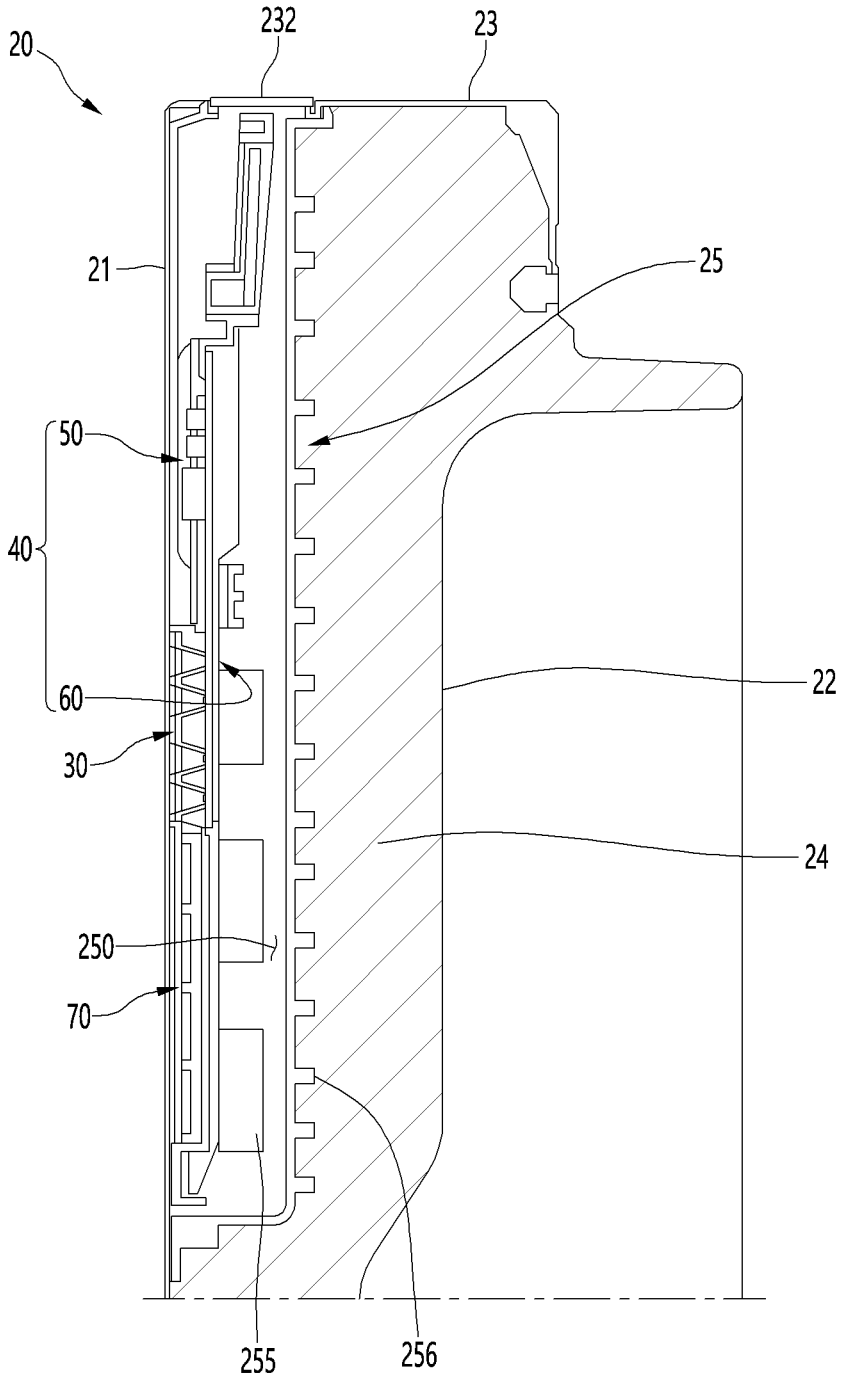
FIG. 6 is a cross-sectional view taken along line 6-6' of FIG. 2.

FIG. 4 is an exploded perspective view of the door from which an outer plate is separated. FIG. 5 is an exploded perspective view of a display assembly separated from the door. FIG. 6 is a cross-sectional view taken along line 6-6' of FIG. 2.

As shown in the drawings, the appearance of the door may be defined by the outer plate 21, the door liner 22, and the cap decor 23. An insulating material 24 (FIG. 6) may be provided in the inner space of the door 20 in which the outer plate 21, the door liner 22, and the cap decor 23 are coupled. The insulating material 24 may be foam-molded by injecting a foaming liquid.

In some implementations, an inner case 25 may be disposed in the door 20, and provide a space for mounting of the display cover 30, the display assembly 40 and the touch sensor assembly 70. The inner case 25 may have an upper end that can be coupled to a lower surface of the cap decor 23, and a front periphery that can be coupled to the outer plate 21 to define a predetermined space. The space that is defined by the inner case 25 may define an independent space such that the foaming liquid does not penetrate the space when the foaming liquid is injected into the door 20, thus providing a space in which the display assembly 40 and the touch sensor assembly 70 are mounted.

In addition, the display cover 30 may be provided in the inner space of the inner case 25 for mounting of the display assembly 40. The display cover 30 may be mounted in close contact with the rear surface of the outer plate 21, and have an open upper surface, so that the display assembly 40 may be inserted downwardly from the top of the display cover 30 and mounted.

In addition, a reinforcing plate 26 may be further provided between the upper end of the display cover 30 and the cap decor 23. The reinforcing plate 26 may be attached to the rear surface of the outer plate 21 to prevent the outer plate 21 from being bent into the inner space of the inner case 25.

In some implementations, the open upper surface of the inner case 25 may communicate with a decor opening 231 formed in the cap decor 23. In addition, the decor opening 231 may be opened and closed by the decor cover 232. In addition, the display assembly 40 may be inserted into the inner space of the inner case 25 through the decor cover 232.

The upper surface of the display cover 30 may be open. Therefore, when the display assembly 40 is inserted while the display cover 30 is mounted inside the inner case 25, the display assembly 40 may be inserted into the open upper surface of the display cover 30. The display assembly 40 may be completely inserted into the display cover 30 by its own weight. In addition, when the decor cover 232 is mounted to shield the decor opening 231, the lower surface of the decor cover 232 may press the upper end of the display assembly 40, thus enabling the display assembly 40 to be completely inserted.

In addition, the display assembly 40 may have a structure to guide the display assembly 40 to be mounted in an accurate position when being inserted into the display cover 30. For example, the display assembly 40 and the display cover 30 may have a plurality of structures that are in contact with or match each other, and through these structures, the display assembly 40 may be mounted in the accurate position of the display cover 30.

When the display assembly 40 is mounted in the accurate position inside the display cover 30, the light emitting member 511 and the third through hole 614 of the display assembly 40, the second through hole 312 of the display cover 30, and the first through hole 213 of the outer plate 21 may be aligned to communicate with each other. Therefore, when the light emitting member 511 is turned on, light emitted from the light emitting member 511 may pass through the third through hole 614, the second through hole 312 and the first through hole 213 in order, thus being emitted to the outside.

Figure 7:
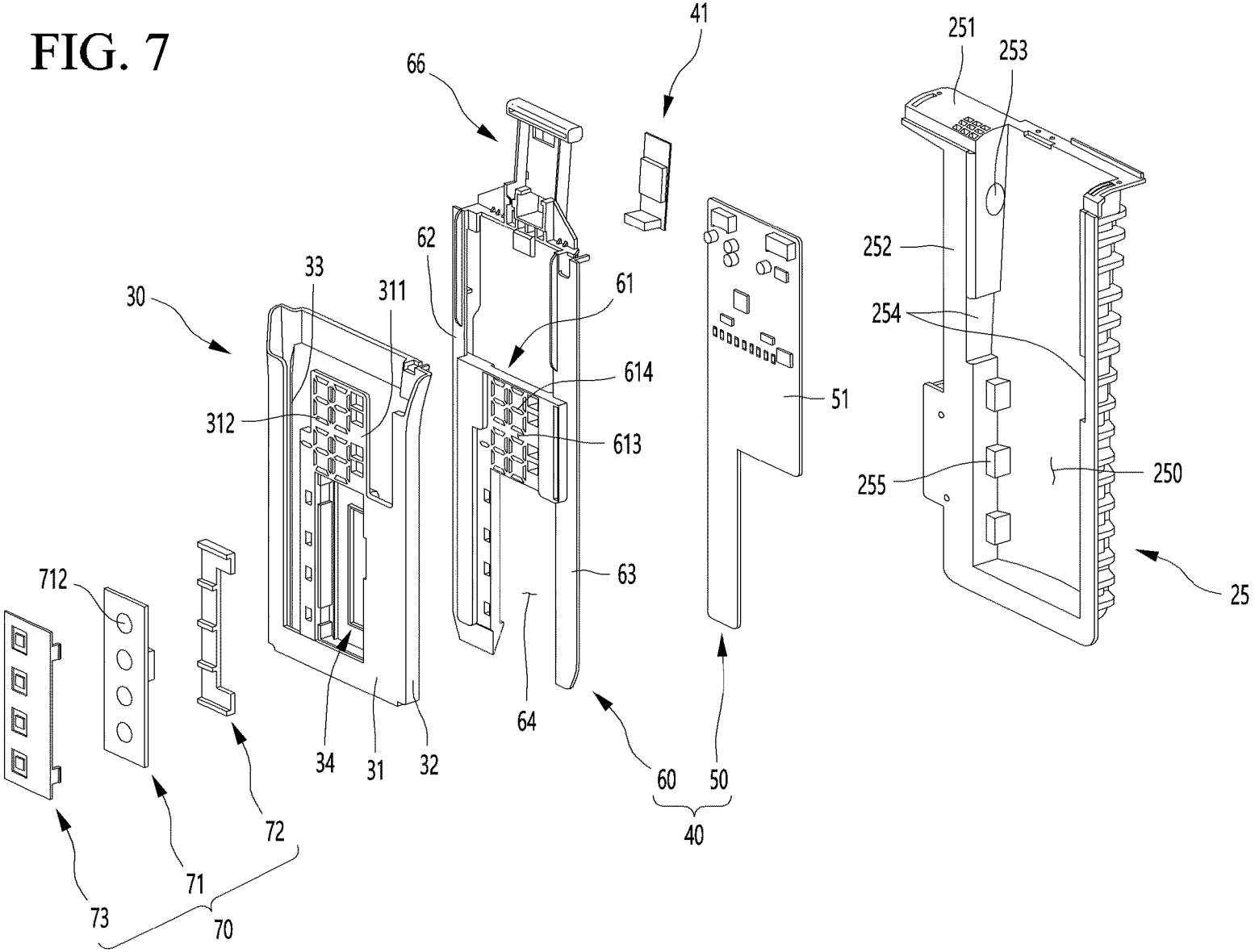
FIG. 7 is an exploded perspective view of a display cover, a display assembly, a touch assembly, and an inner case which are disposed inside a door.

FIG. 7 is an exploded perspective view of the display cover, the display assembly, a touch assembly, and the inner case which are disposed inside the door.

As shown in the drawing, the inner case 25 may be mounted inside the door 20. The display cover 30 may be provided in the inner area of the inner case 25. The display assembly 40 and the touch sensor assembly 70 may be mounted in the display cover 30.

The inner case 25 may include a case upper surface 251 and a case front surface 252, and define a space 250 that is open forward and upward. The case upper surface 251 may contact the cap decor 23, and the case front surface 252 may contact the rear surface of the outer plate 21. In addition, the case front surface 252 may be formed along the rest of the periphery of the inner case 25 except the upper end of the space 250 of the inner case 25.

Further, a reinforcing rib 256 (FIG. 6) may be disposed on the rear surface of the inner case 25 entirely, so that the inner case 25 is not deformed by pressure when the heat insulating material 24 is formed. A wire hole 253 is defined at a side of the upper portion of the inner case 25. Wires can pass through the wire hole 253, and be connected to the display assembly 40 and the touch sensor assembly 70 provided in the inner case 25.

In addition, cover support portions 255 protruding inward may be formed on both left and right sides of the space of the inner case 25. The cover support portions 255 may support the display cover 30 from the rear to enable the display cover 30 to be in close contact with the rear surface of the outer plate 21.

Further, a case groove 254 recessed laterally may be formed on the upper side of the cover support portions 255. The case groove 254 may provide a space in which an upper guide (321 in FIG. 8) at an upper end of the display cover 30 is accommodated.

The display cover 30 may be provided in the inner space 250 of the inner case 25. The cover front surface 31 of the display cover 30 may be in close contact with the rear surface of the outer plate 21. Further, a cover rear surface 33 spaced apart from the cover front surface 31 may be formed, and a space in which the display assembly 40 is accommodated may be defined by a cover peripheral surface 32 connecting the cover front surface 31 and the cover rear surface 33.

In addition, a cover light guide 311 defines a plurality of second through holes 312 and may be formed in the display cover 30. In addition, a sensor assembly mounting portion 34 on which the touch sensor assembly 70 is mounted may be formed to be recessed from the cover front surface 31.

The display assembly 40 may include a display printed circuit board (PCB) 50 and a display frame 60. The display PCB 50 mounts the light emitting member 511 or the like. The display frame 60 can fixedly mount the display PCB 50 and can be inserted through the decor opening 231 from the outside of the door 20.

In addition, the display frame 60 may include a handle portion 66, a first side extension portion 62, a second side extension portion 63, and a frame light guide 61. The first side extension portion 62 and the second side extension portion 63 extend and are spaced apart from each other on the left and right sides. The frame light guide 61 connects the first side extension portion 62 and the second side extension 63. The frame light guide 61 may have one or more third through holes 614 communicating with the second through holes 312. Light emitted from the light emitting member 511 may be guided to the second through hole 312 and the first through hole 213 through the third through hole 614 of the frame light guide 61. Accordingly, the frame light guide 61 may be referred to as a reflector because the frame light guide 61 has a structure that guides light emitted from the light emitting member 511. In addition, a Wi-Fi module 41 may be mounted in the handle portion 66.

The touch sensor assembly 70 may include a touch PCB 71, an elastic member 72, and a touch cover 73. A touch sensor 712 is mounted to the touch PCB 71. The elastic member 72 elastically supports the touch PCB 71. The touch cover 73 can shield the touch PCB 71. The elastic member 72, the touch PCB 71, and the touch cover 73 may be sequentially mounted on the sensor assembly mounting portion 34.

Hereinafter, the structure of the display cover 30 described above will be described in more detail with reference to the drawings.

Figure 8:
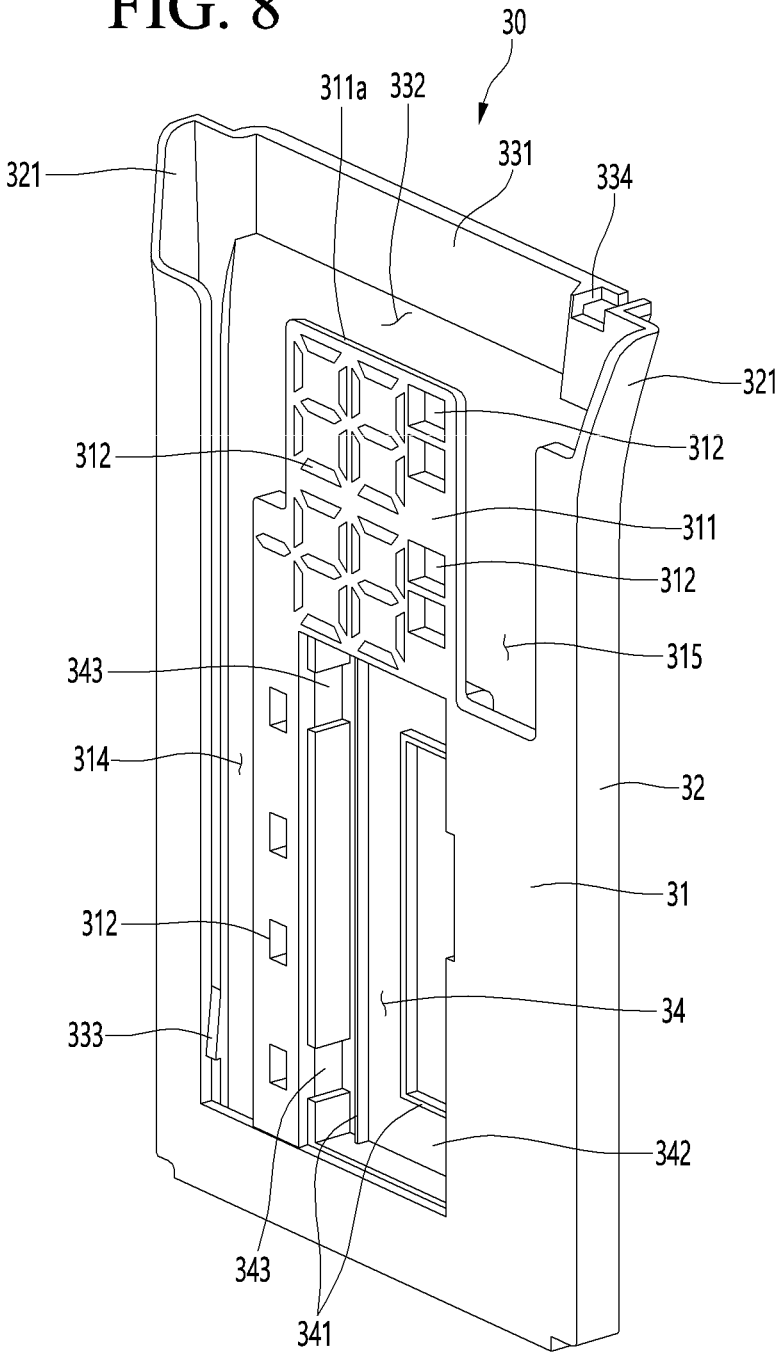
FIG. 8 is a perspective view of the display cover.
Figure 9:
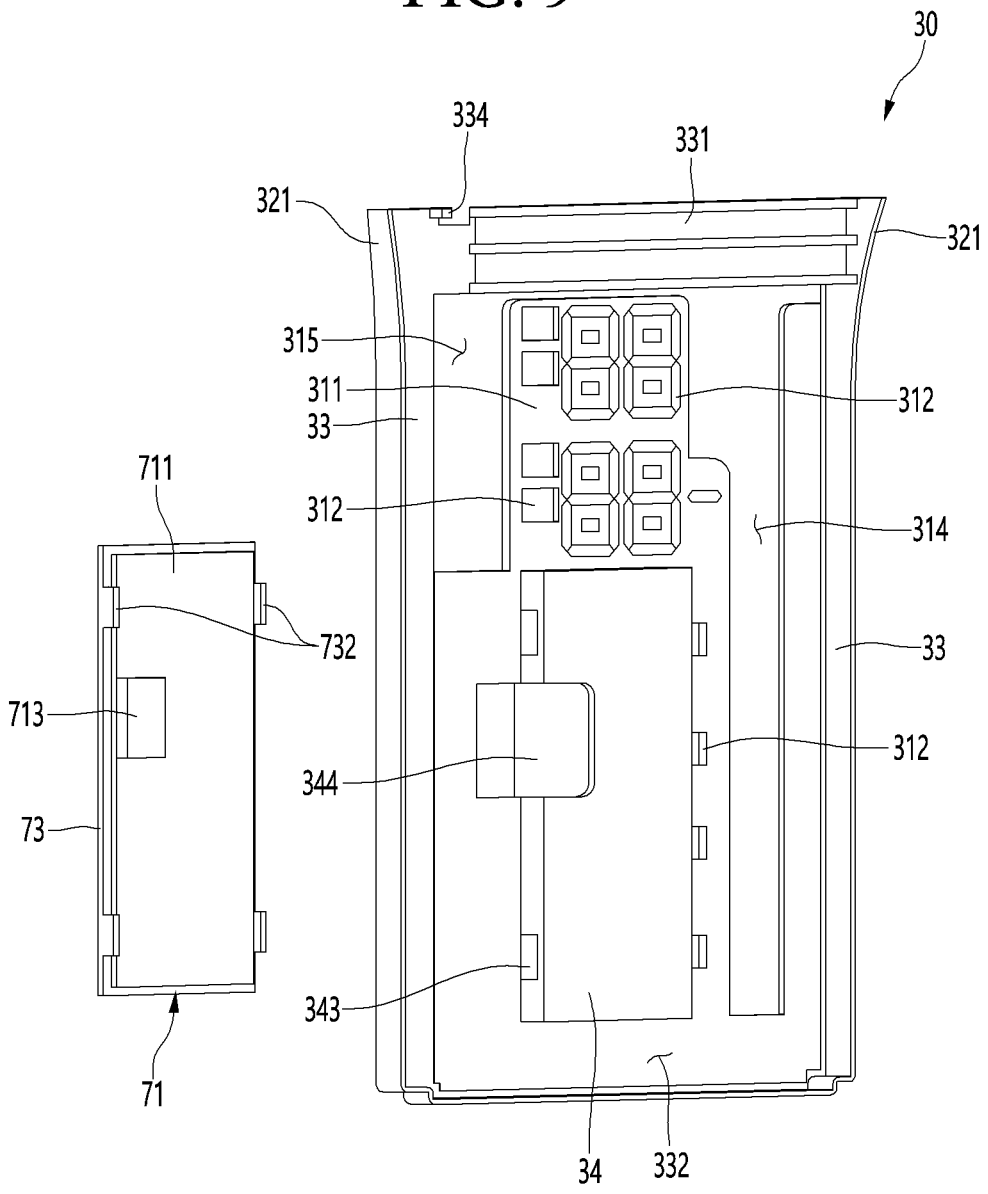
FIG. 9 is an exploded perspective view of a part of the touch assembly and the display cover as viewed from the rear.

FIG. 8 is a perspective view of the display cover. FIG. 9 is an exploded perspective view of a part of the touch assembly and the display cover as viewed from the rear.

As shown in the drawings, the display cover 30 may be formed by injection molding of a plastic material. The display cover 30 may be open upward to enable the display assembly 40 to be inserted from above. The display frame 60 and the display cover 30 of the display assembly 40 are configured to be guided and engaged with each other in a plurality of portions in a state in which the display assembly 40 is inserted into the display cover 30, so that the display assembly 40 may be arranged in an accurate position inside the display cover 30. The second through hole 312 and the third through hole 614 are aligned through the correct arrangement of the display assembly 40 to transmit the light emitted from the light emitting member 511.

The display cover 30 may include the cover front surface 31 and the cover rear surface 33 which are partially open, and a cover peripheral surface 32 forming a periphery by connecting the peripheries of the cover front surface 31 and the cover rear surface 33 spaced apart from each other. In addition, the cover peripheral surface 32 may be formed in a portion other than the upper surface of the display cover 30 to form an inlet that is open in the upper portion of the display cover 30.

The cover front surface 31 may form the same plane as a whole, and may be fixedly mounted in a state that is completely in close contact with the rear surface of the outer plate 21. To this end, an adhesive agent may be applied or an adhesive sheet or tape may be attached to the cover front surface 31 or the rear surface of the outer plate 21.

In this case, the cover light guide 311 that constitutes the cover front surface 31 may also be attached in close contact with the outer plate 21. In this case, it is important that the second through holes 312 of the cover light guide 311 are mounted such that they are accurately matched with the first through holes 213 of the outer plate 21.

The display cover 30 may be mounted at an accurate position using the second through holes 312. As an example, the first through holes 213 may be mounted such that the first through holes 213 are positioned in the inner area of the second through holes 312 when light is emitted to pass through all of the first through holes 213 from the front of the outer plate 21 so that the first through holes 213 are clearly visible. That is, the display cover 30 may be mounted at an accurate position by allowing all of the first through holes 213 to be positioned in the inner area of the second through holes 312.

In some implementations, the second through holes 312 may be formed in a size such that the plurality of first through holes 213 are arranged inside the second through holes 312. For example, the second through holes 312 may form each unit element of the seven-segment, and the plurality of first through holes 213 may be positioned inside the second through holes 312. The plurality of second through holes 312 may be gathered to form a plurality of seven-segment shapes, and operation information of the refrigerator 1 may be displayed with numbers.

A first side opening 314 and a second side opening 315 may be formed on both sides of the cover light guide 311 in which the second through holes 312 are formed. The first side opening 314 and the second side opening 315 may be elongated in the vertical direction, and may be formed to correspond to a first side protrusion 611 and a second side protrusion 612 of the display frame 60 so that the first side protrusion 611 and the second side protrusion 612 are inserted thereto.

In addition, a cover inclined surface 311*a* may be formed in an upper end of the cover light guide 311. The cover inclined surface 311*a* can have an inclination that protrudes rearward as it goes downward. The cover inclined surface 311*a* may have an inclination corresponding to a frame inclined surface 615 formed in a lower end of the frame light guide 61 of the display frame 60 when the display assembly 40 is inserted and mounted. The cover inclined surface 311*a* and the frame inclined surface 615 may contact each other to guide the display assembly 40 to be inserted into the accurate position when the display assembly 40 is inserted and mounted.

In addition, a sensor assembly mounting portion 34 may be further formed in the front surface of the display cover 30. The sensor assembly mounting portion 34 may be provided on the lower side of the cover light guide 311 in which the second through holes 312 are formed. The sensor assembly mounting portion 34 may be recessed to form a space in which the touch sensor assembly 70 is accommodated.

Accordingly, the recessed inner surface of the sensor assembly mounting portion 34 may have a shape protruding backward, and when the display assembly 40 is coupled thereto, may be positioned between the first side extension 62 and the second side extension 63.

A mounting rib 341 for mounting the elastic member 72 may be formed in the bottom of the inner surface of the sensor assembly mounting portion 34. The mounting rib 341 may be formed along the outer periphery of the elastic member 72. Accordingly, the elastic member 72 may be inserted into a space defined by the mounting rib 341, and the periphery of the elastic member 72 may be supported by the mounting rib 341.

In addition, when the elastic member 72 is mounted in the sensor assembly mounting portion 34, the touch PCB 71 may be supported by the front surface of the elastic member 72. In addition, the touch cover 73 may be mounted to shield the open front surface of the sensor assembly mounting portion 34. In this case, the touch sensor 712 of the touch PCB 71 may be pressed by the elastic member 72 so as to be in close contact with the rear surface of the touch cover 73.

The open front surface of the sensor assembly mounting portion 34 may be formed to have a size corresponding to the touch cover 73. Accordingly, the touch cover 73 may shield the sensor assembly mounting portion 34. In addition, hook holes 343 may be further formed in the inner left and right sides of the sensor assembly mounting portion 34. The hook holes 343 may be open such that cover hooks 732 formed in both side surfaces of the touch cover 73 are inserted thereto. In this case, the hook holes 343 may be formed to be elongated in the front-rear direction to allow the touch cover 73 to move in the front-rear direction.

Therefore, when a user presses the touch manipulation part 212, the outer plate 21 may be slightly elastically deformed while being pressed, and the touch cover 73 may be slightly pushed to the rear and press the touch sensor 712. In this case, the touch cover 73 may have a structure to allow the touch cover 73 to move backward by the shape of the cover hook 732 and the hook hole 343, so that the touch sensor 712 may be recognized more smoothly.

A mounting hole 344 may be open in an inner side surface of the sensor assembly mounting portion 34. The mounting hole 344 may be open at a position corresponding to the PCB connector 713 provided in the rear surface of the touch PCB 71. Accordingly, it is possible to allow a harness connected to the PCB connector 713 to enter and exit the mounting hole 344.

A second through hole 312 for indicating a position of the touch sensor 712 may be further formed in a side of the sensor assembly mounting portion 34, that is, a side adjacent to the first side opening 314. The second through hole 312 may be formed in a simple hole shape rather than a seven-segment shape. In addition, the second through hole 312 may further include second through holes 312 that are open on the side of the seven-segment-shaped second through holes 312 to indicate a temperature such as Fahrenheit or Celsius In some implementations, the cover peripheral surface 32 may be formed along the outer ends of the cover front surface 31 and the cover rear surface 33, and define both left and right side surfaces and a lower surface of the display cover 30. In this case, the width of the cover peripheral surface 32 may be formed to be larger than the thickness of the display assembly 40 to provide a space in which the display assembly 40 is inserted and accommodated.

In addition, the distance between both sides of the cover peripheral surface 32 is formed to correspond to the horizontal width of the display assembly 40 so that the display assembly 40 is fixed without being moved while being accommodated in the display cover 30.

The cover peripheral surface 32 may include an inlet portion 321. The inlet portion 321 is a portion formed at the upper portions of both side surfaces of the cover peripheral surface 32 and may extend toward the outside as it goes upward. For example, the width of the open upper surface of the display cover 30 may be larger than the horizontal width of the display assembly 40, so that the display assembly 40 is easily inserted into the display cover 30 from the upper side.

In some implementations, the cover rear surface 33 may form the rear surface of the display cover 30 and may be formed along the rear ends of the cover peripheral surface 32. The cover rear surface 33 is formed to have a predetermined width along the cover peripheral surface 32. Accordingly, an opening 332, which may be entirely open, can be formed at the center of the cover rear surface 33. The rear surface of the display assembly 40 that is inserted into the display cover 30 may be exposed.

In addition, a cover connection portion 331 may be formed at an upper end of the cover rear surface 33. The cover connection portion 331 may connect upper ends of both side surfaces of the cover peripheral surface 32 to define an opening of the open upper surface of the display cover 30. In addition, when the display assembly 40 is inserted into the display cover 30, the cover connection portion 331 may serve to guide the display assembly 40 toward the inside of the display cover 30. In this case, the cover connection portion 331 may be coupled to the cover peripheral surface 32 with both ends bent forward. Accordingly, it is possible to secure a width in the front-rear direction of an inlet into which the display assembly 40 can be inserted.

Cover protrusions 333 protrude toward the cover front surface 31, and may be formed at the lower left and right sides of the cover rear surface 33. The cover protrusions 333 may protrude to support the lower ends of both sides of the display frame 60, that is, the lower ends of the first side extension 62 and the second side extension 63 from the rear and press them forward.

The cover protrusions 333 may be formed to be inclined to protrude as they extend downward. Accordingly, when the display assembly 40 is inserted and mounted, the display frame 60 may be naturally pressed forward. The front surface of the frame light guide 61 may be in close contact with the rear surface of the cover light guide 311 due to the forward pressing of the display frame 60.

A wire guide portion 334 may be open on one side of the cover connection portion 331 in which the mounting hole 344 is open (right side in FIG. 8) among the left and right sides of the cover connection portion 331. A wire may be guided through the mounting hole 344 and pass through the wire guide portion 334. The wire may be guided toward a touch connector 541 of the display PCB 50.

Hereinafter, the display assembly 40 will be described in more detail with reference to the drawings.

Figure 10:
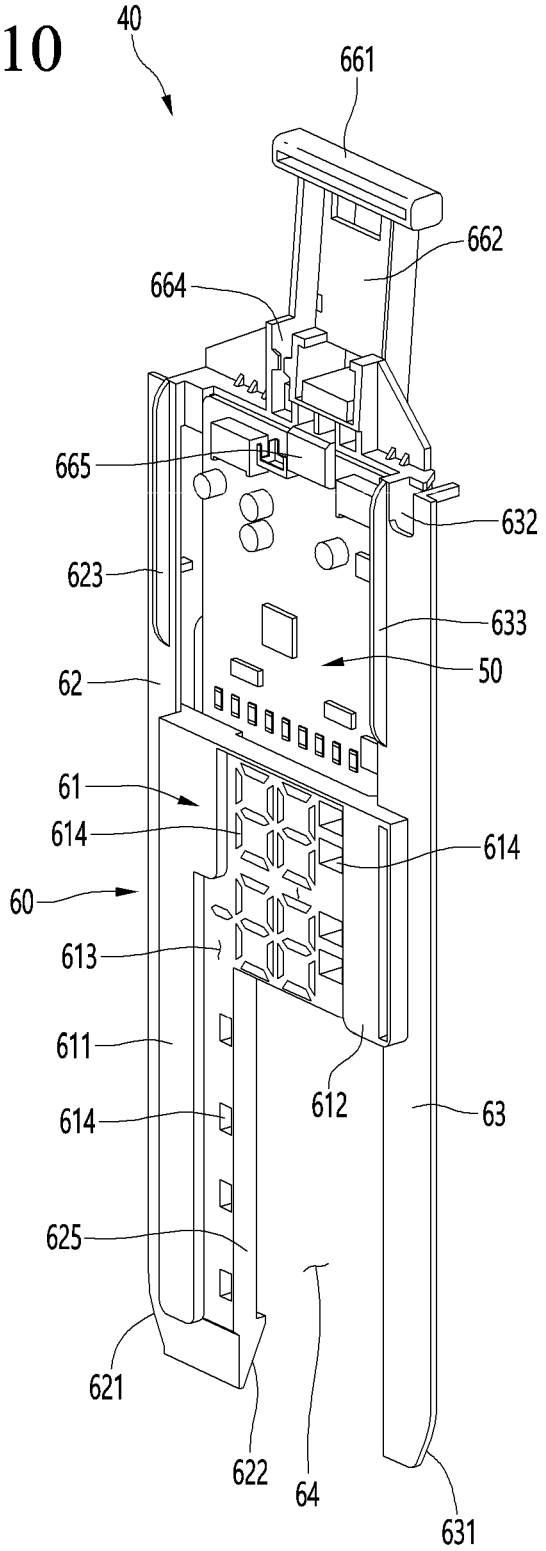
FIG. 10 is a perspective view of the display assembly as viewed from the front.
Figure 11:
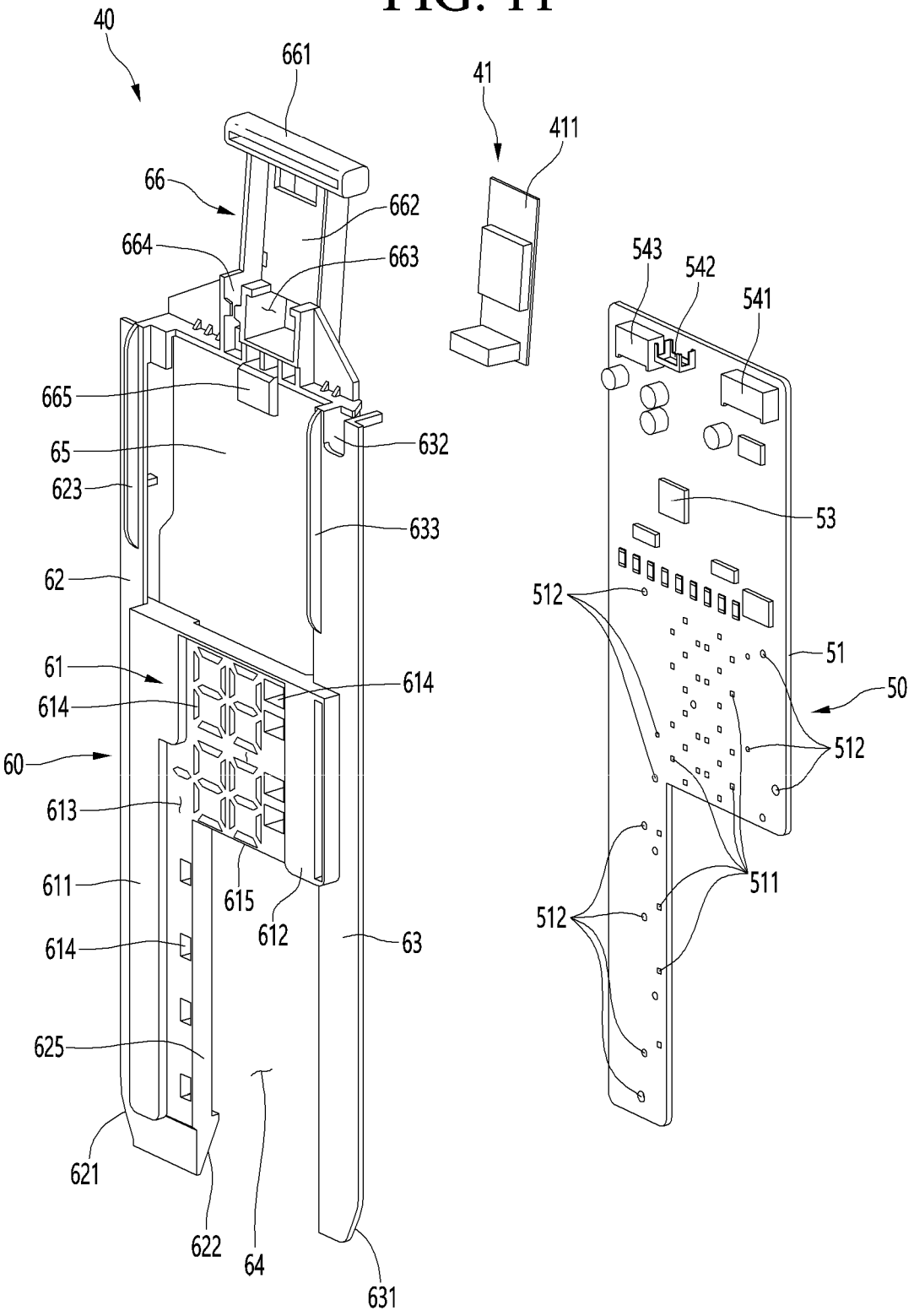
FIG. 11 is an exploded perspective view of the display assembly as viewed from the front.
Figure 12:
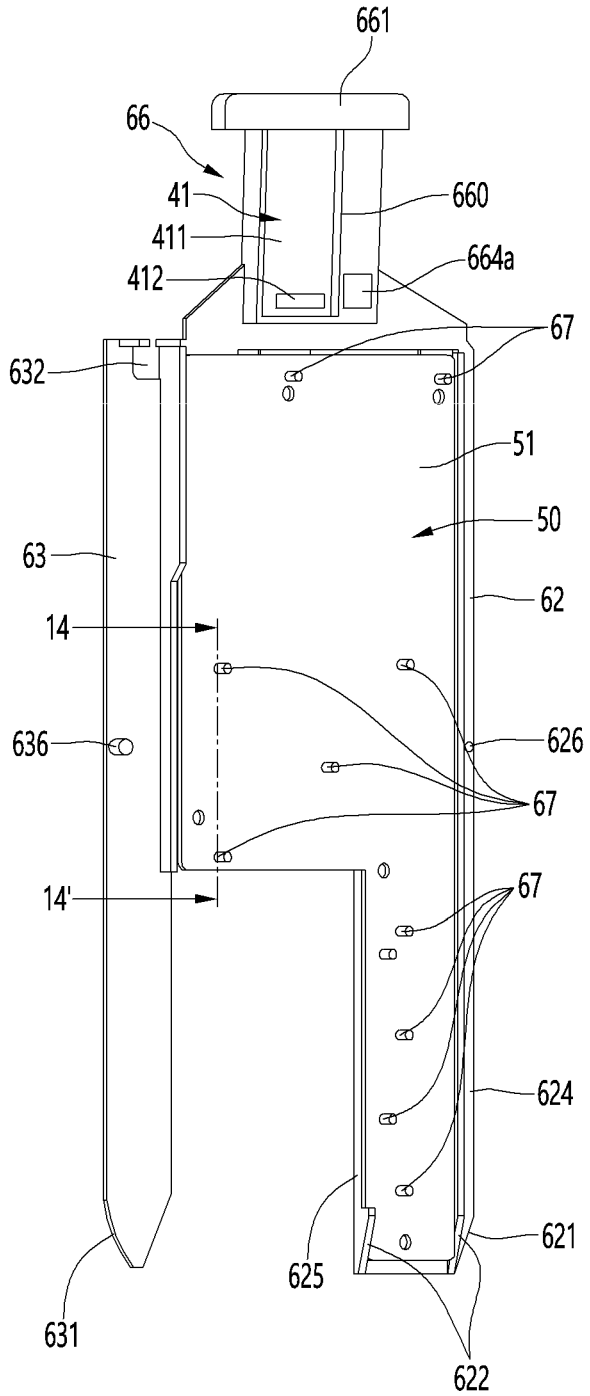
FIG. 12 is a perspective view of the display assembly as viewed from the rear.
Figure 13:
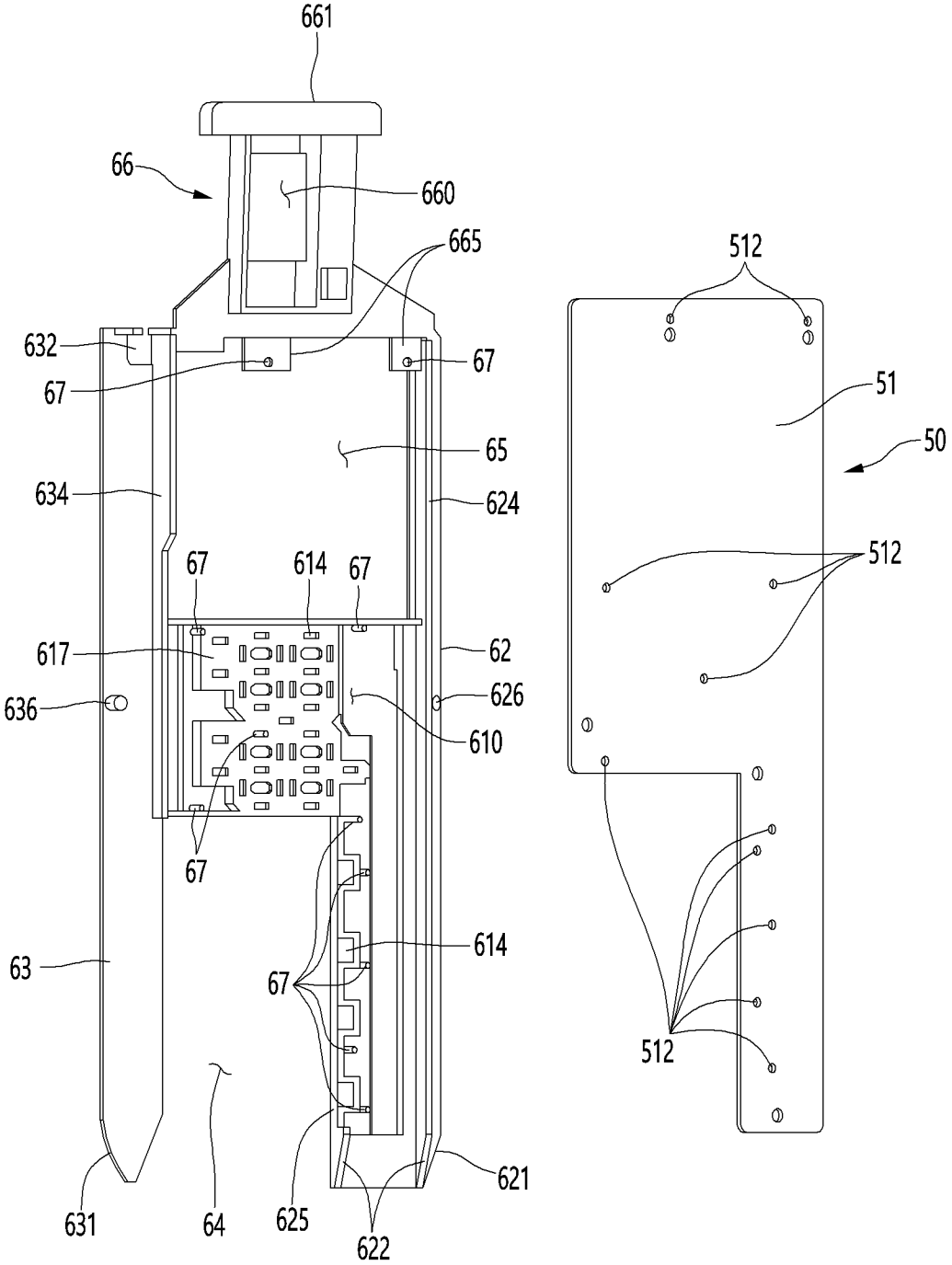
FIG. 13 is an exploded perspective view of the display assembly as viewed from the rear.
Figure 14:
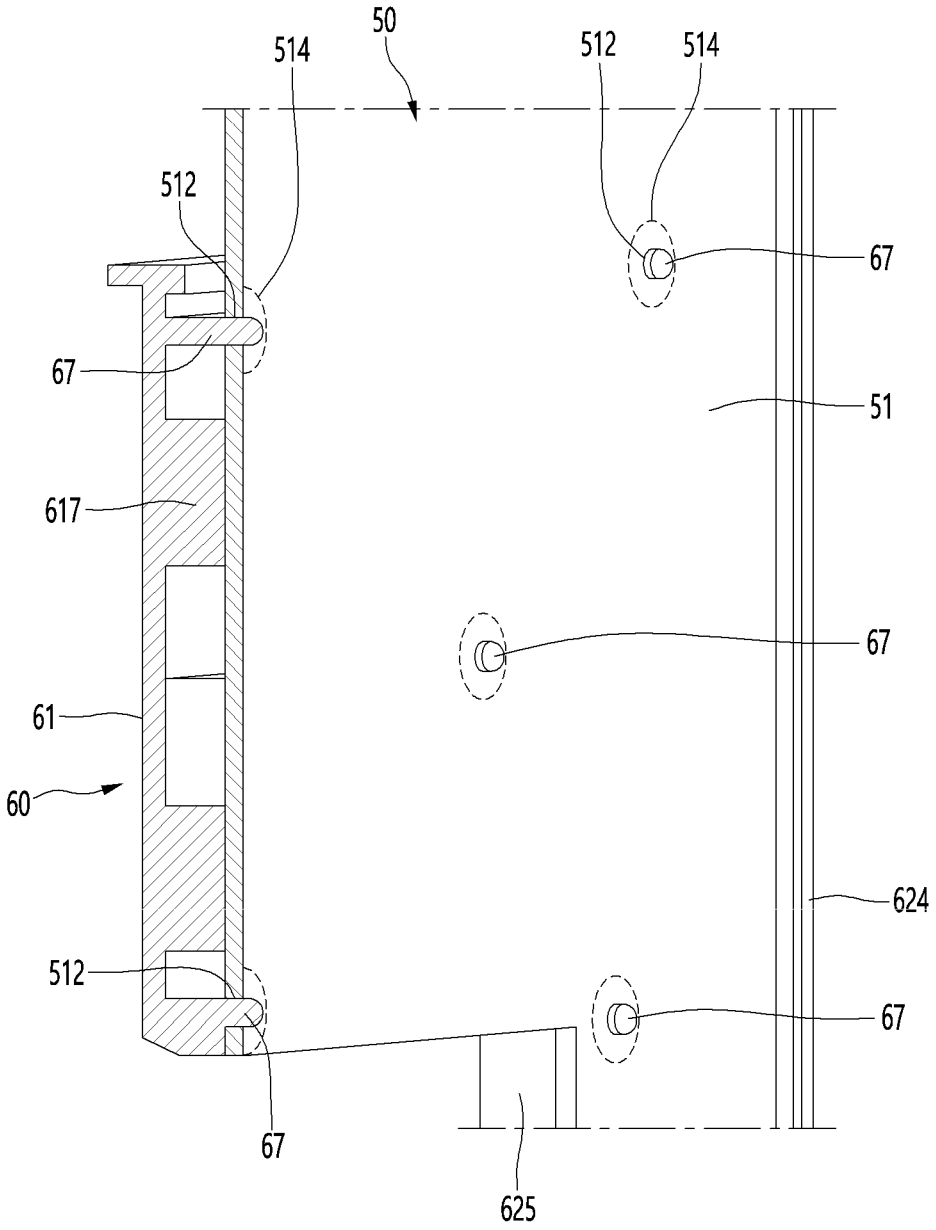
FIG. 14 is a cutaway perspective view taken along line 14-14' of FIG. 12.

FIG. 10 is a perspective view of the display assembly as viewed from the front. FIG. 11 is an exploded perspective view of the display assembly as viewed from the front. FIG. 12 is a perspective view of the display assembly as viewed from the rear. FIG. 13 is an exploded perspective view of the display assembly as viewed from the rear. FIG. 14 is a cutaway perspective view taken along line 14-14' of FIG. 12.

As shown in the drawings, the display assembly 40 may include the display frame 60 and the display PCB 50 mounted on the display frame 60. In addition, the display assembly 40 may further include the Wi-Fi module 41 mounted on the display frame 60.

The display PCB 50 may include the light emitting member 511 and a plurality of connectors 541, 542, and 543. The light emitting member 511 may be an light emitting device (LED). The light emitting member 511 may be disposed at positions corresponding to the second through hole 312 and the third through hole 614, respectively.

In some implementations, the connectors 541, 542, and 543 include a touch connector 541 connected to the touch PCB 71, a main connector 542 connected to a main control unit of the refrigerator, and a Wi-Fi connector 543 connected to the Wi-Fi module 41. The plurality of connectors 541, 542, and 543 may be connected to wires before the display assembly 40 is inserted into the display cover 30.

In addition, the display PCB 50 may be provided with a plurality of elements including a microcomputer 53 for controlling the operation of the light emitting member 511. In addition, a microcomputer may be also provided that processes an input signal of the touch sensor 712.

In addition, the display PCB 50 may be formed to be inserted into and mounted on the rear surface of the display frame 60. In addition, a plurality of fastening holes 512 may be formed in the display PCB 50. Fastening protrusions 67 of the display frame 60 are inserted into the fastening holes 512. Ends of the fastening protrusions 67 that pass through the fastening holes 512 can be fused to be completely coupled to the fastening holes 512 behind the fastening holes 512.

In some implementations, the plurality of fastening holes 512 may be evenly disposed in the entire area of the touch PCB 71. Accordingly, the display PCB 50 and the display frame 60 may be firmly fixed to each other. In particular, the plurality of the fastening holes 512 may be respectively positioned at positions adjacent to the light emitting member 511. Therefore, the front surface of the display PCB 50 adjacent to the light emitting member 511 may be completely in close contact with the rear surface of the frame light guide 61 to prevent the light emitted from the light emitting member 511 from leaking through a gap between the frame light guide 61 and the display PCB 50.

In addition, a substrate protection portion 514 may be formed around the fastening holes 512. The substrate protection portion 514 may prevent damage of the circuit of the substrate while the fastening protrusion 67 is fused to the fastening hole 512. The circuit does not extend to the area of the substrate protection portion 514. The circuit may include heat-resistant coating.

The display frame 60 may include a frame light guide 61 having a third through hole 614 formed therein, and a first side extension 62 and a second extension extending vertically from both ends of the frame light guide 61. In addition, a handle portion 66 may be formed at upper ends of the first side extension 62 and the second side extension 63.

A frame opening 65 can be provided such that the display PCB 50 is exposed through the frame opening 65. The frame opening 65 may be formed between the first side extension 62 and the second side extension 63, and between the upper end of the frame light guide 61 and the lower end of the handle portion 66. Elements including the microcomputer 53 may be disposed in an area of the display PCB 50 exposed through the frame opening 65 such that the elements are visible through the frame opening 65.

Protection ribs 623 and 633 may protrude from the left and right sides of the frame opening 65. The protection ribs 623 and 633 may protrude from the front surfaces of the first side extension 62 and the second side extension 63 to extend from the upper end to the lower end of the frame opening 65. In addition, the protection ribs 623 and 633 may be formed to protrude more than a plurality of elements mounted on the display PCB 50, and therefore, the elements mounted on the display PCB 50 may be protected from being affected by interference or impact during an assembly process.

An upper restraining portion 665 may extend downward and may be provided at an upper end of the frame opening 65, that is, a lower end of the handle portion 66. The upper end of the display PCB 50 may be restrained such that the upper end of the display PCB 50 does not protrude forward by the upper restraining portion 665. At least one or more of the upper restraining portions 665 may be continuously formed along the upper end of the frame opening 65.

In some implementations, a PCB accommodating space 610 is configured to accommodate the display PCB 50. The PCB accommodating space 610 may be formed in a rear surface of the display frame 60. The PCB accommodating space 610 may be formed in a shape corresponding to the display PCB 50. The frame light guide 61 may be formed inside the PCB accommodating space 610.

In order to form the PCB accommodating space 610, the first side extension 62 and the second side extension 63 may be formed with a first extension rib 624 and a second extension rib 634 that protrude rearward. The first extension rib 624 and the second extension rib 634 may constrain the display PCB 50 by contacting outer ends of both left and right sides of the display PCB 50. In addition, a third extension rib 625 protruding rearward may be further formed in the first side extension 62. The third extension rib 625 may be disposed in parallel with the first extension rib 624 and may be formed to support a portion of the display PCB 50 extending downward from the lower portion of the display PCB 50.

For example, the display PCB 50 is fixedly mounted inside the PCB accommodating space 610 by the first extension rib 624, the second extension rib 634, and the third extension rib 625. In addition, the light emitting member 511 may be maintained to be accurately positioned inside the third through hole 614.

The display PCB 50 may be maintained at a correct mounting position by having a structure that receives the display PCB 50 and mounts the display PCB 50 in the display frame 60 that includes the frame light guide 61. Thus, the light emitting member 511 may be positioned inside the third through hole 614 of the frame light guide 61. In addition, the frame light guide 61 may be maintained to be in close contact with the display PCB 50 to prevent light emitted from the light emitting member 511 from leaking between the display frame 60 and the display PCB 50.

A first side inclined portion 621 may be formed to inclinedly extend inward at a lower end of the first side extension 62, and a second side inclined portion 631 may be formed at a lower end of the second side extension 63. The first side inclined portion 621 and the second side inclined portion 631 may be formed to be inclined toward the inside as they extend downward to facilitate insertion of the display frame 60 through the open upper surface of the display cover 30.

For example, the first side inclined portion 621 and the second side inclined portion 631 may be easily inserted into the inlet portion 321 of the display cover 30 when the display assembly 40 is mounted. That is, the lower end of the display frame 60 may be easily inserted through the open upper surface of the display cover 30 away from the decor opening 231.

A lower inclined portion 622 may be further formed at a lower end of the first side extension 62. The lower inclined portion 622 may protrude rearward from the first side extension 62 and may be formed to be inclined so as to further protrude rearward as it extends upward. In addition, the lower inclined portion 622 may be formed at the lower ends of the first extension rib 624 and the third extension rib 625 formed at both side ends of the first side extension 62. When the display assembly 40 is inserted through the open upper surface of the display cover 30, the lower inclined portion 622 may be guided in contact with the cover connection portion 331 to allow the display assembly 40 to be guided to the inside of the display cover 30.

In some implementations, a wire guide hole 632 may be formed at an upper end of the second side extension 63. The wire guide hole 632 may guide a wire extending from the touch sensor assembly 70 to the touch connector 541 of the display PCB 50. For example, the wire may be moved upward along the rear surface of the second side extension 63, and may be guided to the front through the wire guide hole 632. The wire may be connected to the touch connector 541 at the upper end of the display PCB 50.

Pressing protrusions 636 and 626 may be formed at an approximately intermediate point between the first side extension 62 and the second side extension 63. The pressing protrusions 636 and 626 may protrude rearward from the rear surfaces of the first side extension 62 and the second side extension 63, and may be in contact with the cover rear surface 33 of the display cover 30 in a state in which the display assembly 40 is inserted into the display cover 30.

The pressing protrusions 636 and 626 may be positioned between the upper and lower ends of the frame light guide 61 in the vertical height. That is, the pressing protrusions 636 and 626 may be positioned on both sides of the frame light guide 61, respectively.

Accordingly, the display frame 60 may be pressed forward by the pressing protrusions 636 and 626, and the frame light guide 61 may be maintained in close contact with the rear surface of the cover light guide 311.

The frame light guide 61 may be formed to have the same size as the cover light guide 311, and may be formed at a position corresponding to the cover light guide 311. The frame light guide 61 may be formed to connect the first side extension 62 and the second side extension 63.

The front surface of the frame light guide 61 may be in close contact with the rear surface of the cover light guide 311. In addition, a close-contacting portion 617 that is in close contact with the front surface of the display PCB 50 may be formed in a rear surface of the frame light guide 61. The close-contacting portion 617 may be formed in such a way that a peripheral region of the third through holes 614 of the frame light guide 61 protrudes rearward. Accordingly, the third through holes 614 may be in close contact with the front surface of the display PCB 50 in which the light emitting member 511 is provided, so that light emitted from the light emitting member 511 passes through all the third through holes 614.

The third through holes 614 may be formed to correspond to the second through holes 312 in a one-to-one manner, and may be formed in shapes corresponding to positions corresponding to the second through holes 312. The third through holes 614 may have shapes of seven-segment. In addition, one or more additional third through holes 614 may be formed at a position corresponding to the touch sensor 712. One or more additional third through holes 614 may be used to indicate the unit of temperature.

A fastening protrusion 67 may protrude rearward and may be formed inside the PCB accommodating space 610. The fastening protrusion 67 may be formed at a position corresponding to the fastening hole 512 of the display PCB 50. In particular, the fastening protrusion 67 may protrude from the rear surface of the frame light guide 61 and may extend to pass through the fastening hole 512. In addition, the fastening protrusion 67 may be formed not only on the frame light guide 61 but also on the upper restraining portion 665, and allow the display PCB 50 to be fixedly mounted entirely.

The fastening protrusion 67 may be integrally formed with the display frame 60 when the display frame 60 is molded. Accordingly, the fastening protrusion 67 may be injection-formed of a plastic material, similarly to the display frame 60. In addition, the fastening protrusion 67 may be formed such that the end of the fastening protrusion 67 protrudes to the rear of the display PCB 50 while passing through the fastening hole 512.

As shown in FIG. 14, the end of the fastening protrusion 67 protruding through the fastening hole 512 may be fused to be fixed to the periphery of the fastening hole 512. By the above-described coupling structure, the display frame 60 and the display PCB 50 may be fixed to each other very firmly, and the frame light guide 61 and the display PCB 50 may be coupled to be in close contact with each other.

For example, a coupling structure may be provided that allows the display frame 60 to be coupled to the display PCB 50 at a position adjacent to the light emitting member 511 that is mounted on the display PCB 50. In implementations where the coupling structure includes a screw (not fusing of the fastening protrusion 67), the structure can have a relatively large diameter that can cover not only the diameter of the screw but also the diameter of a boss to which the screw is fastened. This makes it difficult to implement a constraining and close-contacting structure at a position adjacent to the light emitting member 511. However, the structure according to the implementations of the present disclosure can be provided in a relatively narrow space and enable the fastening protrusion 67 having a relatively small diameter to be fused through the fastening hole 512. Further, a plurality of the fastening protrusions 67 may provide coupling structures of the display frame 60 and the display PCB 50 at positions adjacent to the light emitting members 51.

In some implementations, a guide accommodating portion 613 may be formed in the front surface of the frame light guide 61. The guide accommodating portion 613 may be recessed in a shape corresponding to the cover light guide 311, and may be formed to be open downward. Accordingly, when the display assembly 40 is completely inserted into the display cover 30, the cover light guide 311 may be formed to be accommodated in the guide accommodating portion 613. In this case, the cover light guide 311 and the guide accommodating portion 613 may be formed in shapes completely corresponding to each other. In addition, the guide accommodating portion 613 may be recessed to a height corresponding to the thickness of the cover light guide 311.

Further, a frame inclined surface 615 may be formed in the lower surface of the frame light guide 61. The frame inclined surface 615 may contact the cover inclined surface 311*a* to guide the insertion of the display assembly 40, and at the same time, induce the cover light guide 311 to be positioned in front of the frame light guide 61 when the display assembly 40 is inserted.

Further, a first side protrusion 611 and a second side protrusion 612 may be formed on both left and right sides of the frame light guide 61, respectively, and can be inserted into the first side opening 314 and the second side opening 315.

The first side protrusion 611 and the second side protrusion 612 may be formed in shapes corresponding to the first side opening 314 and the second side opening 315. The first side protrusion 611 and the second side protrusion 612 may extend in a vertical direction and be inserted along the first side opening 314 and the second side opening 315 when the display assembly 40 is inserted into the display cover 30.

For example, when the display assembly 40 is mounted, the display frame 60 may be guided such that the display frame 60 is be inserted into the display cover 30 so as to be aligned at the accurate position. In addition, when the display assembly 40 has been inserted into the display cover 30, the frame light guide 61 may overlap the cover light guide 311, and finally, the second through holes 312 may be aligned to communicate with the third through holes 614.

A lower opening 64 may be further formed between the first side extension 62 and the second side extension 63 on the lower side of the frame light guide 61. The lower opening 64 may be formed to have a corresponding size such that the sensor assembly mounting portion 34 of the display cover 30 may be inserted, and may be open downward.

Accordingly, when the display assembly 40 is being inserted, the lower opening 64 and the sensor assembly mounting portion 34 may also be coupled to each other, and the display assembly 40 may be mounted at a more accurate position.

In some implementations, the handle portion 66 may further extend upward from the upper end of the first side extension 62 and the second side extension 63. In addition, a handle extension 662 extending upward may be formed in the center of the handle portion 66. In addition, a gripping portion 661 that be in contact with the decor cover 232 may be formed on the upper end of the handle extension 662.

A PCB accommodating portion 660 may be recessed in the rear surface of the handle extension 662. The PCB accommodating portion 660 may be a space in which the Wi-Fi module 41 is accommodated and may be formed to have a size corresponding to a Wi-Fi PCB 441 of the Wi-Fi module 41.

A plurality of elements may be provided on the Wi-Fi PCB 441, and a connector 412 for connecting to the display PCB 50 by a wire may be further provided. A wire guide portion 664 to guide the wire may be formed to recessed from the handle extension 662, and a handle hole 664*a* which the wire enters and exits may be formed in the wire guide portion 664. The wire may be connected to the Wi-Fi connector 543 of the display PCB 50 through the handle hole 664*a*.

In some implementations, an opening 663 may be further formed in the PCB accommodating portion 660. The opening 663 may prevent interference by allowing an element provided in the Wi-Fi PCB 411 to pass through the opening 663 when the Wi-Fi PCB 411 is mounted on the PCB accommodating portion 660.

Hereinafter, a structure in which the display cover 30 and the display assembly 40 are coupled will be described in more detail with reference to the drawings.

Figure 15:
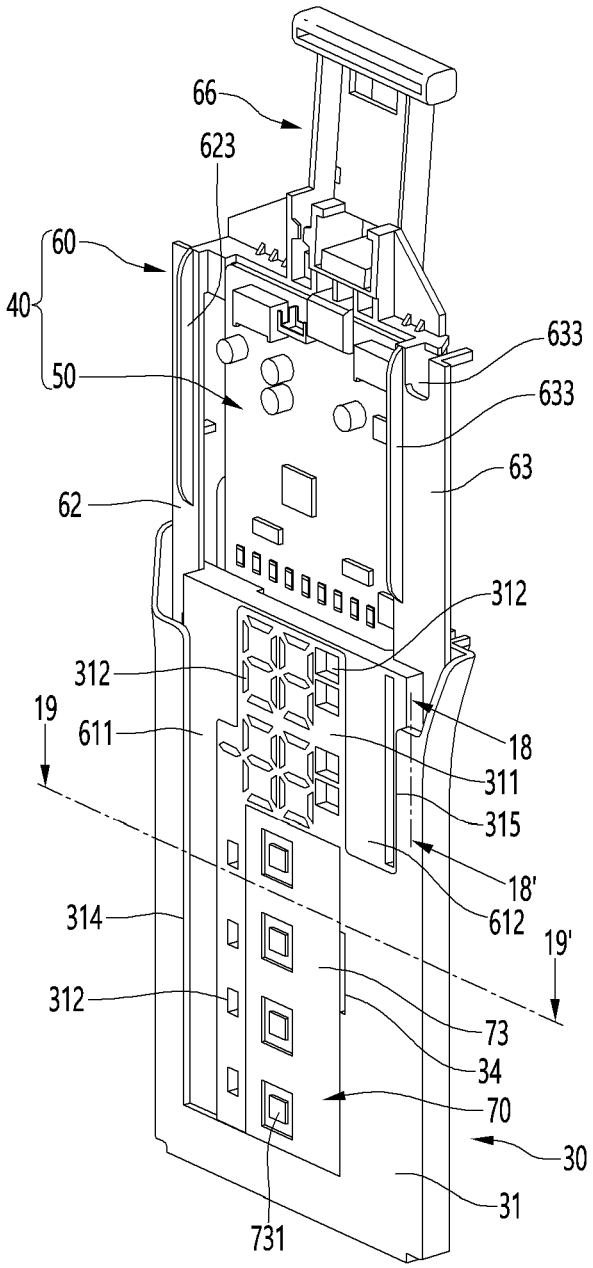
FIG. 15 is a front perspective view of the display assembly coupled to the display cover.
Figure 16:
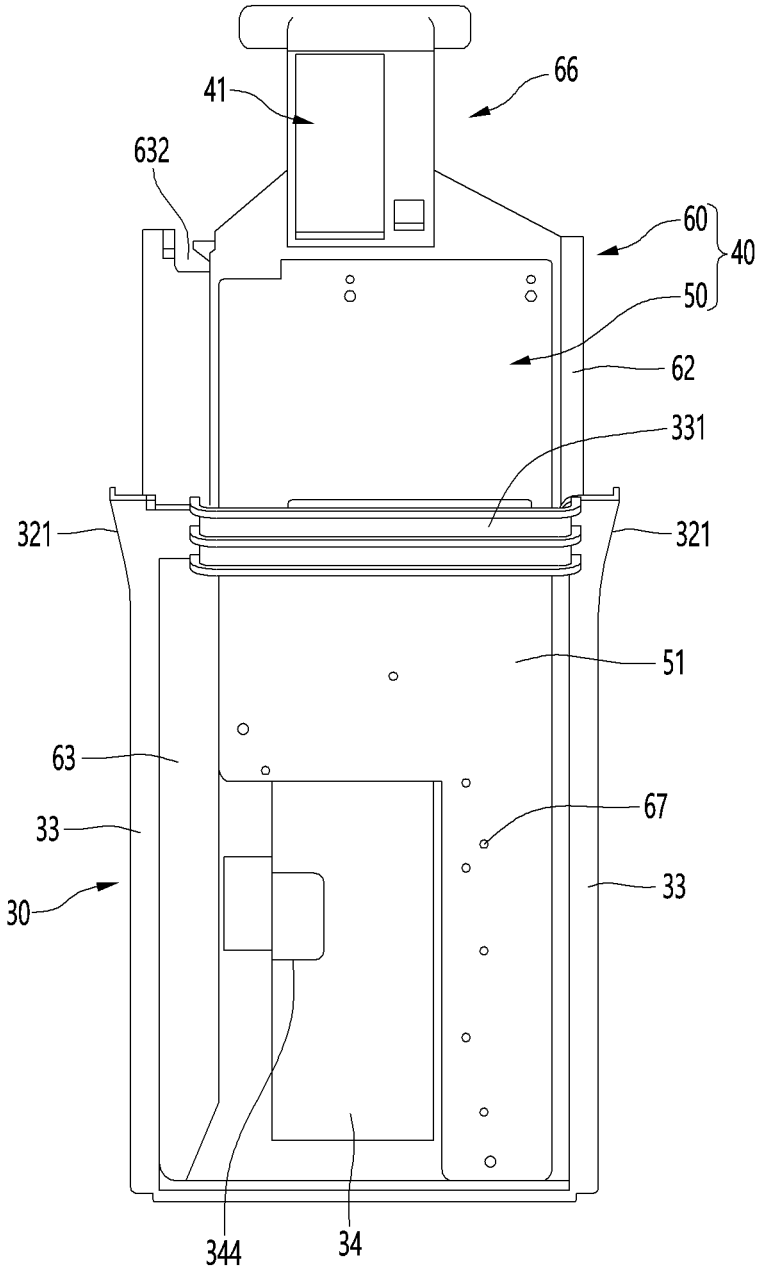
FIG. 16 is a perspective view of the display assembly coupled to the display cover as viewed from the rear.
Figure 17:
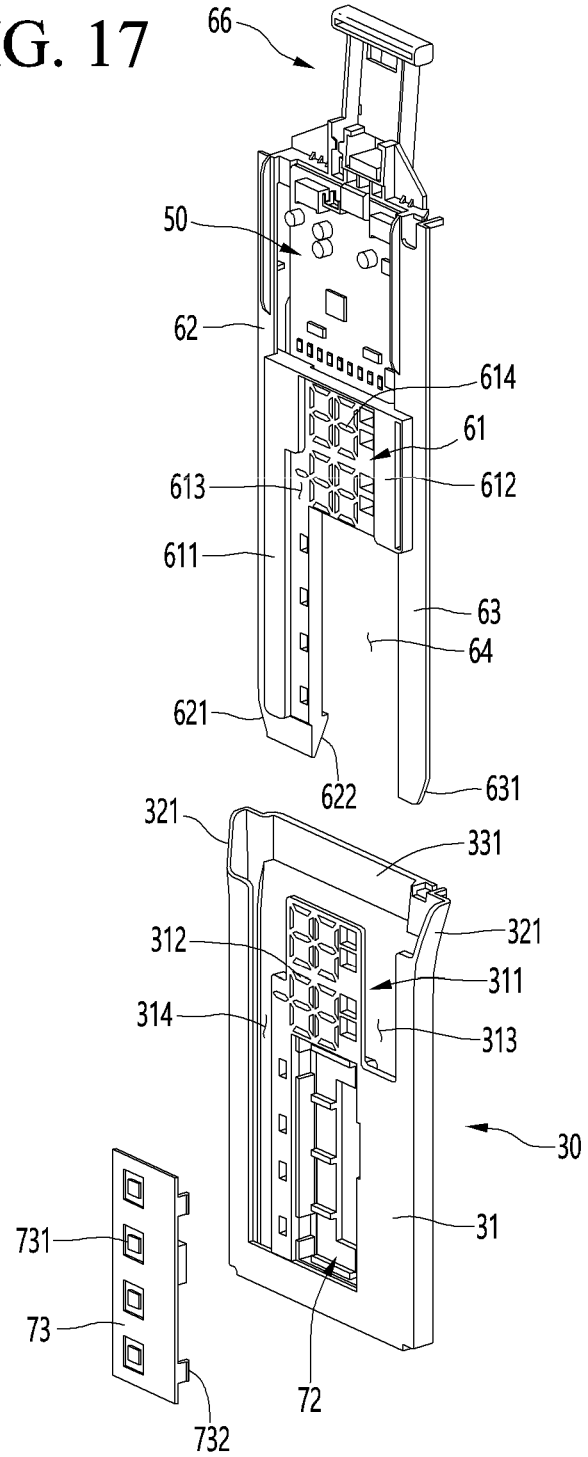
FIG. 17 is an exploded perspective view of the display cover, the display assembly, and the touch assembly.
Figure 18:
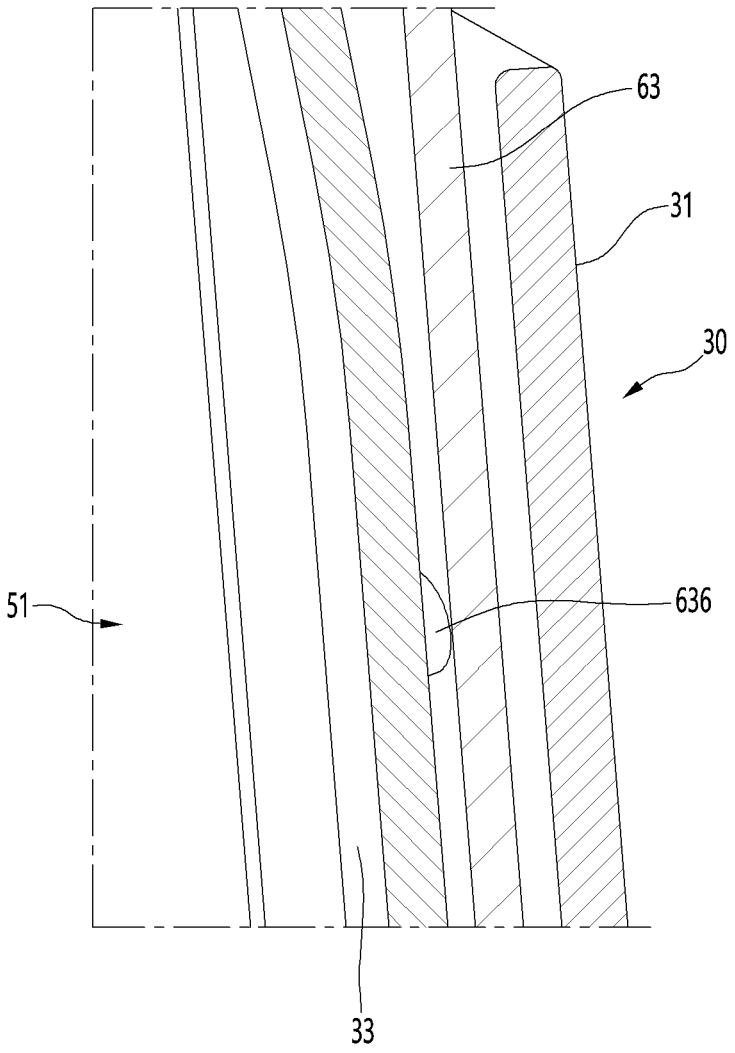
FIG. 18 is a cutaway perspective view taken along line 18-18' of FIG. 15.
Figure 19:
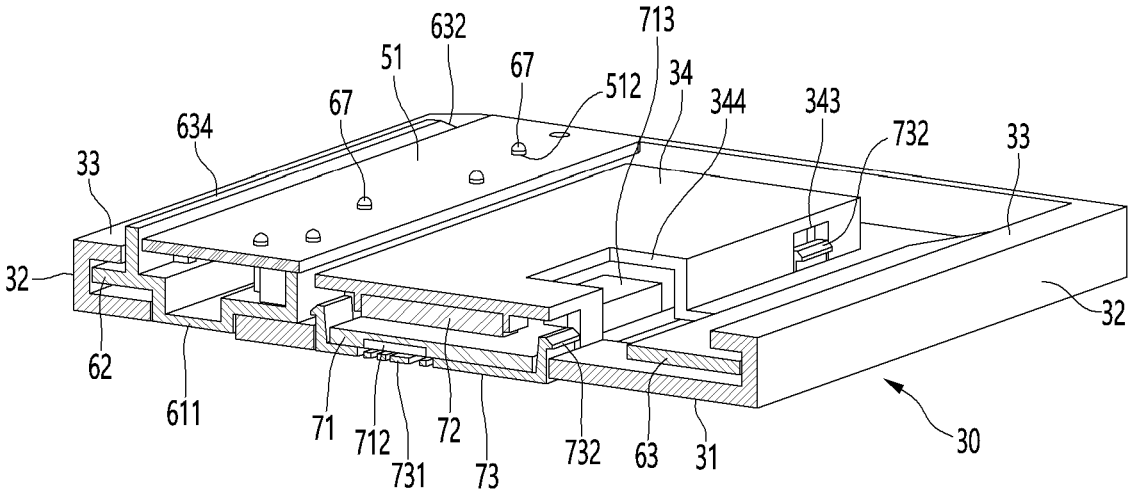
FIG. 19 is a cutaway perspective view taken along line 19-19' of FIG. 15.

FIG. 15 is a front perspective view of the display assembly coupled to the display cover. FIG. 16 is a perspective view of the display assembly coupled to the display cover as viewed from the rear. FIG. 17 is an exploded perspective view of the display cover, the display assembly, and the touch assembly. FIG. 18 is a cutaway perspective view taken along line 18-18' of FIG. 15. FIG. 19 is a cutaway perspective view taken along line 19-19' of FIG. 15.

As shown in the drawings, the display assembly 40 may be inserted into and mounted on the display cover 30 in a state in which the display PCB 50 is coupled to the display frame 60.

In this case, when the display cover 30 is fixedly mounted on the rear surface of the outer plate 21, a user may hold the handle portion 66 and insert the handle portion 66 into the upper surface of the display cover 30 by passing through the decor opening 231 defining the upper surface of the door 20 to which the lower end of the display assembly 40 is assembled.

In this case, the display assembly 40 may be easily inserted into the display cover 30 by a guiding and coupling structure of the display frame 60 and the display cover 30.

In addition, when the display assembly 40 is inserted into the display cover 30, the display assembly 40 may be guided to an accurate position in the inside of the display cover 30 by the guide of the first side extension 62 and the second side extension 63.

In particular, the first side protrusion 611 and the second side protrusion 612 may have a structure that enables the first side opening 314 and the second side opening 315 to be engaged to mesh with each other. Accordingly, the display assembly 40 may be mounted in a state in which the position thereof is aligned inside the display cover 30.

The frame light guide 61 and the cover light guide 311 may overlap with each other in the front-rear direction. The third through holes 614 of the frame light guide 61 and the second through holes 312 of the cover light guide 311 may be aligned to communicate with each other. In this case, the second through holes 312 and the third through holes 614 may be formed to have sizes corresponding to each other and may match each other in a one-to-one manner.

In some implementations, the display frame 60 may be pressed forward in the inside of the display cover 30 by the pressing protrusions 636 and 626 formed in the first side extension 62 and the second side extension 63.

As shown in FIG. 18, the pressing protrusions 636 and 626 may come into contact with the cover rear surface 33 of the display cover 30, and press the display frame 60 to move forward. Accordingly, the rear surface of the cover light guide 311 and the front surface of the frame light guide 61 may be brought into close contact with each other. In addition, the light emitted from the light emitting member 511 may completely pass through the third through hole 614 and the second through hole 312 in turn while the light does not leak between the second through hole 312 and the third through hole 614.

In a state in which the display assembly 40 has been completely inserted into the display cover 30 and mounted, the front surface 31 of the display cover 30 and the front surface of the display assembly 40 may form the same plane to be maintained in close contact with the rear surface of the outer plate 21.

For example, as illustrated in FIGS. 15 and 19, when the display assembly 40 has been inserted into the display cover 30, the first side protrusion 611 and the second side protrusion 612 may be coupled to the inside of the side opening 314 and the inside of the second side opening 315. Further, the front surfaces of the first side protrusion 611 and the second side protrusion 612 are exposed to the front surfaces of the first side opening 314 and the second side opening 315 and form the same plane as the cover front surface 31.

Accordingly, a part of the front surface of the display assembly 40 which has been inserted into the display cover 30 may be also fixed in close contact with the outer plate 21 while the display cover 30 is attached to the rear surface of the outer plate 21.

As a result, the display cover 30 in which the second through holes 312 are formed is fixedly mounted onto the rear surface of the outer plate 21 while the second through holes 312 are aligned with the first through holes 213. In addition, the display PCB 50 provided with the light emitting member 511 may be coupled in close contact with the display frame 60 in which the third through holes 614 are formed, and inserted into the display cover 30 so that the first through holes 213, the second through holes 312, and the third through holes 614 are all aligned finally, thus allowing light emitted from the light emitting member 511 to pass through the through holes.

In some implementations, the sensor assembly mounting portion 34 may be recessed from the front surface of the display cover 30, and the touch cover 73, the touch PCB 71, and the elastic member 72 may be mounted in the sensor assembly mounting portion 34.

In this case, the touch cover 73 positioned at the most front may also be positioned on the same plane as the cover front surface 31 of the display cover 30, and fixedly mounted onto the outer plate while being mounted on the display cover 30. Accordingly, when the display cover 30 is fixedly mounted, the display cover 30 may also be in close contact with the rear surface of the outer plate 21.

Hereinafter, the touch sensor assembly 70 will be described in more detail with reference to the drawings.

Figure 20:
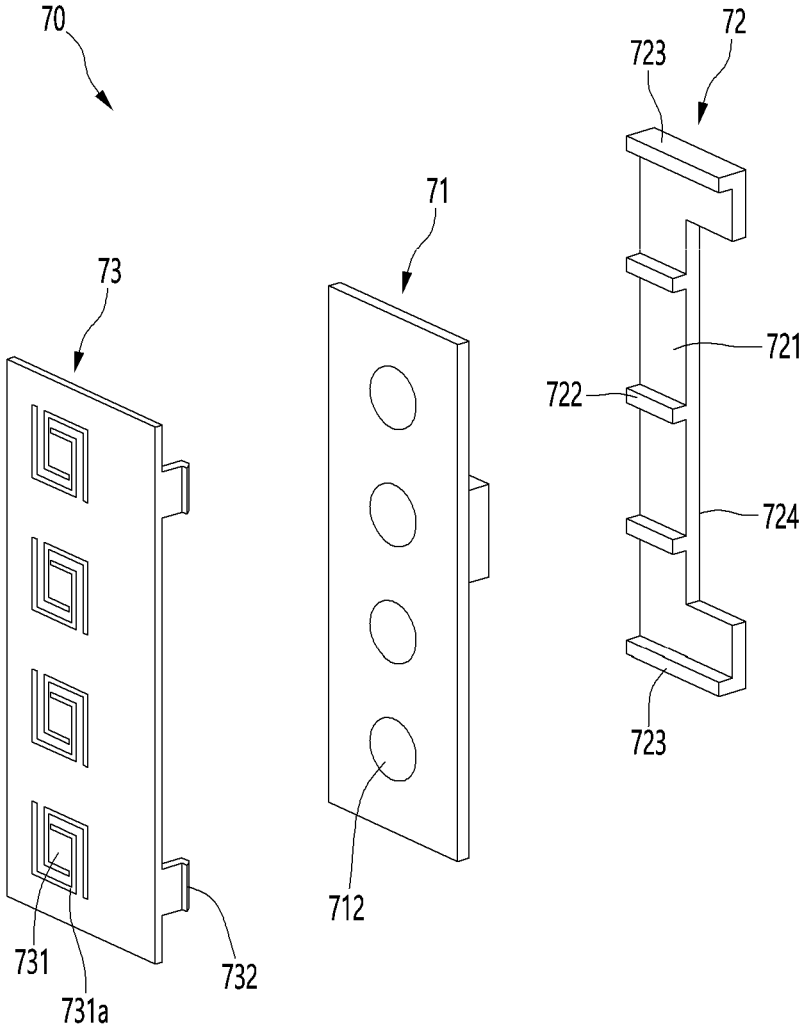
FIG. 20 is an exploded perspective view of the touch assembly.
Figure 21:
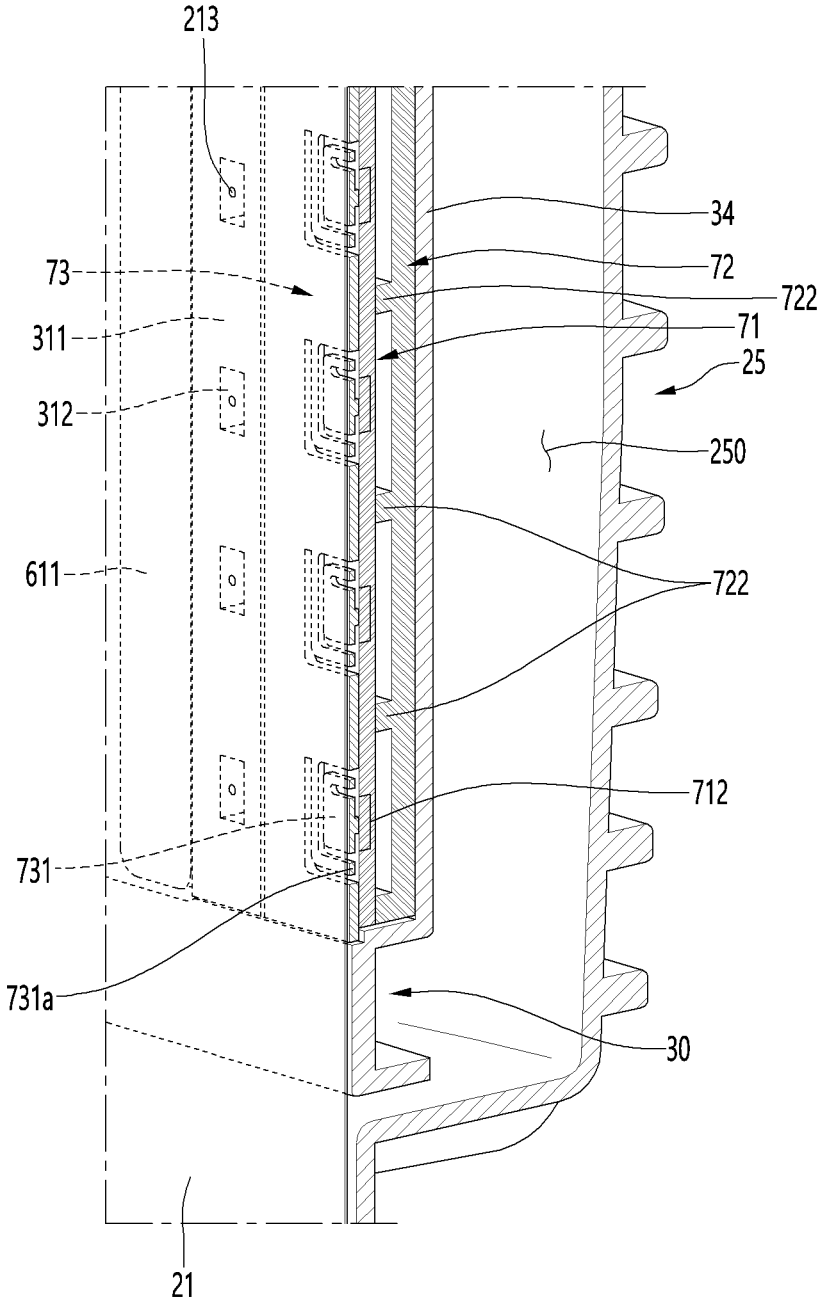
FIG. 21 is a cutaway perspective view taken along line 21-21' of FIG. 2.

FIG. 20 is an exploded perspective view of the touch assembly. FIG. 21 is a cutaway perspective view taken along line 21-21' of FIG. 2.

As shown in the drawings, the elastic member 72, the touch PCB 71, and the touch cover 73 constituting the touch sensor assembly 70 may be mounted in turn inside the sensor assembly mounting portion 34 of the display cover 30.

The elastic member 72 may be fixedly mounted onto the bottom surface of the sensor assembly mounting portion 34. Further, the elastic member 72 may be formed of an elastic material such as rubber, and press and support the touch PCB 71 forward from the rear.

In this case, the elastic member 72 may include a base 721 forming a bottom surface, and support protrusions 722 and 723 protruding forward from the base 721. The base 721 may be formed in a plate shape, and may be formed at least in a size corresponding to the touch PCB 71.

A base depression 724 may be formed to be recessed inward from one side of the base 721. The base depression 724 may be formed at a position corresponding to the PCB connector 713 mounted on the touch PCB 71 and may be recessed at a position corresponding to the mounting hole 344. Accordingly, even when the touch PCB 71 is mounted, it is possible to prevent interference by the PCB connector 713 and wires connected to the PCB connector 713.

A plurality of support protrusions 722 and 723 extending in the horizontal direction may be formed in the base 721. The plurality of support protrusions 722 and 723 may be positioned at intermediate points between a plurality of touch sensors 712 provided in the touch PCB 71. In addition, the support protrusions 722 and 723 may be elongated in the horizontal direction from one end to the other end of the base 721. The length of the support protrusions 722 and 723 in the horizontal direction may be longer than a diameter of the touch sensor 712.

In some implementations, among the plurality of support protrusions 722 and 723, the support protrusions 723 formed at the upper and lower ends of the base 721 may be formed to be longer than the lengths of the remaining support protrusions 722. That is, the shape of the base 721 may have a longer width at the upper and lower ends than that of the middle portion due to the base depression 724, and therefore, the support protrusions 723 formed at the upper and lower ends of the base 721 may be also formed to be longer than the support protrusions 722 positioned between the upper and lower ends of the base 721.

The widths of the support protrusions 723 positioned at the upper and lower ends of the base 721 may correspond to the widths of the upper and lower ends of the base 721 so that the upper and lower ends of the touch PCB 71 may be entirely supported. Accordingly, it is possible to stably support the touch PCB 71 from the rear and prevent the touch PCB 71 from tilting in one direction.

The touch PCB 71 may be formed in a plate shape capable of being accommodated inside the sensor assembly mounting portion 34 and may have a structure that is entirely supported by the elastic member 72.

A plurality of touch sensors 712 may be provided on the front surface of the touch PCB 71. The touch sensor 712 is a sensor device that recognizes a touch operation by detecting a change in pressure, and a general piezo-type touch sensor may be used.

Accordingly, the touch sensor 712 may recognize a user's touch operation by detecting a change in pressure applied according to the deformation of the outer plate 21 when the user presses the outer plate 21.

A plurality of the touch sensors 712 may be disposed in the vertical direction, and may be disposed in each of regions between the plurality of support protrusions 722 and 723. That is, the support protrusions 722 and 723 may be disposed in the upper and lower portions adjacent to a position where the touch sensor 712 is mounted, and the pressure applied to the touch sensor 712 by the arrangement of the support protrusions 722 and 723 may be concentrated to the central portion of the touch sensor 712.

The touch PCB 71 may be pressed forward by the elastic member 72 and further pressed forward by the support protrusions 722 and 723 so that the touch sensor 712 may be brought into more close contact with the rear surface of the touch cover 73. Accordingly, a user's touch manipulation through the touch cover 73 may be more effectively recognized.

The touch cover 73 may be formed to have a size corresponding to the open front surface of the sensor assembly mounting portion 34, and may be fixedly mounted to the sensor assembly mounting portion 34 by the cover hooks 732 formed on both sides of the touch cover 73 to be movable in the front and rear directions.

Accordingly, in a state in which the touch PCB 71 is pressed and supported forward by the elastic member 72, it is possible to more closely contact the rear surface of the outer plate 21. In addition, when the outer plate 21 is pressed, the outer plate 21 may more effectively press the touch sensor 712 while being moved rearward.

A touch booster 731 may be disposed on the touch cover 73. The touch booster 731 may be formed to be concentric with the central portion of the touch sensor 712, and may be formed in front of the touch sensor 712. In addition, a plurality of spiral-shaped booster cutouts 731*a* are formed along the periphery of the touch booster 731 so that the central portion of the touch booster 731 may be moved backward when pressure is applied to the touch booster 731. That is, the touch booster 731 may be moved backward while being elastically deformed by the booster cutout 731*a*, and may return to its original position when the user releases a pressing hand.

A protrusion protruding rearward may be further formed in the center of the touch booster 731, and thus, when the touch booster 731 is moved backward by an operation of pressing the outer plate 21, the touch sensor 712 may be pressed more effectively.

Hereinafter, a state in which the display part 211 is visible in the refrigerator having the above structure will be described with reference to the drawings.

Figure 22:
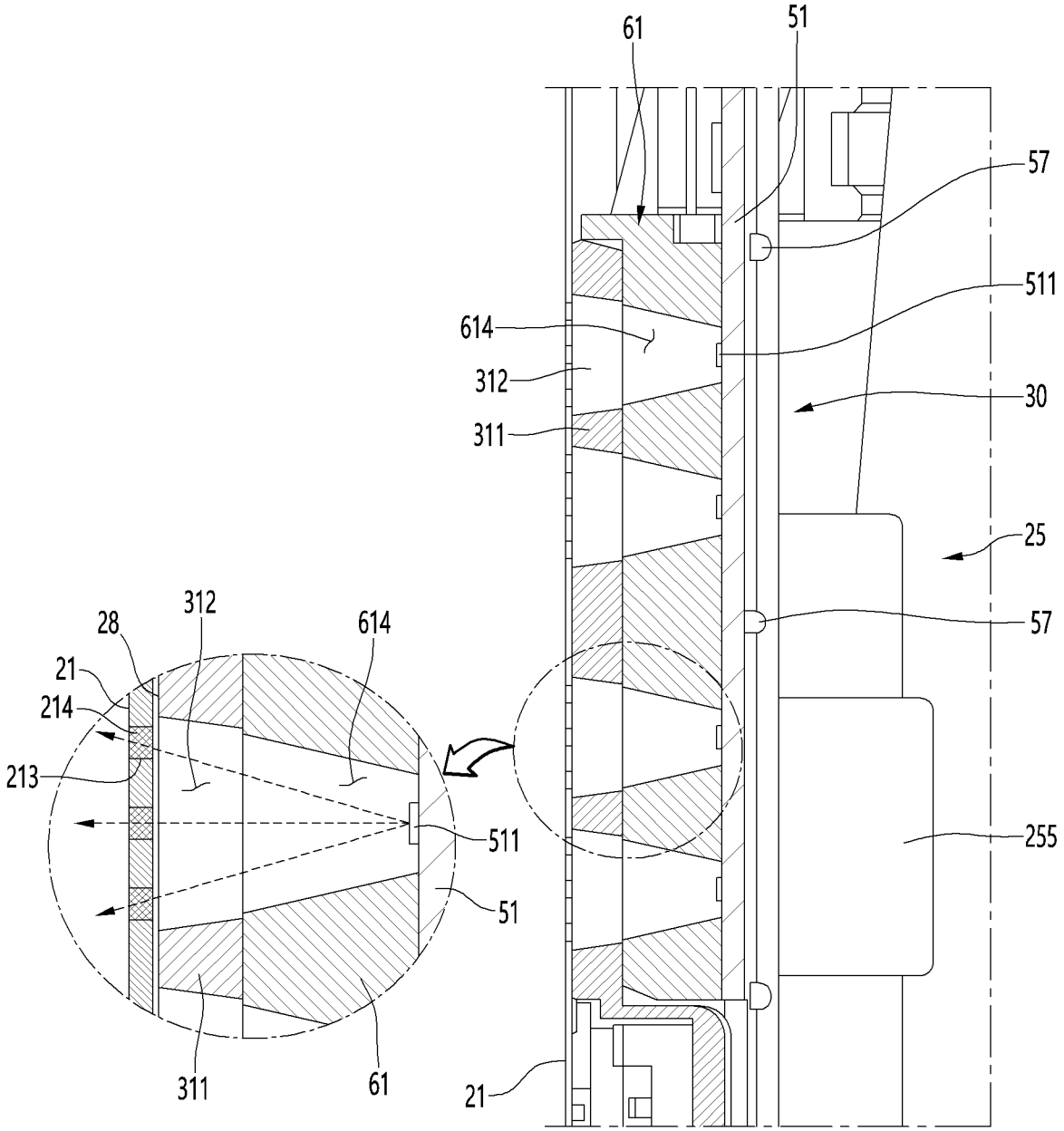
FIG. 22 is a cross-sectional view taken along line 22-22' of FIG. 2.
Figure 23:
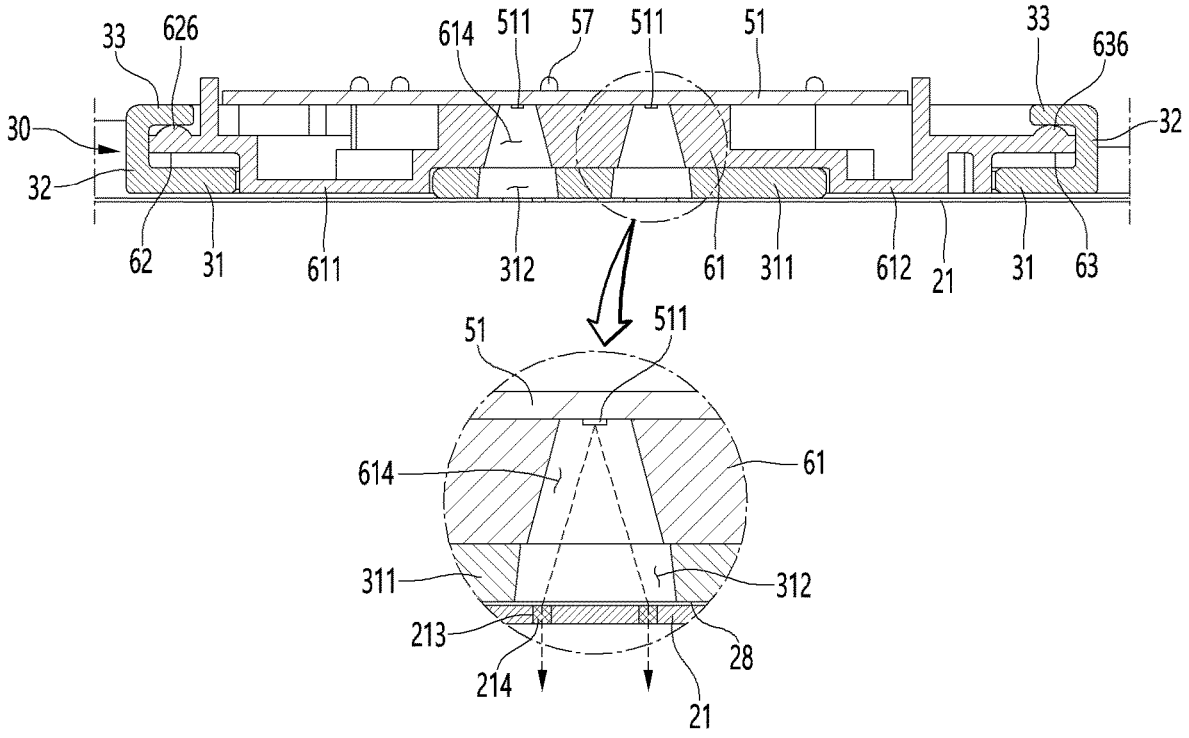
FIG. 23 is a cross-sectional view taken along line 23-23' of FIG. 2.

FIG. 22 is a cross-sectional view taken along line 22-22' of FIG. 2. FIG. 23 is a cross-sectional view taken along line 23-23' of FIG. 2.

As shown in the drawings, when a user's touch manipulation is received during operation of the refrigerator 1 or the operation state of the refrigerator 1 is displayed, the light emitting member 511 is turned on, and the display part 211 may be visualized while light is emitted. In addition, the display part 211 may display a specific number, letter, symbol, or pattern by means of a plurality of first through holes 213 constituting the display part 211 to transmit information to a user.

For example, when the light emitting member 511 is turned on, light emitted by the light emitting member 511 may be emitted to the outside by passing through the third through holes 614, the second through holes 312 and the first through holes 213 sequentially by the display assembly 40 and the display cover 30 coupled to be aligned.

In this case, the display PCB 50 in which the light emitting member 511 is provided may be accommodated in the display frame 60 and firmly coupled to the display frame 60 by the fastening protrusion 67 and the fastening hole 512, so that light from the light emitting member 511 passes through the third through holes 614.

In addition, the display cover 30 may be coupled to the outer plate 21 such that the plurality of first through holes 213 are aligned with the second through holes 312. Accordingly, the light passing through the second through holes 312 may pass through the first through holes 213 in the inner regions of the second through holes 312 and the light may be emitted to the outside.

A diffusion sheet 28 may be further provided between the display cover 30 and the outer plate 21 so that light passing through the first through holes 213 becomes brighter, making the first through holes 213 look sharper and brighter. In addition, a transparent hole filling member 214 may be provided inside the first through hole 213, and emitted light may pass through the hole filling member 214 and be emitted to the outside.

In some implementations, when the display assembly 40 is inserted into the display cover 30, the display cover 30 and the display assembly 40 may be coupled to each other in a state in which they are aligned at an accurate position by several structures, such as (i) the structure of the plurality of inclined portions 621, 622, and 631, the inclined surfaces 311*a* and 615, and the inlet portion 321 formed in the display frame 60 and the display cover 30, (ii) the structure that couples the first side opening 314, the second side opening 315, the first side protrusion 611 and the second side protrusion 612 with each other, (iii) the close-contacting structure by the pressing protrusions 636 and 626, and (iv) the like.

Therefore, all of light passing through the third through holes 614 may be guided to the second through holes 312, and then guided to the first through holes 213 without not being leaked or covered, thereby light being emitted to the outside.

Alternatively or in addition to the implementations described above, the refrigerator according to the present disclosure may be implemented in various other implementations. Hereinafter, a refrigerator according to another implementation of the present disclosure will be described in detail with reference to the drawings.

Figure 24:
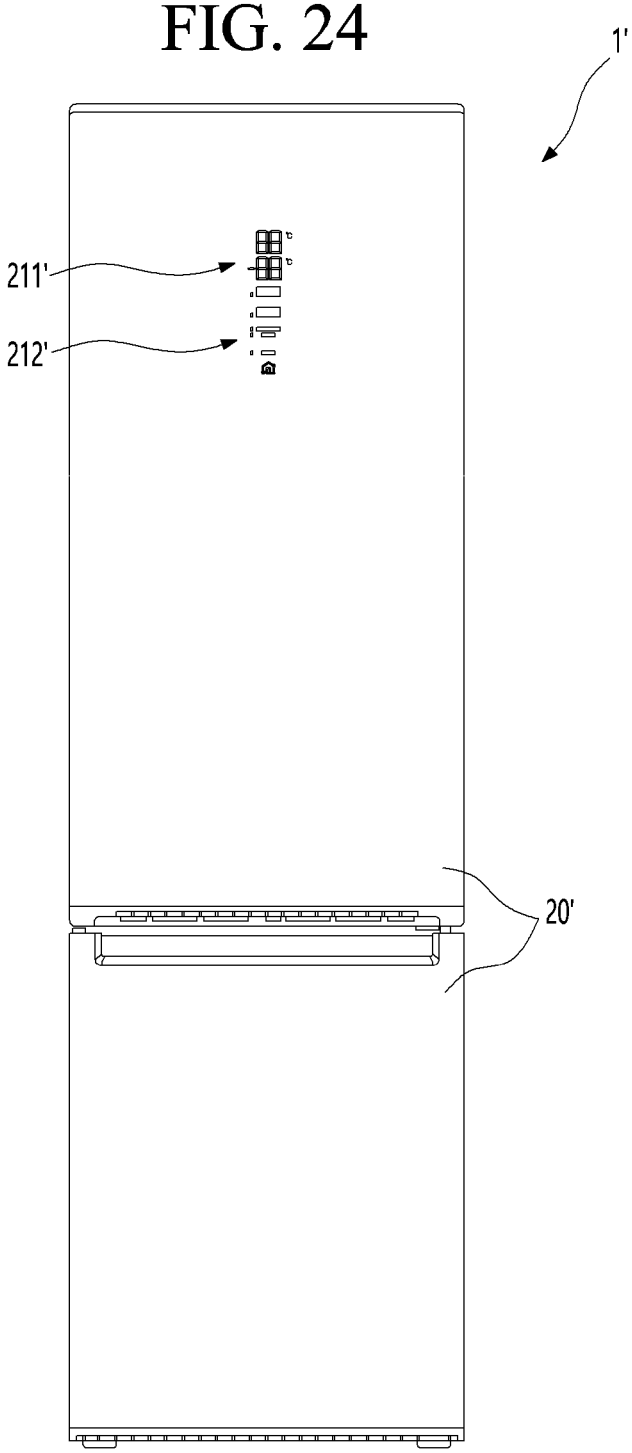
FIG. 24 is a front view of a refrigerator according to an implementation of a refrigerator door.

FIG. 24 is a front view of a refrigerator according to an implementation of a refrigerator door.

As shown in the drawings, a refrigerator 1' according to an implementation of the present disclosure may include a cabinet defining a storage space and refrigerator doors 20' mounted on the cabinet 10 to open and close the storage space. Here, an outer appearance of the refrigerator 1' may be defined by the cabinet, the doors 20', and the like.

The storage space may be divided into left and right sides and/or upper and lower sides, and a plurality of refrigerator doors 20' for opening and closing each space may be provided on an open front surface of the storage space.

The refrigerator door 20' may be configured to open and close the storage space in a sliding or rotating manner, and may be configured to define a front outer appearance of the refrigerator 1' when the doors are closed.

The refrigerator door 20' on one side (upper left side in FIG. 24) of the plurality of refrigerator doors 20' may be provided with a display part 211' and a touch manipulation part 212' at a height that makes user's manipulation and identification easy.

The display part 211' is for displaying the operating state of the refrigerator 1' to the outside of the refrigerator. The display part 211' may display a symbol, number, or the like as light is emitted from the inside of the refrigerator door 20' and transmitted through the display part 211', thus enabling the user to identify the symbol or number from the outside. The specific structure and shape of the display part 211' may be the same as the display part 211 of the above-described implementation (FIGS. 1-23).

The touch manipulation part 212' is a part that allows the user to make a touch to operate the refrigerator 1' and is provided on a partial area of the front surface of the refrigerator door 20'. A portion of the touch manipulation part 212' where a pressing operation can be detected may be configured by various methods such as plane processing such as printing or etching or light transmission. The specific structure and shape of the touch manipulation part 212' may be the same as the touch manipulation part 212 of the above-described implementation (FIGS. 1-23).

Figure 25:
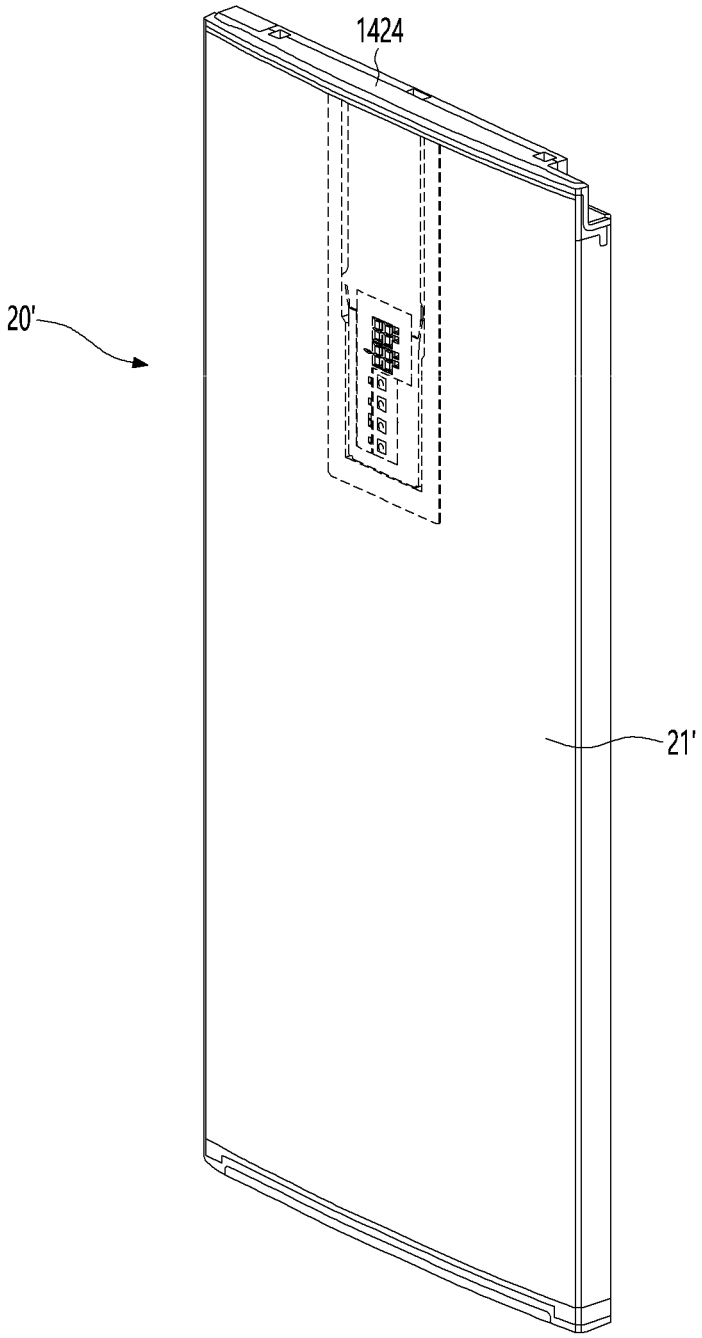
FIG. 25 is a perspective view of the refrigerator door.
Figure 26:
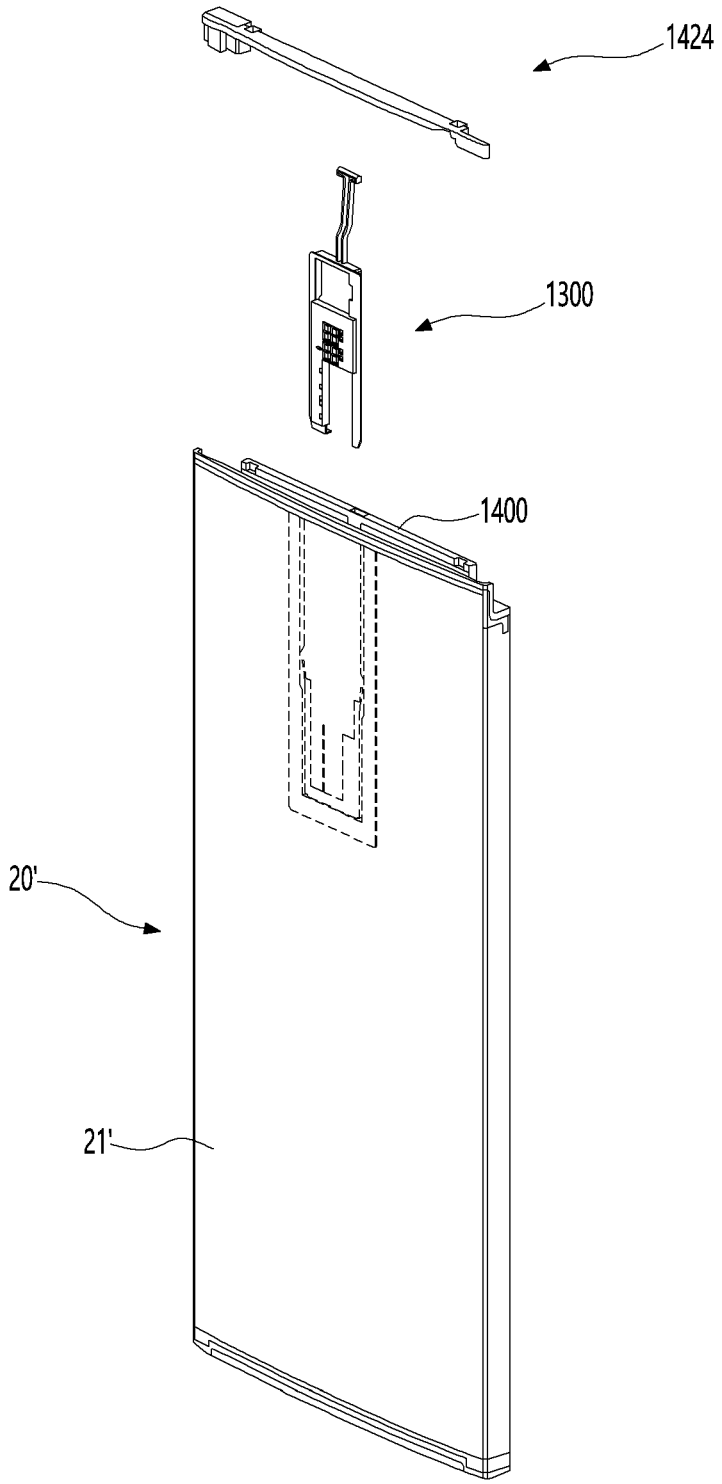
FIG. 26 is an exploded perspective view showing a state in which a decor cover and a frame assembly constituting the refrigerator door are separated.
Figure 27:
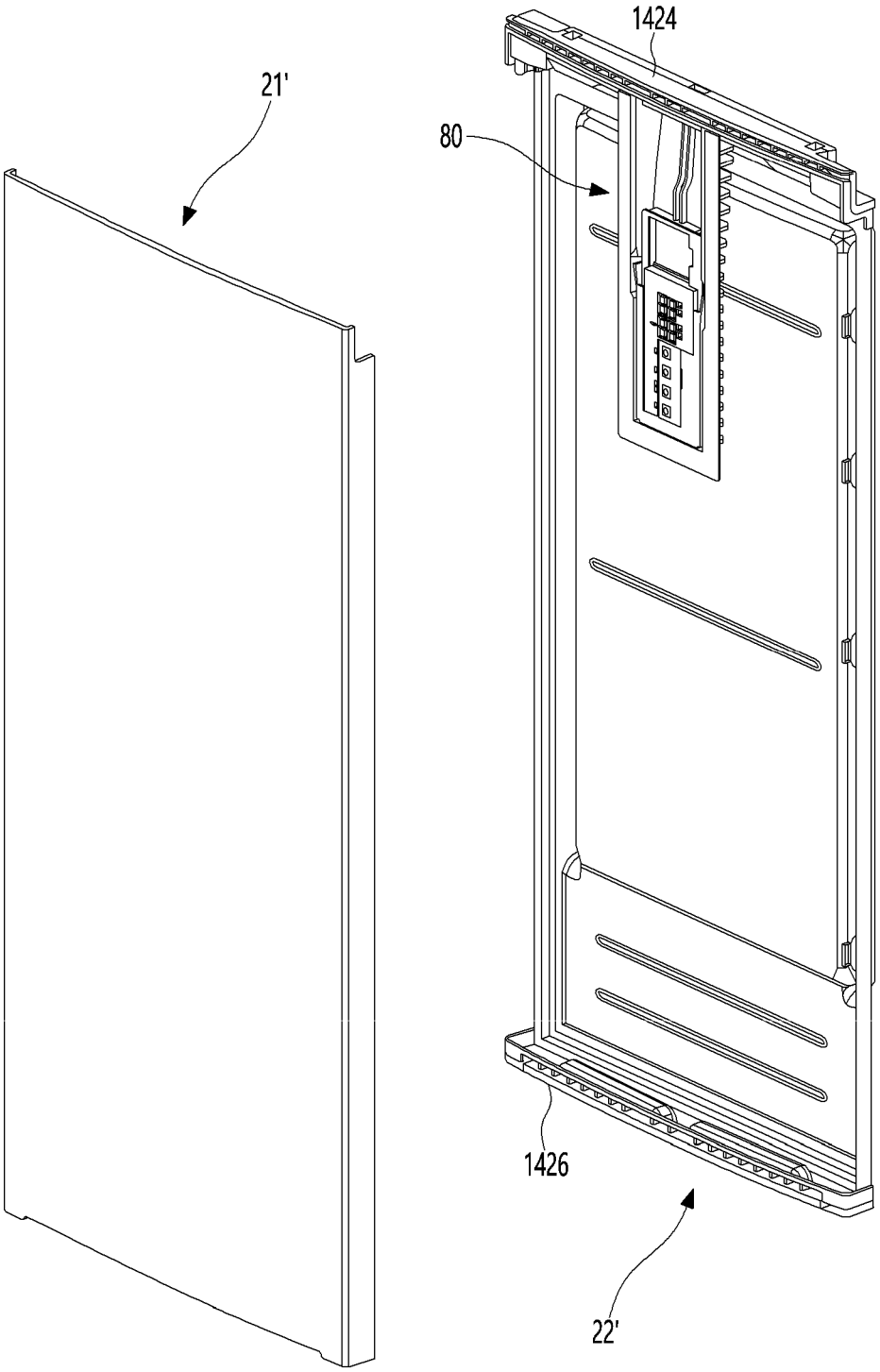
FIG. 27 is an exploded perspective view showing a state in which a front panel and a door liner constituting the refrigerator door are separated.

FIG. 25 is a perspective view of the refrigerator door 20', and FIG. 26 is an exploded perspective view showing a state in which a decor cover 1424 and a frame assembly 1300 constituting the refrigerator door 20' are separated from each other and a front panel 21' and a door liner 22' are separated from each other.

As shown in the drawings, the refrigerator door 20' may be provided with a front panel 21' defining a front appearance and a door liner 22' defining a rear appearance, and the like. Parts having various functions may be provided between the front panel 21 and the door liner 22'.

In some implementations, a touch display device 80 may be provided between the front panel 21' and the door liner 22'.

The touch display device 80 may detect a user's touch signal and emit light such that a state of the refrigerator is displayed to the outside, and may be coupled to an upper end of the door liner 22' as shown.

A decor cover 1424 and a lower decor 1426 may be further provided at the upper and lower ends of the door liner 22'.

The decor cover 1424 and the lower decor 1426 may shield a gap between the front panel 21' and the upper and lower ends of the door liner 22', and at the same time, define the appearance of the upper and lower ends of the refrigerator door 20'.

The decor cover 1424 may define the appearance of an upper surface of the refrigerator door 20' and at the same time, serve to shield a frame entrance 1422, which will be described below. For example, a frame assembly 1300 to be described below may have a cover function of shielding the frame entrance 1422, which is a passage through which the frame assembly 1300 is separated upward of the refrigerator door 20'.

Figure 28:
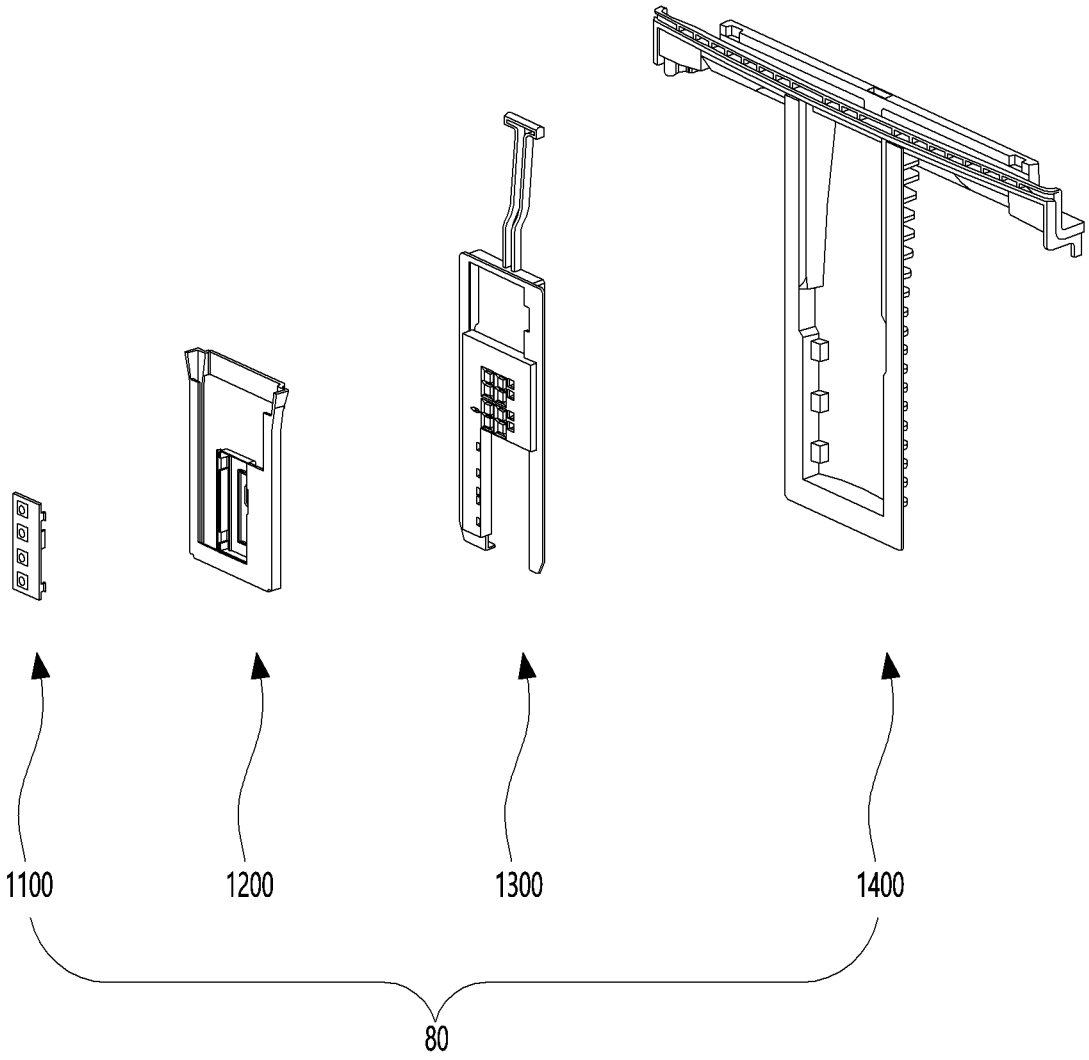
FIG. 28 is an exploded perspective view showing a configuration of a touch display device that is a part of the refrigerator door.
Figure 29:
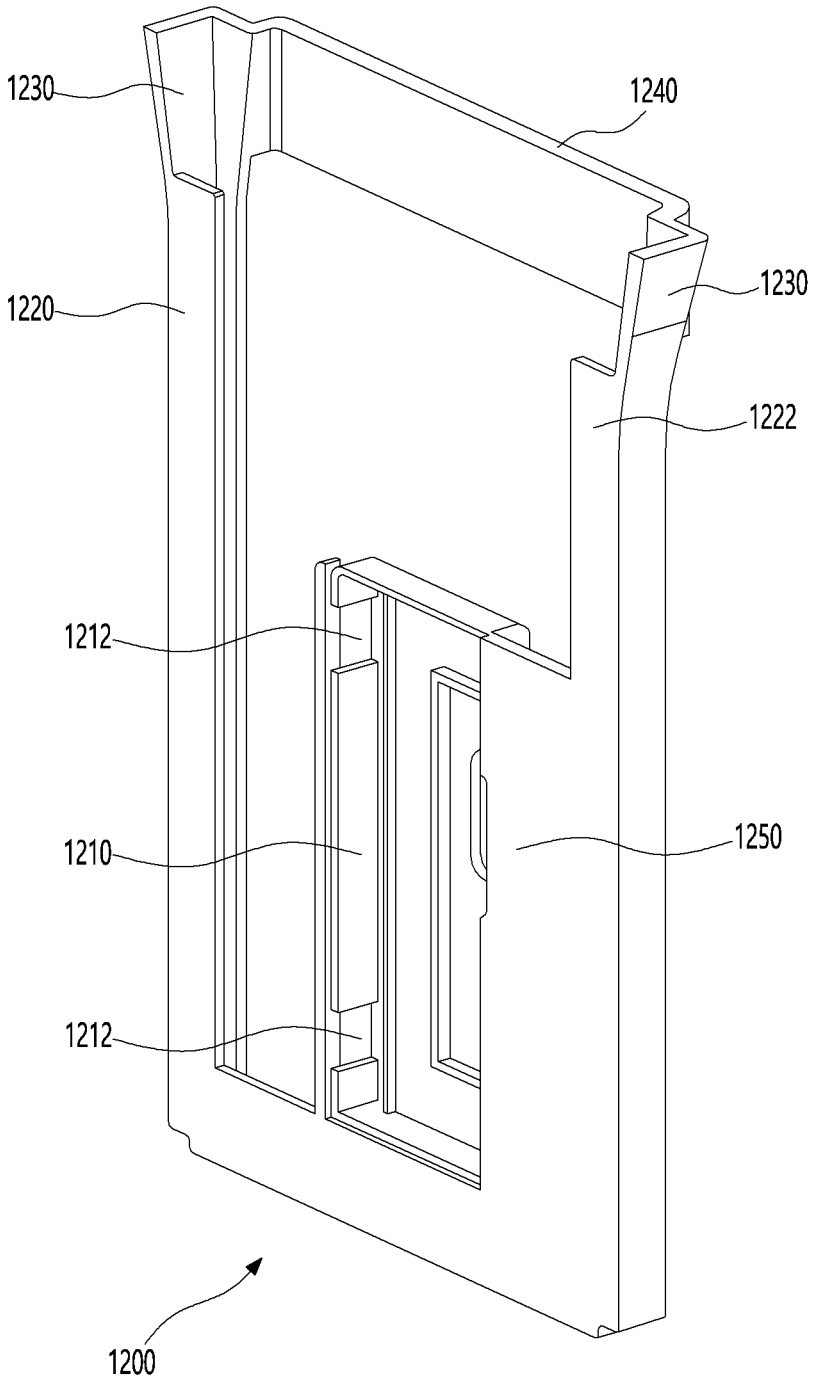
FIG. 29 is a perspective view showing a detailed configuration of a cover assembly that is a part of the touch display device.
Figure 30:
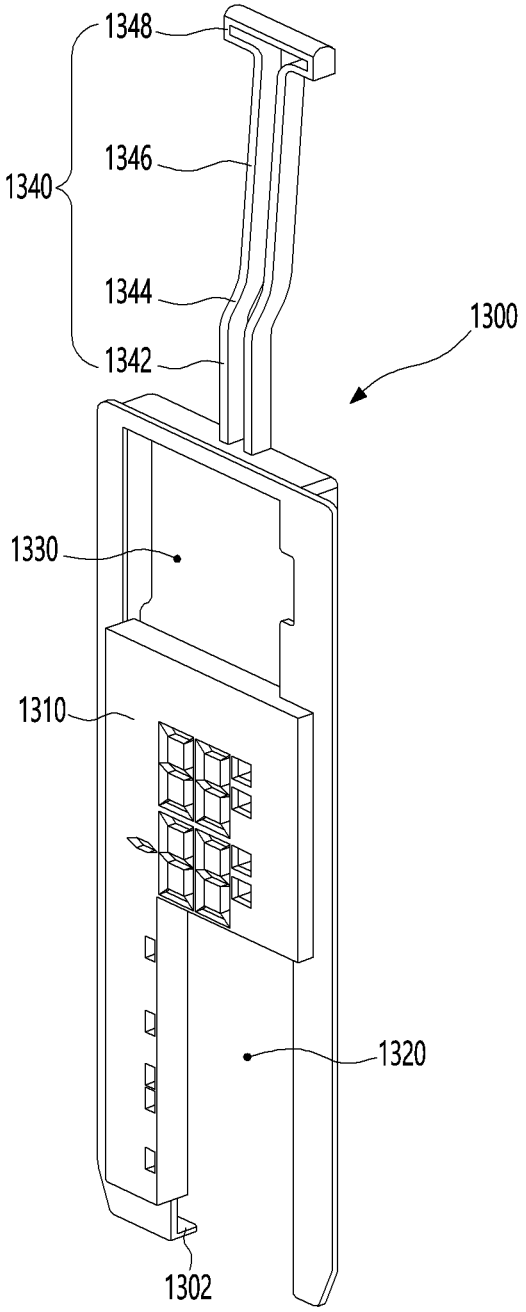
FIG. 30 is a perspective view showing a detailed configuration of a frame assembly, which is a part of the touch display device.
Figure 31:
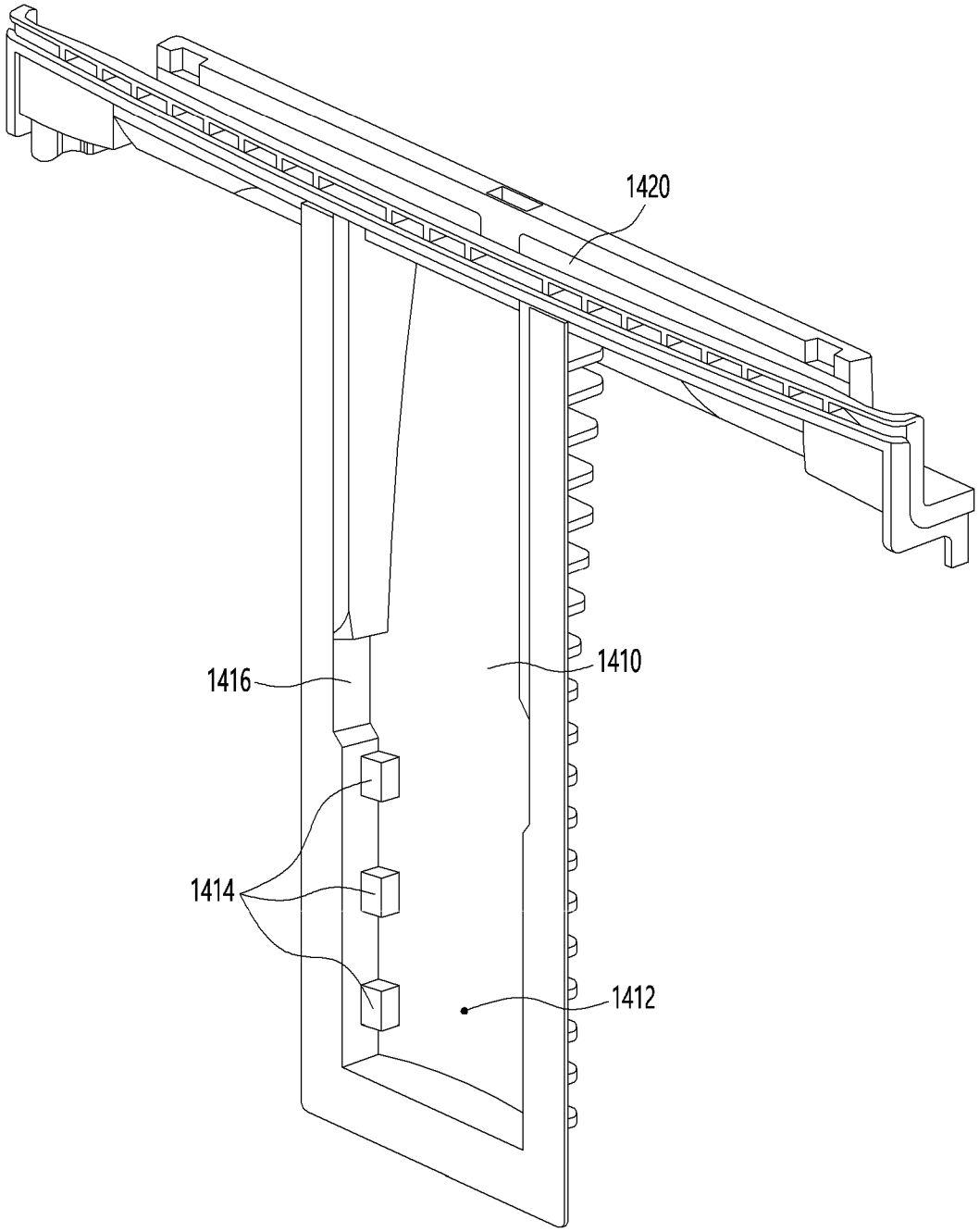
FIG. 31 is a perspective view showing a detailed configuration of a case assembly that is a part of the touch display device.
Figure 32:
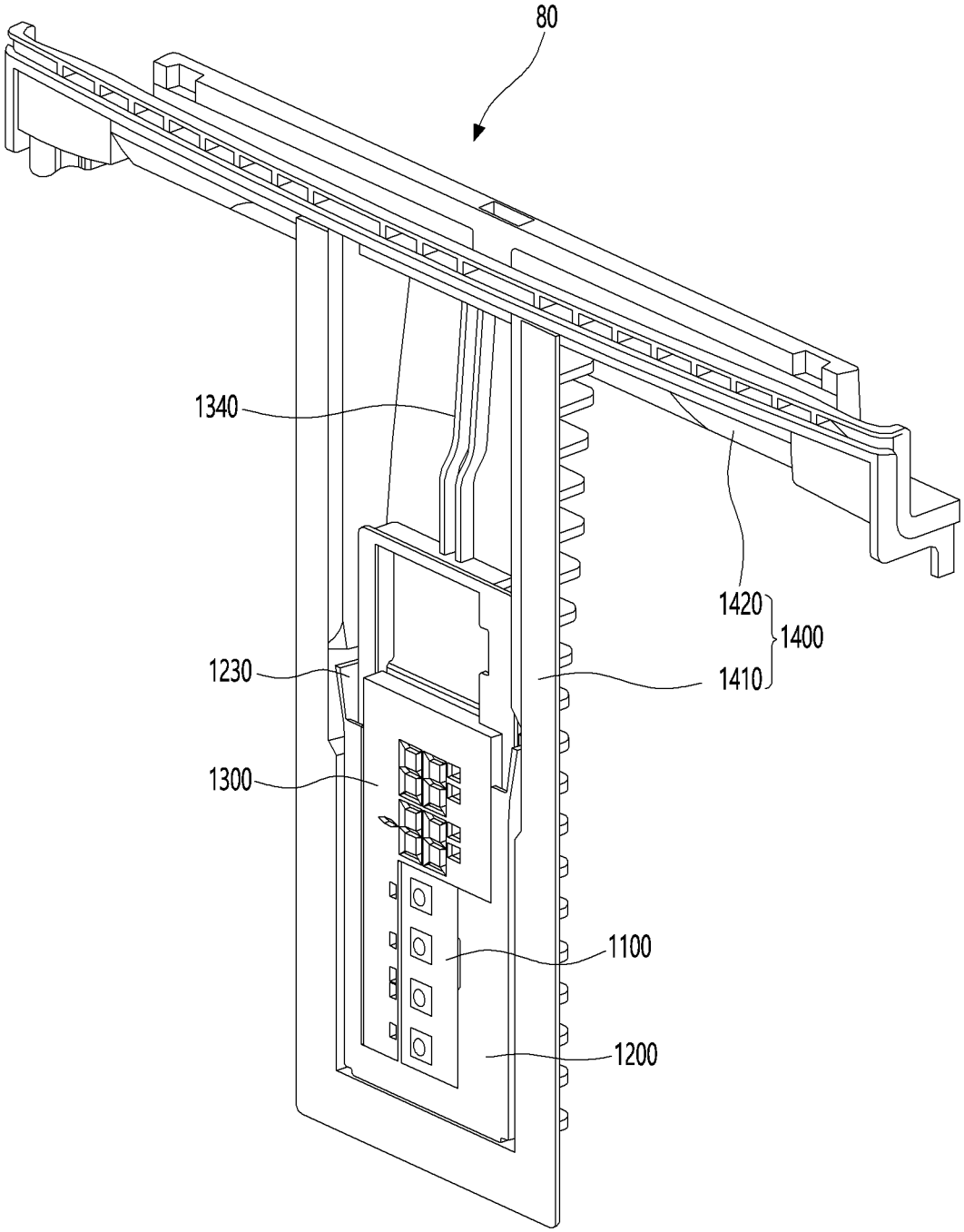
FIG. 32 is a perspective view showing a configuration of the touch display device.
Figure 33:
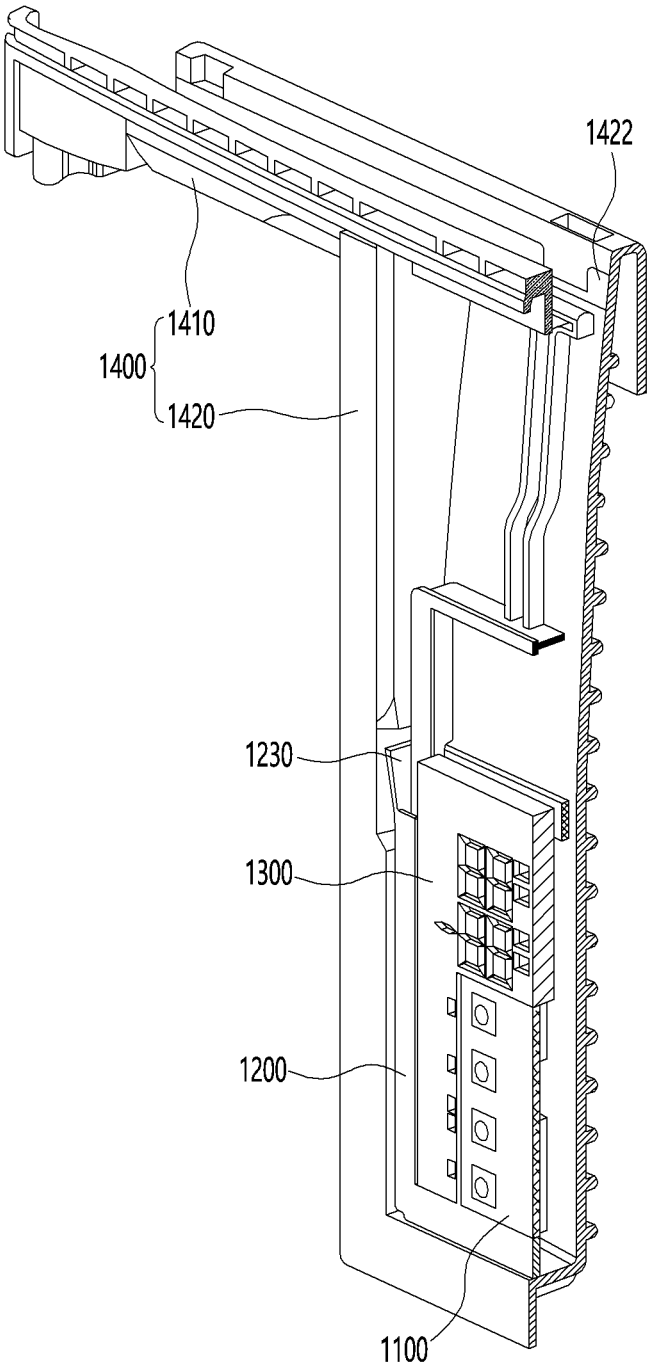
FIG. 33 is a partially cutaway perspective view of the internal configuration of the touch display device.
Figure 34:
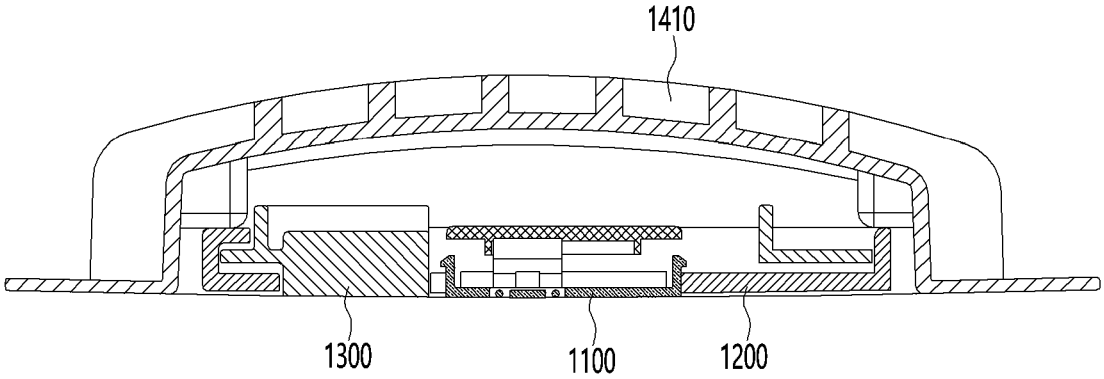
FIG. 34 is a plan cross-sectional view of the internal configuration of the touch display device.

FIG. 28 is an exploded perspective view illustrating an example of the touch display device 80 provided in the refrigerator door 20', and FIGS. 29 to 31 are perspective views respectively showing configurations of a cover assembly 1200, a frame assembly 1300 and a case assembly 1400. FIG. 32 is a perspective view showing a configuration of the touch display device 80, and FIG. 33 is a partial cut-away perspective view showing a configuration of the touch display device 80. FIG. 34 is a plan cross-sectional view of the touch display device 80.

As shown in the drawings, the touch display device 80 may be provided on the rear side of the front panel 21' to recognize a signal applied to the touch manipulation part 212' or display a state of the refrigerator 1' on the display part 211' or the like so that the user can visually recognize the state from the outside.

The touch display device 80 may include the touch assembly 1100 provided at a rear side of the touch manipulation part 212' of the refrigerator door 20' to detect a touch, the cover assembly 1200 on which the touch assembly 1100 is mounted, a frame assembly 1300 including a reflector 1310 that generates a signal displayed through the display part 211' and the like, the cover assembly 1400 in which the cover assembly 1200 and the frame assembly 1300 are accommodated, and the like.

The touch assembly 1100 may include a touch panel installed in close contact with the rear side of the touch manipulation part 212' and a sensor PCB that recognizes a touch signal. The touch assembly 1100 may be detachably mounted on the cover assembly 1200.

In some implementations, it is preferable that a plurality of fastening hooks or the like are provided at both left and right ends of the touch assembly 1100 to be detachably mounted to the cover assembly 1200.

In some implementations, the touch assembly 1100 may be integrally formed with the cover assembly 1200. For example, the sensor PCB provided in the touch assembly 1100 is accommodated inside the cover assembly 1200 and may be integrally molded such that a touch panel of the front surface is exposed to the front surface of the cover assembly 1200.

Further, the touch assembly 1100 may have the same structure as the touch sensor assembly 70 of the above-described implementation, and thus may be referred to as a touch sensor assembly.

The cover assembly 1200 may be formed to have a rectangular shape as a whole, and may be mounted on the case assembly 1400.

The cover assembly 1200 may include a touch box 1210 in which the touch assembly 1100 is accommodated, and a left guide 1220 and a right guide 1222 through which the frame assembly 1300 is slidably inserted and accommodated.

For example, the left guide 1220 and the right guide 1222 may have shapes symmetrical to each other and may be formed at left and right ends of the cover assembly 1200.

The left guide 1220 and the right guide 1222 may be formed to have a tunnel shape with an open left or right side, such that the left and right ends of the frame assembly 1300 are inserted thereto. In some implementations, it is preferable that the left guide 1220 is formed such that the right side thereof is open and has a cross section of a shape of ' c' (when viewed from above), and the right guide 1222 is formed such that the left side thereof is open and has a cross section of a shape of D (when viewed from above).

The touch box 1210 may be formed in the center of the lower portion of the cover assembly 1200 and have a rectangular shape having a vertical length longer than a horizontal length so as to correspond to an outer shape of the touch assembly 1100.

The touch box 1210 may be recessed rearward from the front surface of the cover assembly 1200 by a predetermined distance, and the front thereof may be open. Accordingly, the touch assembly 1100 may be accommodated and mounted through the front of the touch box 1210.

Fastening grooves 1212 are respectively formed in the left and right sides of the touch box 1210. The fastening grooves 1212 may be portions with which fastening hooks of the touch assembly 1100 is caught.

The lower end of the touch box 1210 may be connected to the lower end of the cover assembly 1200, and the right end of the touch box 1210 may be connected to the front surface of the right guide 1222. Accordingly, the lower portion of the front surface of the right guide 1222 may further extend to the left to form a connecting piece 1250, and the left end of the connecting piece 1250 may be integrally connected with the right end of the touch box 1210.

In some implementations, at upper ends of the left guide 1220 and the right guide 1222, a pair of extensions 1230 may be formed symmetrically to each other and configured to guide insertion of the frame assembly 1300. For example, the pair of extensions 1230 may be integrally formed at the upper ends of the left guide 1220 and the right guide 1222. A distance (left-right distance) between the pair of extensions 1230 can increase as they go upward.

For example, the extensions 1230 may be formed such that the distance between the upper ends of the left guide 1220 and the right guide 1222 gradually increase as they go upward. The extensions 1230 may serve to guide the lower end of the frame assembly 1300 to be smoothly inserted through the left guide 1220 and the right guide 1222.

A connecting extension 1240 may be further provided at upper ends of the left guide 1220 and the right guide 1222.

The connecting extension 1240 may be formed of a flat plate having a predetermined thickness, and may serve to securely connect and fix the upper ends of the left guide 1220 and the right guide 1222 to each other. For example, the connecting extension 1240 may serve to firmly support the upper ends of the left guide 1220 and the right guide 1222 such that they are not bent or deformed.

The cover assembly 1200 may be fixed in close contact with a rear surface of the front panel 21', or may be fixed to the case assembly 1400 or the like. For example, the cover assembly 1200 is preferably assembled to the front panel 21' or the like and is positioned to correspond to a button position of the front panel 21' to serve to recognize a button. In some implementations, it is preferable that the cover assembly 1200 is fixed to, for example, the front panel 21' with double-sided tape or the like to apply pressure to the touch panel.

In some implementations, the cover assembly 1200 may have the same structure as the display cover 30 of the above-described implementation. Accordingly, the cover assembly 1200 may also be referred to as a display cover. In addition, the touch box 1210 may have the same structure as the sensor assembly mounting portion 34 of the above-described implementation. Accordingly, the coupling structure of the touch assembly 1100 and the cover assembly 1200 may be the same as the coupling structure of the touch sensor assembly 70 and the display cover 30 as described above.

The frame assembly 1300 may include an LED, a display PCB, an 88 segment, and the like.

The frame assembly 1300 may be assembled to be slidably inserted into the cover assembly 1200 to receive a signal from the touch assembly 1100 and display information according to the cutout positions of the front panel 21'.

The frame assembly 1300 may have a rectangular shape having upper and lower lengths longer than left and right lengths, as a whole, and may be inserted into the cover assembly 1200 from the upper side to be accommodated.

The left and right ends of the frame assembly 1300 may be respectively inserted into and accommodated in the left guide 1220 and the right guide 1222 of the cover assembly 1200. In some implementations, it is preferable that at least the left and right ends of the lower half of the frame assembly 1300 are formed to have a thickness smaller than the inner spaces of the left guide 1220 and the right guide 1222.

Reinforcing ribs 302 for reinforcing strength may be further provided at both left and right ends or lower ends of the frame assembly 1300.

A reflector 1310 may be further integrally formed with the frame assembly 1300. For example, the frame assembly 1300 may be integrally provided with the reflector 1310 protruding further forward than the front surface of the frame assembly 1300.

The reflector 1310 may be formed to have a predetermined thickness in the front surface of a display PCB (for example, 50 in FIG. 11) on which an LED is provided, and may serve to guide the light of the LED toward the front panel 21' in front of the reflector 1310 and protect a display PCB provided on the rear side from static electricity. Accordingly, the reflector 1310 may be at least a part of the display frame 60 of the above-described implementation.

Because not only the front panel 21' is formed of stainless steel, but also a display PCB or the like needs to be disposed adjacent to a display part 211', it may be vulnerable to static electricity occurring during use due to the characteristics of the structure.

However, the reflector 1310 may enable the display PCB to be structurally spaced apart from the front panel 21' and light transmission to be facilitated, thereby protecting the display PCB from static electricity.

One or more holes may be formed in the frame assembly 1300 to reduce the weight thereof.

For example, a touch receiving hole 1320 with an open lower portion is formed to penetrate back and forth in the lower half of the frame assembly 1300. The touch receiving hole 1320 may be a portion where the touch box 1210 of the cover assembly 1200 is positioned.

A square-shaped through hole 1330 may be further formed to penetrate back and forth on the upper side of the reflector 1310.

A frame handle 1340 may be further formed at an upper end of the frame assembly 1300.

For example, the frame handle 1340 extending upward may be provided in a central portion of an upper end of the frame assembly 1300.

When the frame assembly 1300 is coupled to the cover assembly 1200, the frame handle 1340 may be formed to have a predetermined length vertically, and a user holds the frame handle 1340 and manipulates it.

The frame handle 1340 may include a first vertical portion 1342 extending upward from an upper end of the frame assembly 1300, an inclined portion extending obliquely upward to the rear upper side to a rear and upper side from an upper end of the first vertical portion 1342, a second vertical portion 1346 extending upward from an upper end of the inclined portion 1344, and a grip portion 1348 formed at an upper end of the second vertical portion 1346.

The first vertical portion 1342 and the second vertical portion 1346 may extend parallel to each other and may be connected by the inclined portion 1344. As described above, the frame handle 1340 is composed of the first vertical portion 1342, the second vertical portion 1346, and the inclined portion 1344. The grip portion 1348 that is spaced apart upward and rearward from the upper end of the frame assembly 1300 can facilitate assembly or separation of the frame assembly 1300 from the upper side of the refrigerator door 20'.

The grip portion 1348 is a portion configured to be held by a user by a hand. The grip portion 1348 may be formed to extend to the left and right at the upper end of the second vertical portion 1346.

Therefore, when the user inserts the frame assembly 1300, the user may hold the grip portion 1348 and perform insertion such that the lower end of the frame assembly 1300 is inserted downward through an upper entrance (not shown) of the refrigerator door 20'.

When the frame assembly 1300 is inserted downward of the refrigerator door 20', the lower end of the frame assembly 1300 are inserted into and mounted in a space between the left guide 1220 and the right guide 1222 through the extension 1230 of the cover assembly 1200.

In some implementations, the frame assembly 1300 may have the same structure as the display assembly 40 of the above-described implementation. Accordingly, the frame assembly 1300 may be referred to as a display assembly.

The case assembly 1400 may prevent a foaming liquid filled into the inside of the refrigerator door 20' from leaking to the touch display device 80, and also serve as an assembly path of the frame assembly 1300 that is slidably fastened to the cover assembly 1200 from the upper side.

As shown in the drawings, the case assembly 1400 may include a main portion 1410 in which the cover assembly 1200 and the like are accommodated, an upper portion 1420 formed at an upper side of the main portion 1410 to enable the case assembly 1400 to be mounted on the upper end of the refrigerator door 20', and the like.

The main portion 1410 and the upper portion 1420 may be detachably coupled to each other. The main portion 1410 may be formed to be elongated vertically, and the upper portion 1420 may be formed at the upper end of the main portion 1410 to have a predetermined length left and right.

The upper portion 1420 is preferably formed to have a shape corresponding to the upper end of the refrigerator door 20' or the upper end of the door liner 22', or to have a corresponding left-right length so as to be fastened to each other.

A central portion of the upper portion 1420 is formed to be recessed downward, and a frame entrance 1422 that guides, for example, the frame assembly 1300 to be pulled out upward or inserted downward from the upper side is preferably formed to penetrate up and down in the center of the upper portion 1420.

Therefore, although not shown in detail, the frame entrance 1422 is preferably formed to have a flat cross-section corresponding to sizes of the frame assembly 1300 in the left-right and front-rear directions such that the frame assembly 1300 can sufficiently pass through the frame entrance 1422 up and down.

The decor cover 1424 may be coupled to an upper end of the upper portion 1420.

The main portion 1410 is formed in a rectangular shape, and a central portion thereof is formed to be recessed rearward to define a cover space 1412. The cover space 1412 is a portion in which the cover assembly 1200, the frame assembly 1300 and the like are accommodated. Therefore, it is preferable that the recess depth of the cover space 1412 has a size corresponding to the thickness of the cover assembly 1200.

One or more cover support portions 1414 may be provided on the left and right sides of the cover space 1412 of the main portion 1410.

The cover support portions 1414 are preferably formed to correspond to each other on the left and right sides of the cover space 1412, and is preferably configured to press and support the left and right sides of the cover assembly 1200 from the rear.

Accordingly, in a state where the cover assembly 1200 is attached to the rear surface of the front panel 21', when the frame assembly 1300 is attached to the front panel 21' and a foaming liquid is applied to the inside of the refrigerator door 20', the cover support portions 1414 may push the cover assembly 1200 forward so that the cover assembly 1200 can maintain a state of being attached to the front panel 21'.

In particular, even when an adhesive member (not shown) that attaches the cover assembly 1200 to the front panel 21' is cured and loses its function, the cover support portion 1414 may maintain a state in which the front panel 21' and the cover assembly 1200 are in close contact with each other by pressing the cover assembly 1200.

In some implementations, it is preferable that a plurality of the cover support portions 1414 are arranged vertically at regular intervals so as to evenly press and support the entire cover assembly 1200.

In some implementations, it is preferable that ribs or protrusions are further formed on the front surface of the cover support portion 1414 adjacent to the cover assembly 1200 so as to be in line or point contact with the cover assembly 1200. In this case, even when the contact surface between the cover assembly 1200 and the cover support portion 1414 is uneven, the cover assembly 1200 is not be inclined, and the cover support portions 1414 may transmit pressure evenly to the cover assembly 1200.

In some implementations, it is possible to configure the cover support portions 1414 to have a shape corresponding to the left and right side ends of the cover assembly 1200 such that the rear end of the cover assembly 1200 is detachably attached to the cover support portion 1414.

A restraining groove 1416 is further formed on the upper side of the cover support portions 1414.

For example, a pair of restraining grooves 1416 may be formed left and right at the central portion of the main portion 1410. That is, as shown in the drawings, the central portion of the main portion 1410 is formed such that parts of the certain portion are recessed from left and right sides to form the restraining grooves 1416, and the extensions of the cover assembly 1200 may be accommodated in the restraining grooves 1416.

In some implementations, the main portion 1410 of the case assembly 1400 may have the same structure as the inner case 25 of the above-described implementation. Accordingly, the main portion 1410 may be referred to as the inner case 25.

Hereinafter, an example method for manufacturing and operating the refrigerator according to the present disclosure will be described with reference to FIGS. 1 to 11.

As shown in the drawings, in order to manufacture the refrigerator door 20', the front panel 21' is molded using a plate-shaped stainless steel as a material. In this case, a plurality of through holes constituting the display part 211' may be formed in the front panel 21' through etching or laser processing.

Although not shown in detail, the through holes may be filled by a sealing member or the like, and a diffusion sheet may be attached thereto. In addition, the touch manipulation part 212' may be formed in the front panel 21' by etching, surface processing, or printing.

The touch display device 80 is installed on the rear side of the front panel 21'. After all internal components are mounted on the touch display device 80, the case assembly 1400 may be attached to, for example, the front panel 21', and after the case assembly 1400 is fixed, the frame assembly 1300 and the like may be inserted.

First, the touch assembly 1100 may be integrally molded with the cover assembly 1200 or may be manufactured separately from and assembled to the cover assembly 1200.

When the touch assembly 1100 is manufactured separately from and assembled to the cover assembly 1200, the touch assembly 1100 may be pushed from the front of the touch box 1210 of the cover assembly 1200 to the touch box 1210.

In this case, the fastening hook formed in the touch assembly 1100 may be inserted into the fastening groove 1212 of the touch box 1210, and the touch assembly 1100 may be immediately fastened by one-touch.

The frame assembly 1300 is inserted into and accommodated in the cover assembly 1200. When the frame assembly 1300 is pushed from the upper side to the lower side of the cover assembly 1200, the lower end of the frame assembly 1300 may be guided through the extension 1230 of the cover assembly 1200 and accommodated between the left guide 1220 and the right guide 1222.

The cover assembly 1200 is preferably mounted on the main portion 1410 from the front of the case assembly 1400. A state in which both the cover assembly 1200 and the frame assembly 1300 are fastened to the case assembly 1400 is shown in FIG. 9.

When it is preferable that the touch display device 80 that has been assembled as described above is fixed in close contact with the rear side of the front panel 21', the upper end 1420 of the case assembly 1400 may be the upper end of the front panel 21'.

The frame assembly 1300 may be installed to be detachable to the outside of the refrigerator door 20' such that the frame assembly 1300 is drawn out upward through the frame handle 1340 even when the frame assembly 1300 has been fastened to the refrigerator door 20'.

The scope of the present disclosure is not limited to the implementations illustrated above, and many other modifications based on the present disclosure will be possible for those skilled in the art within the above technical scope.

What is claimed is:

1. A refrigerator comprising:

a cabinet that defines a storage space; and a door configured to open and close the storage space, wherein the door includes:

an outer plate that includes a metal material and that includes a front surface and a rear surface opposite to the front surface, wherein the front surface of the outer plate defines a front appearance of the door, and wherein the outer plate includes (i) a display part that includes a plurality of first through holes configured to display information of the refrigerator and (ii) a touch manipulation part that is connected to the display part and configured to receive a user input;

a display cover that is mounted to the rear surface of the outer plate;

an inner case that is mounted to the rear surface of the outer plate and surrounds the display cover, wherein the inner case and the outer plate define a space that communicates with an opening that is defined at a peripheral surface of the door;

a door liner that defines a rear surface of the door opposite to the front appearance of the door;

an insulating material that is disposed between the outer plate and the door liner;

a display assembly that is configured to be inserted into the display cover through the opening at the peripheral surface of the door, and that includes a plurality of light emitters configured to emit light that passes through the plurality of first through holes; and a touch sensor assembly that is mounted to the display cover at a position corresponding to the touch manipulation part and that is configured to detect a user's touch operation on the outer plate, wherein the touch manipulation part is disposed vertically below the display part, wherein the light emitters are positioned vertically above the touch sensor assembly based on the display assembly being inserted into the display cover, and wherein the display assembly includes:

a display printed circuit board (PCB) that includes the plurality of light emitters, and a display frame that is coupled to the display PCB and inserted into the display cover, wherein the display PCB is disposed between the display frame and the inner case.

2. The refrigerator of claim 1, wherein the display frame includes a lower end and an upper end opposite vertically to the lower end, and defines a lower opening that extends at the lower end of the display frame, and wherein the touch sensor assembly is positioned at the lower opening based on the display assembly being inserted into the display cover.

3. The refrigerator of claim 2, wherein the display frame includes:

a frame light guide that is positioned vertically above the lower opening, and that includes a plurality of third through holes configured to guide light emitted from the light emitters toward the first through holes; and a first side extension and a second side extension that extend vertically from opposite ends of the frame light guide, wherein the lower opening of the display frame is defined between the first side extension and the second side extension, and wherein, based on the display assembly being inserted into the display cover, the touch sensor assembly is inserted into the lower opening of the display frame.

4. The refrigerator of claim 3, wherein the first side extension and the second side extension include pressing protrusions that contact a rear surface of the display cover and press the display frame against the rear surface of the display cover.

5. The refrigerator of claim 1, wherein the display cover defines a sensor assembly mounting portion that is recessed from a front surface of the display cover to define a middle surface of the display cover, the front surface of the display cover being opposite to a rear surface of the display cover, wherein the touch sensor assembly is mounted on the middle surface of the display cover and the sensor assembly mounting portion, and wherein the touch sensor assembly includes:

a touch PCB that is received in the sensor assembly mounting portion and that mounts a touch sensor;

an elastic member that is mounted in the sensor assembly mounting portion and that supports the touch PCB; and a touch cover that is configured to close an open surface of the sensor assembly mounting portion and that contacts the rear surface of the outer plate and transmits the user's touch operation on the outer plate to the touch sensor.

6. A refrigerator comprising:

a cabinet that defines a storage space; and a door configured to open and close the storage space, wherein the door includes:

an outer plate that includes a metal material and that includes a front surface and a rear surface opposite to the front surface, wherein the front surface of the outer plate defines a front appearance of the door, and wherein the outer plate includes a display part that includes a plurality of first through holes configured to display information of the refrigerator;

a display cover that is mounted to the rear surface of the outer plate;

an inner case that is mounted to the rear surface of the outer plate and surrounds the display cover, wherein the inner case and the outer plate define a space that communicates with an opening that is defined at a peripheral surface of the door;

a door liner that defines a rear surface of the door opposite to the front appearance of the door;

an insulating material that is disposed between the outer plate and the door liner; and a display assembly that is configured to be inserted into the display cover through the opening at the peripheral surface of the door, wherein the display assembly includes:

a display frame that is inserted into the display cover and that defines a frame opening through the display frame;

a display PCB that is coupled to the display frame and disposed between the display frame and the inner case;

a light emitter that is mounted to a surface of the display PCB and faces the plurality of first through holes; and a microcomputer that is mounted to the surface of the display PCB and disposed in the frame opening.

7. The refrigerator of claim 6, wherein the display frame includes a frame light guide that contacts the surface of the display PCB and defines third through holes configured to guide light emitted from the light emitter toward the first through holes, and wherein the frame opening extends horizontally through the display frame and is disposed vertically above the frame light guide.

8. The refrigerator of claim 7, wherein a part of the display PCB to which the light emitter is mounted is shielded by the frame light guide, and wherein a part of the PCB to which the microcomputer is mounted is exposed through the frame opening.

9. The refrigerator of claim 6, wherein, based on the display assembly being inserted into the display cover, the frame opening is positioned vertically above the display cover, and the microcomputer is exposed to outside of the display cover.

10. The refrigerator of claim 6, wherein the display frame includes:

a first side extension and a second side extension that vertically extend from opposite sides and that are spaced apart from each other;

a frame light guide that connects the first side extension and the second side extension and that defines a third through hole configured to guide light emitted from the light emitter toward the first through holes; and a handle portion that extends vertically and connects ends of the first side extension and the second side extension, and wherein the frame opening is defined by the first side extension, the second side extension, the frame light guide, and the handle portion.

11. A refrigerator comprising:

a cabinet that defines a storage space; and a door configured to open and close the storage space, wherein the door includes:

an outer plate that includes a metal material and that includes a front surface and a rear surface opposite to the front surface, wherein the front surface of the outer plate defines a front appearance of the door, and wherein the outer plate includes a display part that includes a plurality of first through holes configured to display information of the refrigerator;

a display cover that is mounted to the rear surface of the outer plate;

an inner case that is mounted to the rear surface of the outer plate and surrounds the display cover, wherein the inner case and the outer plate define a space that communicates with an opening that is defined at a peripheral surface of the door;

a door liner that is coupled to the outer plate and defines a rear surface of the door opposite to the front appearance of the door;

an insulating material that is disposed between the outer plate and the door liner; and a display assembly that is configured to be inserted into the display cover through the opening at the peripheral surface of the door, wherein the display assembly includes a plurality of light emitters configured to emit light that passes through the plurality of first through holes, and wherein the display assembly includes:

a display PCB that includes a surface to which the plurality of light emitters are mounted;

a frame light guide that defines a third through hole and contacts the surface of the display PCB such that the light emitted from the plurality of light emitters are guided toward the plurality of first through holes;

a display frame that is coupled to the display PCB and connected to the frame light guide; and a handle portion that extends from an end of the display frame toward the opening at the peripheral surface of the door, wherein the display PCB is disposed between the display frame and the inner case.

12. The refrigerator of claim 11, wherein the display frame includes a plurality of fastening protrusions, wherein the display PCB defines a plurality of fastening holes that correspond to the fastening protrusions, and wherein the fastening protrusions of the display frame are engaged with the fastening holes of the display PCB such that the display frame and the display PCB are coupled to each other.

13. The refrigerator of claim 12, wherein the display frame includes a plastic material, and wherein ends of the plurality of fastening protrusions that extends through the plurality of fastening holes are fused and bonded around the fastening holes.

14. The refrigerator of claim 12, wherein the plurality of fastening protrusions and the plurality of fastening holes are disposed along the plurality of light emitters.

15. The refrigerator of claim 12, wherein the display frame defines a PCB accommodating space that is configured to receive the display PCB, and wherein the plurality of fastening protrusions are disposed at the PCB accommodating space.

16. A refrigerator comprising:

a cabinet that defines a storage space; and a door configured to open and close the storage space, wherein the door includes:

an outer plate that includes a metal material and that includes a front surface and a rear surface opposite to the front surface, wherein the front surface of the outer plate defines a front appearance of the door, and wherein the outer plate includes a display part that includes a plurality of first through holes configured to display information of the refrigerator;

a cover light guide that defines a plurality of second through holes;

a display cover that includes an open upper surface and is connected to the cover light guide such that the plurality of second through holes communicate with the plurality of first through holes of the display part, wherein the display cover is mounted to the rear surface of the outer plate;

an inner case that is mounted to the rear surface of the outer plate and surrounds the display cover, wherein the inner case and the outer plate define a space that communicates with an opening that is defined at the door;

a door liner that defines a rear surface of the door opposite to the front appearance of the door;

an insulating material that is disposed between the outer plate and the door liner; and a display assembly that is configured to be inserted into the display cover through the opening at the door, wherein the display assembly includes:

a display frame that includes a handle portion and a guide accommodating portion that is defined at a front surface of the display frame vertically below the handle portion;

a display PCB that is coupled to a rear surface of the display frame opposite to the front surface of the display frame and that is disposed between the display frame and the inner case; and a plurality of light emitters that are disposed at the display PCB and correspond to the guide accommodating portion of the display frame, wherein the plurality of light emitters are configured to emit light that passes through the second through holes and the first through holes, and wherein, based on the display assembly being inserted through the open upper surface of the display cover, the cover light guide of the door is received in the guide accommodating portion of the display frame.

17. The refrigerator of claim 16, wherein the display frame includes a frame light guide that contacts the display PCB and includes a plurality of third through holes configured to guide light emitted from the plurality of light emitters toward the first through holes, and wherein the guide accommodating portion is recessed at the frame light guide, and wherein the plurality of first through holes, the plurality of second through holes, and the plurality of third through holes communicate with one another based on the display assembly being inserted into the display cover.

18. The refrigerator of claim 17, wherein the display frame further include a first side extension and a second side extension that extend vertically from opposite side ends of the frame light guide, and that contact opposite side ends of the display cover, wherein a first side protrusion and a second side protrusion that extend vertically and are disposed at the first side extension and the second side extension, and wherein the display cover defines a first side opening and a second side opening that receive, and are engaged with, the first side protrusion and the second side protrusion based on the display assembly being inserted in to the display cover.

19. The refrigerator of claim 18, wherein the cover light guide is disposed between the first side opening and the second side opening.

20. The refrigerator of claim 18, wherein the frame light guide and the cover light guide includes inclined surfaces that are configured to contact each other and guide the cover light guide to the guide accommodating portion based on the display assembly being inserted into the display cover.

* * * * *